US012317970B2

(12) United States Patent
Paikin

(10) Patent No.: US 12,317,970 B2
(45) Date of Patent: Jun. 3, 2025

(54) GEMSTONE AND METHODS OF CUTTING THE SAME

(71) Applicant: Albert Gad Ltd., New York, NY (US)

(72) Inventor: Reuven Paikin, Windhoek (NA)

(73) Assignee: Albert Gad Ltd., New York, NY (US)

( * ) Notice: Subject to any disclaimer, the term of this patent is extended or adjusted under 35 U.S.C. 154(b) by 0 days.

(21) Appl. No.: 18/423,111

(22) Filed: Jan. 25, 2024

(65) Prior Publication Data

US 2024/0156219 A1 May 16, 2024

Related U.S. Application Data

(63) Continuation of application No. 17/376,679, filed on Jul. 15, 2021, now Pat. No. 11,918,089.

(60) Provisional application No. 63/063,117, filed on Aug. 7, 2020.

(51) Int. Cl.
*A44C 17/00* (2006.01)
*B28D 5/00* (2006.01)

(52) U.S. Cl.
CPC ..... *A44C 17/001* (2013.01); *A44C 17/005* (2013.01)

(58) Field of Classification Search
CPC ..... A44C 17/001; A44C 17/00; B28D 5/00
USPC ..... 63/32; 125/30.01; D11/90
See application file for complete search history.

(56) References Cited

U.S. PATENT DOCUMENTS 693,084 A 2/1902 Townsend
D286,388 S 12/1986 Ishida
D361,670 S 8/1995 McMillan
D414,133 S 9/1999 Parker
D444,097 S 6/2001 Cutshall
D452,457 S 12/2001 Tolkowsky
D457,090 S 5/2002 Stern
D466,436 S 12/2002 Tolkowsky
D474,995 S 5/2003 Mehta
D481,649 S 11/2003 Samuels
D493,119 S 7/2004 Goenka
6,761,044 B2 7/2004 Samuels
D493,745 S 8/2004 Cutshall
D496,603 S 9/2004 Sung et al.
D511,475 S 11/2005 Hirapara et al.
D512,936 S 12/2005 Sung et al.
(Continued)

FOREIGN PATENT DOCUMENTS

IN 3331040010001 9/2020

OTHER PUBLICATIONS

Chinese Trademark RGN. 303815004, Registered Aug. 24, 2016.
(Continued)

*Primary Examiner* — Jack W Lavinder
(74) *Attorney, Agent, or Firm* — Nixon Peabody LLP

(57) ABSTRACT

A gemstone includes a crown, a pavilion, and a girdle disposed between the crown and the pavilion. The girdle has a pear-shaped cross-section with a rounded end a tapered end narrower than the rounded end. The surface of the gemstone is generally divided into a number of groups of interlocking facets disposed at a variety of angles. The groups of facets comprising the surface of the crown generally include star facets, upper intermediate crown facets, lower intermediate crown facets, main crown facets, and upper girdle facets. The upper girdle facets generally abut an upper edge of the girdle. The groups of facets comprising the surface of the pavilion include culet-adjacent facets, candle facets, main pavilion facets, and lower girdle facets. The lower girdle facets generally abut a lower edge of the girdle.

20 Claims, 11 Drawing Sheets

(56) References Cited

U.S. PATENT DOCUMENTS

| | | | |
|---|---|---|---|
| D514,013 | S | 1/2006 | Voorn |
| D525,902 | S | 8/2006 | Dholakiya |
| D530,642 | S | 10/2006 | Botha |
| D546,232 | S | 7/2007 | Botha |
| D546,233 | S | 7/2007 | Botha |
| D556,624 | S | 12/2007 | Botha |
| D568,200 | S | 5/2008 | Chui |
| D569,757 | S | 5/2008 | Abel |
| D581,829 | S | 12/2008 | Hodara |
| 8,156,760 | B2 | 4/2012 | Gad |
| D671,859 | S | 12/2012 | Gersh |
| D726,578 | S | 4/2015 | Sishodia |
| D809,963 | S | 2/2018 | Mehta |
| D820,717 | S | 6/2018 | Mitchener |
| D839,767 | S | 2/2019 | Rydlewicz |
| D890,623 | S | 7/2020 | Paikin |
| 11,559,121 | B2 | 1/2023 | Paikin |
| D984,308 | S | 4/2023 | Mehta |
| 11,633,022 | B2 | 4/2023 | Paikin |
| 11,633,023 | B2 | 4/2023 | Paikin |
| D1,027,712 | S | 5/2024 | Paikin |
| D1,027,713 | S | 5/2024 | Paikin |
| 2003/0181147 | A1 | 9/2003 | Schachter |
| 2003/0192346 | A1 | 10/2003 | Samuels |
| 2005/0000405 | A1 | 1/2005 | Brookshire |
| 2011/0265514 | A1 | 11/2011 | Fakier |
| 2012/0060557 | A1 | 3/2012 | Van Looveren |
| 2016/0120274 | A1 | 5/2016 | Mezhibovsky |
| 2019/0274399 | A1 | 9/2019 | Tomasik |
| 2021/0212421 | A1 | 7/2021 | Paikin |
| 2021/0212422 | A1 | 7/2021 | Paikin |
| 2021/0361040 | A1 | 11/2021 | Paikin |
| 2022/0039525 | A1 | 2/2022 | Paikin |
| 2022/0218078 | A1 | 7/2022 | Kani |

OTHER PUBLICATIONS

Indian Trademark RGN. 255240-0001, Registered Jul. 15, 2013.

International Search Report and Written Opinion in International Application No. PCT/US2019/031374, mailed Jul. 3, 2019 (10 pages).

SPIE Digital Library. "Angular Spectrum Evaluation Tool analysis of the Crown of Light Diamond Cut." Retrieved from the Internet at <https://www.spiedigitallibrary.org/journals/optical-engineering/volume-59/issue-12/124104/Angular-Spectrum-Evaluation-Tool-analysis-of-the-Crown-of-Light/10.1117/1.OE.59.12.124104.full>; 11 Pages (2020).

GEMSTONE AND METHODS OF CUTTING THE SAME

CROSS-REFERENCE TO RELATED APPLICATIONS

The present application is a continuation of U.S. patent application Ser. No. 17/376,679, filed Jul. 15, 2021, now allowed, which claims the benefit of and priority to U.S. Provisional Patent Application No. 63/063,117, filed Aug. 7, 2020, each of which is hereby incorporated by reference herein in its entirety.

TECHNICAL FIELD

The present disclosure relates to gemstones, more specifically, the present disclosure relates to a pattern of facets of gemstones.

BACKGROUND

Some gemstones are designed/cut to produce a desirable amount of brilliance, or "sparkle" by forming or cutting a number of individual facets on the exterior surface of the gemstone. Other gemstones are designed/cut to enhance a natural color (e.g., yellow, pink, etc.) of the gemstone. However, it can be difficult to produce a gemstone having a layout of facets at specific angles that produce both a desirable amount of brilliance and also enhance the natural color of the gemstone. The present disclosure is directed to solving these problems and addressing other needs.

SUMMARY

According to some implementations of the present disclosure, a gemstone comprises a girdle, a crown, and a pavilion. The girdle defines a perimeter of the gemstone and has a pear-shaped cross-section. The pear-shaped cross section is an oval shape with a first rounded end and a second tapered end opposing the first rounded end. The second tapered end is narrower than the first rounded end. The crown forms an upper portion of the gemstone. A surface of the crown includes a table, a plurality of star facets, a plurality of upper intermediate crown facts, a plurality of lower intermediate crown facets, a plurality of main crown facets, and a plurality of upper girdle facets. The table forms a generally horizontal upper surface of the crown. Each of the plurality of star facets is disposed adjacent to and abuts an edge of the table. Each of the plurality of upper intermediate crown facets is disposed generally between two of the plurality of star facets. An upper vertex of each of the plurality of upper intermediate crown facets abuts a vertex of the table. Each of the plurality of lower intermediate crown facets is disposed generally between two of the plurality of upper intermediate crown facets. An upper vertex of each of the plurality of lower intermediate crown facets abuts a lower vertex of one of the plurality of star facets. Each of the plurality of main crown facets is disposed generally between two of the plurality of lower intermediate crown facets. An upper vertex of each of the plurality of main crown facets abuts a lower vertex of one of the plurality of lower intermediate crown facets. The plurality of upper girdle facets is formed in pairs of adjacent upper girdle facets. Each pair of adjacent upper girdle facets is disposed generally between two of the plurality of main crown facets. The upper vertices of both upper girdle facets in each pair of upper girdle facets abuts a lower vertex of one of the plurality of lower intermediate crown facets. A surface of the pavilion includes a plurality of culet-adjacent facets, a plurality of candle facets, a plurality of main pavilion facets, and a plurality of lower girdle facets. The plurality of culet-adjacent facets forms a lower point of the pavilion. A lower portion of each of the plurality of candle facets is disposed generally between two of the plurality of culet-adjacent facets. Each of the main pavilion facets is disposed between two of the plurality of candle facets. A lower edge of each of the plurality of main pavilion facets abuts an upper edge of one of the plurality of culet-adjacent facets. The plurality of lower girdle facets is formed in pairs of adjacent lower girdle facets. Each pair of adjacent lower girdle facets is disposed generally between two of the plurality of main pavilion facets. Each pair of adjacent lower girdle facets has an upper portion of a respective one of the plurality of candle facets disposed generally therebetween. The girdle is positioned between the crown and the pavilion. Each of the plurality of upper girdle facets is disposed adjacent to and abuts an upper edge of the girdle. Each of the plurality of lower girdle facets is disposed adjacent to and abuts a lower edge of the girdle.

According to some implementations of the present disclosure, a gemstone comprises a girdle and a crown. The girdle defines a perimeter of the gemstone and has a pear-shaped cross-section. A surface of the crown includes a table, a plurality of star facets, a plurality of upper intermediate crown facts, a plurality of lower intermediate crown facets, a plurality of main crown facets, and a plurality of upper girdle facets. The table forms a generally horizontal upper surface of the crown. Each of the plurality of star facets is disposed adjacent to and abuts an edge of the table. Each of the plurality of upper intermediate crown facets is disposed generally between two of the plurality of star facets. An upper vertex of each of the plurality of upper intermediate crown facets abuts a vertex of the table. Each of the plurality of lower intermediate crown facets is disposed generally between two of the plurality of upper intermediate crown facets. An upper vertex of each of the plurality of lower intermediate crown facets abuts a lower vertex of one of the plurality of star facets. Each of the plurality of main crown facets is disposed generally between two of the plurality of lower intermediate crown facets. An upper vertex of each of the plurality of main crown facets abuts a lower vertex of one of the plurality of lower intermediate crown facets. The plurality of upper girdle facets is formed in pairs of adjacent upper girdle facets. Each pair of adjacent upper girdle facets is disposed generally between two of the plurality of main crown facets. The upper vertices of both upper girdle facets in each pair of upper girdle facets abuts a lower vertex of one of the plurality of lower intermediate crown facets.

According to some implementations of the present disclosure, a gemstone comprises a girdle and a pavilion. The girdle defines a perimeter of the gemstone and has a pear-shaped cross-section. A surface of the pavilion includes a plurality of culet-adjacent facets, a plurality of candle facets, a plurality of main pavilion facets, and a plurality of lower girdle facets. The plurality of culet-adjacent facets forms a lower point of the pavilion. A lower portion of each of the plurality of candle facets is disposed generally between two of the plurality of culet-adjacent facets. Each of the main pavilion facets is disposed between two of the plurality of candle facets. A lower edge of each of the plurality of main pavilion facets abuts an upper edge of one of the plurality of culet-adjacent facets. The plurality of lower girdle facets is formed in pairs of adjacent lower girdle facets. Each pair of adjacent lower girdle facets is disposed generally between two of the plurality of main pavilion facets. Each pair of adjacent lower girdle facets has an upper portion of a respective one of the plurality of candle facets disposed generally therebetween.

According to some implementations of the present disclosure, a gemstone comprises a girdle, a crown, and a pavilion. The girdle defines a perimeter of the gemstone and has a pear-shaped cross-section. A surface of the crown includes a table, a plurality of star facets, a plurality of upper intermediate crown facts, a plurality of lower intermediate crown facets, a plurality of main crown facets, and a plurality of upper girdle facets. The table has a generally octagonal shape. The plurality of star facets is disposed adjacent to the table. Each of the plurality of star facets is triangle-shaped. The plurality of upper intermediate crown facets is disposed adjacent to the plurality of star facets. Each of the plurality of upper intermediate crown facets is kite-shaped. The plurality of lower intermediate crown facets is disposed adjacent to the plurality of upper intermediate crown facets. Each of the plurality of lower intermediate crown facets is kite-shaped. The plurality of main crown facets is disposed adjacent to the plurality of lower intermediate crown facets. Each of the plurality of main crown facets is kite-shaped. The plurality of upper girdle facets is disposed adjacent to the plurality of main crown facets. Each of the plurality of upper girdle facets is triangle-shaped. A surface of the pavilion includes a plurality of culet-adjacent facets, a plurality of candle facets, a plurality of main pavilion facets, and a plurality of lower girdle facets. The plurality of culet-adjacent facets forms a lower point of the pavilion. Each of the plurality of culet-adjacent facets has a generally pentagonal shape. The plurality of candle facets is disposed adjacent to the plurality of culet-adjacent facets. Each of the plurality of candle facets has six edges. Each of the main pavilion facets is disposed between two of the plurality of candle facets and has a generally pentagonal shape. The plurality of lower girdle facets is formed in pairs of adjacent lower girdle facets. Each pair of adjacent lower girdle facets is disposed generally between two of the plurality of main pavilion facets. Each lower girdle facet has four edges. The girdle is positioned between the crown and the pavilion. Each of the plurality of upper girdle facets is disposed adjacent to and abuts an upper edge of the girdle. Each of the plurality of lower girdle facets is disposed adjacent to and abuts a lower edge of the girdle.

According to some implementations of the present disclosure, a gemstone comprises a crown, a pavilion, and a girdle. The crown forms an upper portion of the gemstone. The pavilion forms a lower portion of the gemstone. The girdle is positioned between the crown and the pavilion, and encircles the gemstone. The girdle has a pear-shaped cross-section with a first rounded end and a second tapered end narrower than the first rounded end. The gemstone has a top depth percentage between about 15% and about 35%, and a bottom depth percentage between about 45% and about 60%.

According to some implementations of the present disclosure, a gemstone comprises a crown, a pavilion, and a girdle. The crown forms an upper portion of the gemstone. The pavilion forms a lower portion of the gemstone. The girdle is positioned between the crown and the pavilion, and encircles the gemstone. The girdle has a pear-shaped cross-section with a first rounded end and a second tapered end narrower than the first rounded end. The gemstone has a total depth percentage between about 75% and about 88%.

According to some implementations of the present disclosure, a gemstone comprises a crown forming an upper portion of the gemstone and a pavilion forming a lower portion of the gemstone. The surface of the crown is defined by a first plurality of facets, each of the first plurality of facets being disposed at an angle between about 8° and about 58° relative to an upper surface of the gemstone. The surface of the pavilion is defined by a second plurality of facets, each of the second plurality of facets being disposed at an angle between about 28° and about 54° relative to the upper surface of the gemstone.

According to some implementations of the present disclosure, a method of forming a crown of a gemstone comprises forming a generally horizontal upper surface on an upper portion of the gemstone; forming a first temporary set of crown facets, the first temporary set of crown facets being formed at an angle of between about 42° and about 48° relative to the generally horizontal upper surface; forming a second temporary set of crown facets on the upper portion of the gemstone from portions of the generally horizontal upper surface and the first temporary set of crown facets, the second temporary set of crown facets being formed at an angle of between about 18° and about 35° relative to the generally horizontal upper surface, a remainder of the first temporary set of crown facets forming a third temporary set of crown facets; forming a fourth temporary set of crown facets on the upper portion of the gemstone from portions of the generally horizontal upper surface and the second temporary set of crown facets, the fourth temporary set of crown facets being formed at an angle of between about 10° and about 24° relative to the generally horizontal upper surface, a remainder of the second temporary set of crown facets forming a first final set of crown facets; forming a second final set of crown facets on the upper portion of the gemstone from portions of the third temporary set of crown facets, the second final set of crown facets being formed at an angle of between about 46° and about 58° relative to the generally horizontal upper surface, a remainder of the third temporary set of crown facets forming a third final set of crown facets; and forming a fourth final set of crown facets on the upper portion of the gemstone from portions of the generally horizontal surface and the fourth temporary set of crown facets, the fifth final set of crown facets being formed at an angle of between about 8° and about 18° relative to the generally horizontal upper surface, a remainder of the fourth temporary set of crown facets forming a fifth final set of crown facets, such that the upper portion of the gemstone is formed from the first, second, third, fourth, and fifth final sets of crown facets.

According to some implementations of the present disclosure, a method of forming a pavilion of a gemstone comprises forming a first temporary set of pavilion facets, the first temporary set of pavilion facets being formed at an angle of between about 41° and about 45° relative to the horizontal upper surface, the first temporary set of facets forming a lower point; forming a second temporary set of pavilion facets on the lower portion of the gemstone from portions of the first temporary set of pavilion facets, the second temporary set of facets being formed at an angle of between about 36.5° and about 40° relative to the horizontal upper surface, a remainder of the first temporary set of pavilion facets forming a third temporary set of pavilion facets; forming a fourth temporary set of pavilion facets on the lower portion of the gemstone from portions of the second temporary set of pavilion facets and the third temporary set of pavilion facets, the fourth temporary pavilion facets being formed at an angle of between about 33° and about 45° relative to the horizontal upper surface, a remainder of the second temporary set of pavilion facets forming a first final set of pavilion facets, a remainder of the third temporary set of pavilion facets forming a fifth temporary set of pavilion facets; and forming a second final set of pavilion facets on the lower portion of the gemstone from portions of the fourth temporary set of pavilion facets and the fifth temporary set of pavilion facets, the second final set of pavilion facets being formed at an angle of between about 42° and about 54°, a remainder of the fourth temporary set of pavilion facets forming a third final set of pavilion facets, a remainder of the fifth temporary set of pavilion facets forming a fourth final set of pavilion facets, such that the lower portion of the gemstone is formed from the first, second, third, and fourth final sets of pavilion facets.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1A:
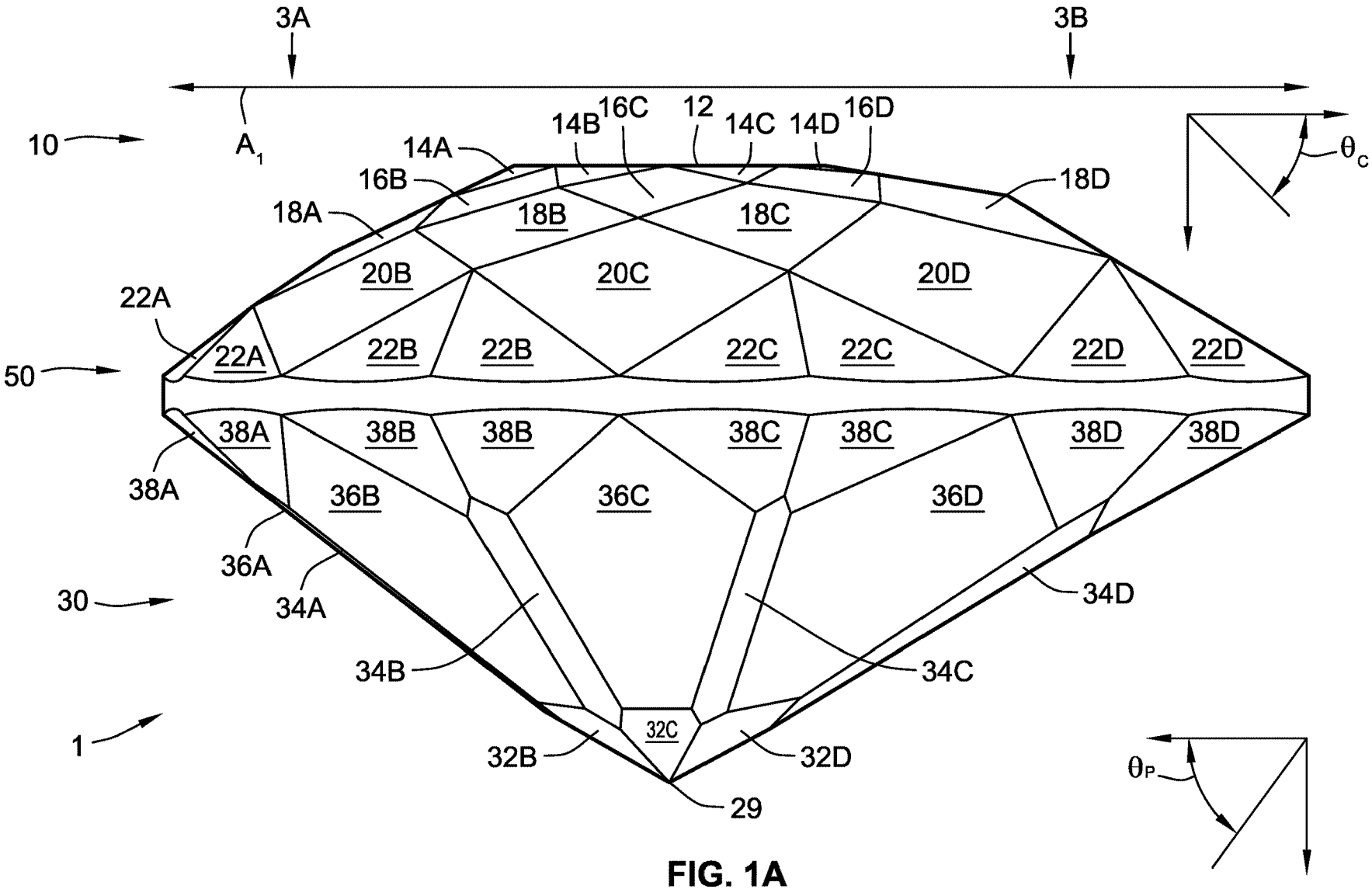
FIG. 1A is a first elevation view of a gemstone along a major axis, according to some implementations of the present disclosure.

While the present disclosure is susceptible to various modifications and alternative forms, specific implementations and embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

Figure 1B:
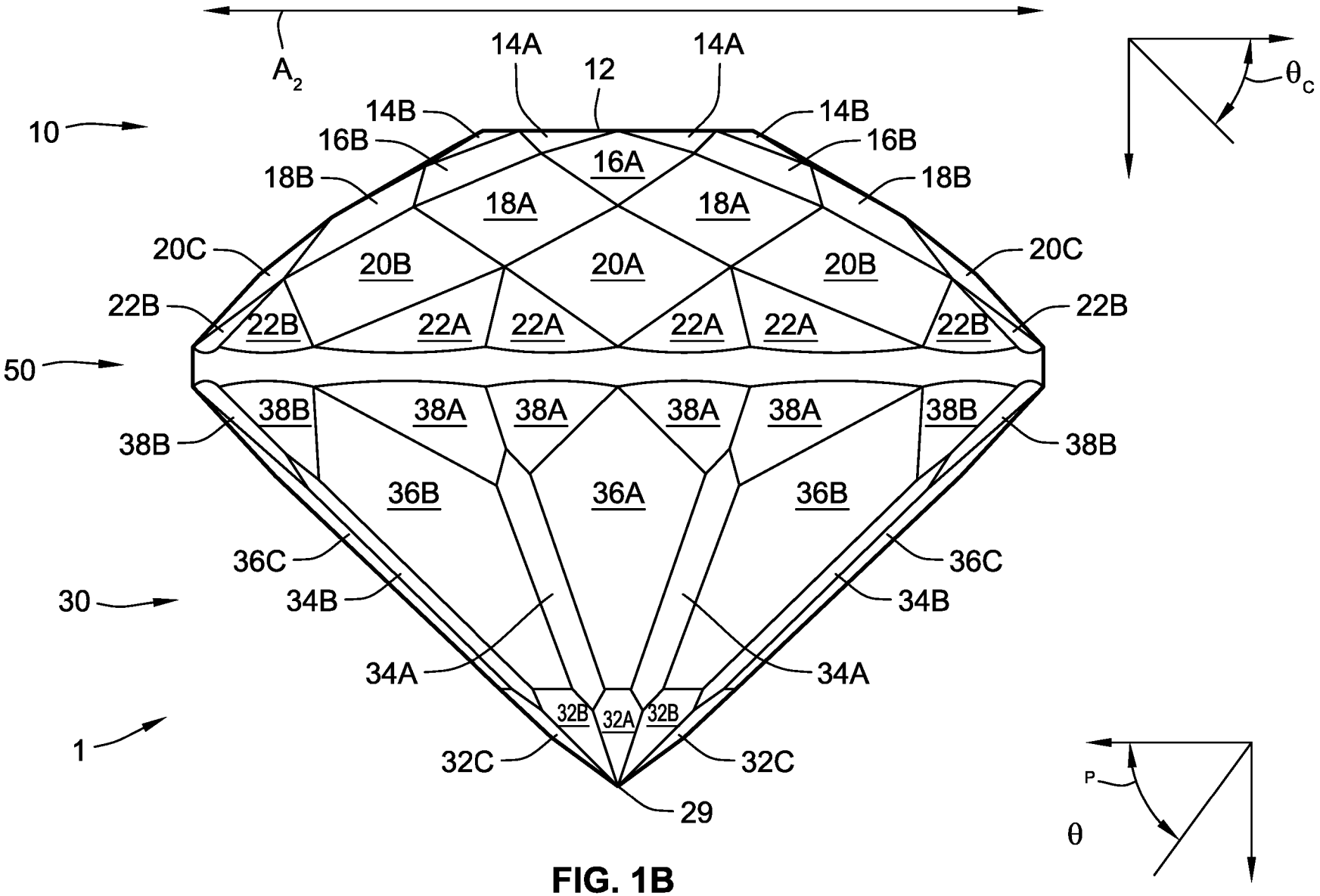
FIG. 1B is a second elevation view of the gemstone of FIG. 1A along a minor axis, according to some implementation of the present disclosure.
Figure 2:
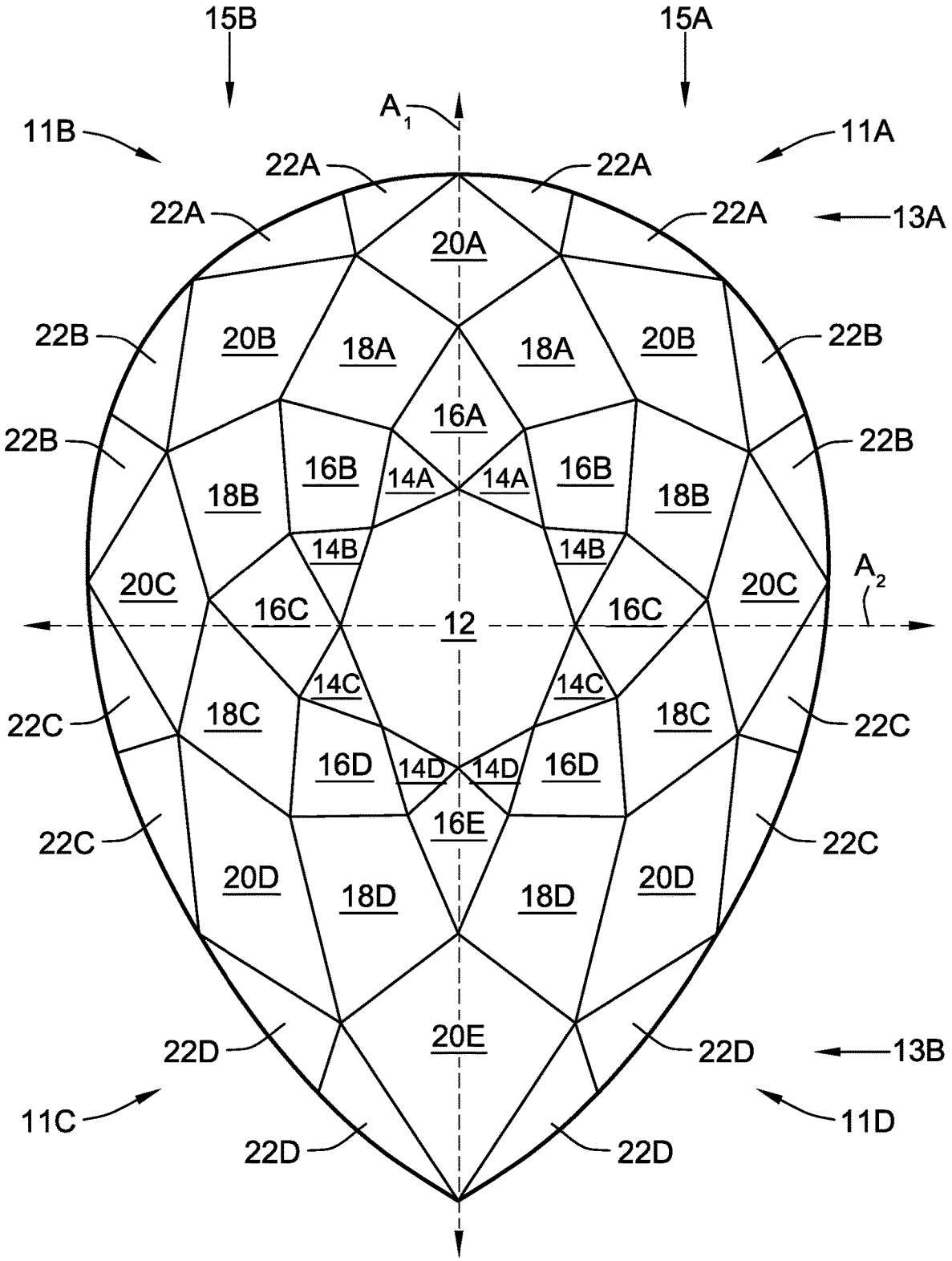
FIG. 2 is a top plan view of the gemstone of FIGS. 1A and 1B, according to some implementations of the present disclosure.

FIGS. 1A and 1B illustrate elevation views of an implementation of the gemstone 1. The gemstone 1 is generally divided into a crown 10 formed as the upper portion of the gemstone 1, a pavilion 30 formed as the lower portion of the gemstone 1, and a girdle 50, which is generally disposed between the crown 10 and the pavilion 30. The girdle 50 generally encircles the entire circumference of the gemstone 1. The crown 10 generally has a flat top surface (as seen in FIG. 2), referred to as a table 12. The lower portion of the gemstone 1 at the pavilion 30 can terminate in a lower point 29 as shown in FIGS. 1A and 1B, or can terminate in a flat facet called a culet. The gemstone 1 is generally a precious stone, such as but not limited to a diamond, ruby, emerald, sapphire, or pearl. The gemstone 1 can also be a synthetic material, such as cubic zirconium. More broadly, the gemstone 1 can include any material capable of being cut, such as, for example, precious or non-precious stones, cubic zirconia, ceramic, metal, plastic, wood, etc.

Figure 3:
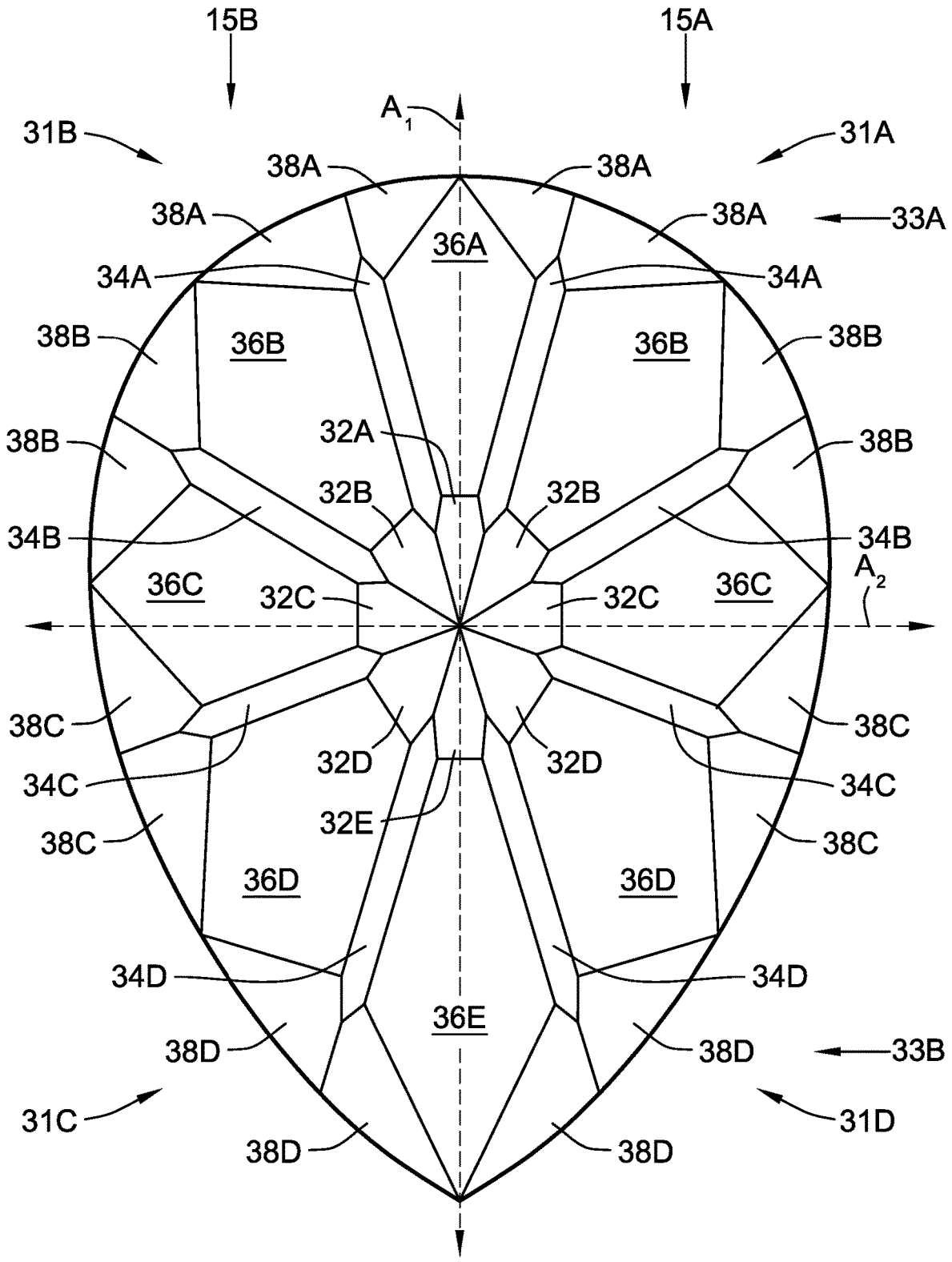
FIG. 3 is a bottom plan view of the gemstone of FIGS. 1A and 1B, according to some implementations of the present disclosure.

The girdle 50 is generally the widest portion of the gemstone 1. When the gemstone 1 is viewed from above or below (e.g., the view in FIGS. 2 and 3, respectively), the girdle 50 defines the outer perimeter of the gemstone 1. The gemstone 1 has a pear shape. The pear shape is generally an oval shape with two opposing ends, where the first end is rounded, and the second end is tapered, and thus narrower than the first end. Thus, the girdle 50 and the perimeter of the gemstone 1 have a pear-shaped cross-section, which generally has one rounded end 3A and one tapered end 3B. As shown in FIGS. 2 and 3, the tapered end 3B can terminate in a point.

The cross-section of the girdle 50 and the gemstone 1 has a major axis $A_1$ and a minor axis $A_2$ that are generally perpendicular to each other. The major axis $A_1$ extends between the rounded end 3A and the tapered end 3B. The minor axis $A_2$ extends between opposite sides of the gemstone 1. The dimension of the gemstone 1 along the major axis $A_1$ is larger than the dimension of the gemstone 1 along the minor axis $A_2$. In some implementations, the ratio of the dimension along the major axis $A_1$ to the dimension along the minor axis $A_2$ is about 1.50 to 1.28. In other implementation, the ratio is about 1.1 or about 1.2. In still other implementations, the ratio is greater than 1.0 and less than or equal to 2.0, greater than 1.0 and less than or equal to 1.5, greater than 1.0 and less than or equal to 1.3. In further implementations, the ratio is about 1.17.

Viewing FIG. 1A, the major axis $A_1$ extends horizontally relative to the plane of FIG. 1A, while the minor axis $A_2$ (not shown) extends into and out of the plane of FIG. 1A.

Viewing FIG. 1B, the minor axis $A_2$ extends horizontally relative to the plane of FIG. 1B, while the major axis $A_1$ (not shown) extends into and out of the plane of FIG. 1B. Generally, the gemstone 1 is symmetric about the major axis $A_1$, and asymmetric about the minor axis $A_2$.

In other implementations, the gemstone 1 can have a shape that differs from the shape shown in FIGS. 1A and 1B. For example, in some implementations, the gemstone 1 can have generally equal dimension along the major and minor axes $A_1$ and $A_2$, while remaining symmetric about the major axis $A_1$ and asymmetric about the minor axis $A_2$. In additional or alternative implementations, the tapered end 2A does not taper to a point, but instead tapers to a rounded end or a flat end. Generally, if end 2A tapers to a rounded end, end 2A will have a smaller radius of curvature than end 2B, e.g., the curvature of the end 2A will be more sudden than the gradual curvature of the end 2B. As shown in FIGS. 2 and 3, the distance of the gemstone 1 along the minor axis $A_2$ is less at the tapered end than at the rounded end, which is thus narrower than the rounded end.

The dimensional characteristics of the gemstone 1 are based off of the width of the gemstone 1. The width of the gemstone 1 is the distance between the sides of the gemstone 1 at the girdle. In these implementations, the width of the gemstone 1 is the dimension of the gemstone 1 along the minor axis $A_2$, at the girdle 50. In other implementations, the other measurements of the gemstone 1 could also be used as the width, to determine the dimensional characteristics of the gemstone 1.

The gemstone 1 has a table percentage that is a measure of a width or diameter of the table of the gemstone 1. The table can be formed in a variety of shapes, as thus the measure of the width of the table can vary. In an implementation, the table is a circle, and thus the diameter of the circle is used to express the table percentage of the gemstone 1. In another implementation, the table is an octagon, and either the distance between opposing edges of the octagon or between opposing vertices of the octagon is used to express the table percentage. The table percentage is generally expressed as the width of the table 12 divided by the width of the gemstone 1. In an implementation, the table percentage is between about 27.0% and about 40.0%. In a further implementation, the table percentage is between about 30.0% and about 35.0%. In an additional implementation, the table percentage is between about 25.0% and about 45.0%. In yet a further implementation the table percentage is about 33.5%.

The gemstone 1 has a top depth percentage that is a measure of the height of the crown 10 of the gemstone 1. The top depth percentage is generally expressed as the height of the crown 10 divided by the width of the gemstone 1. In an implementation, the top depth percentage is between about 22.0% and about 29.0%. In another implementation, the top depth percentage is between about 20.0% and about 30.0%. In a further implementation, the top depth percentage is between about 15.0% and about 35.0%. In yet a further implementation the top depth percentage is about 25.5%.

The gemstone 1 has a bottom depth percentage that is a measure of the total height of the pavilion 30 of the gemstone 1. The bottom depth percentage is generally expressed as the height of the pavilion 30 divided by the width of the gemstone 1. In an implementation, the bottom depth percentage is between about 45.0% and about 52.0%. In another implementation, the bottom depth percentage is between about 43.0% and about 55%. In a further implementation the bottom depth percentage is between about 40% and about 60%. In still another implementation, the bottom depth percentage is about 48.5%.

The gemstone 1 has a girdle thickness percentage that is a measure of the total height of the girdle 50 of the gemstone 1. The girdle thickness percentage is generally expressed as the height of the girdle 50 divided by the width of the gemstone 1. In an implementation, the girdle thickness percentage is between about 3.5% and about 6.5%. In another implementation, the girdle thickness percentage is between about 2.0% and about 8.0%. In a further implementation, the girdle thickness percentage is greater than about 0.0% and less than about 10.0%. In yet a further implementation the girdle thickness percentage is about 5.0%.

The gemstone 1 has a total depth percentage that is a measure of the total height of the gemstone 1. The total depth percentage is generally expressed as the height of the gemstone 1 divided by the width of the gemstone 1. The total depth percentage may also be expressed as the sum of the top depth percentage, the bottom depth percentage, and the girdle thickness percentage. In an implementation, the total depth percentage is between about 75.0% and about 88.0%. In another implementation, the total depth percentage is between about 70.0% and about 90.0%. In further implementation, the total depth percentage is between about 78.0% and about 82.0%. In yet a further implementation the total depth percentage is about 88.0%. In an even further implementation, the total depth percentage is about 81.0%.

The surface of the gemstone 1 is generally divided into a number of groups of interlocking facets disposed at a variety of angles. The facets comprising the surface of the crown 10 generally include a table 12; star facets 14A, 14B, 14C, and 14D; upper intermediate crown facets 16A, 16B,16C, 16D, and 16E; lower intermediate crown facets 18A, 18B, 18C, and 18D; main crown facets 20A, 20B, 20C, 20D, and 20E; and upper girdle facets 22A, 22B, 22C, and 22D. The upper girdle facets 22A-22C generally abut an upper edge of the girdle 50.

The groups of facets comprising the surface of the pavilion 30 include culet-adjacent facets 32A, 32B, 32C, 32D, and 32E; candle facets 34A, 34B, 34C, and 34D; main pavilion facets 36A, 36B, 36C, 36D, and 36E; and lower girdle facets 38A, 38B, 38C, 38D, and 38E. The lower girdle facets 38A-38E generally abut a lower edge of the girdle 50.

In some implementations, the girdle 50 is a continuous pear-shaped facet that encircles the entirety of the gemstone 1. Thus, in these implementations, the cross-section of the girdle 50 is a generally continuous curve that tapers to the point at the tapered end 2A. In other implementations, the girdle 50 is divided into a plurality of sub-facets. In yet other implementations, each sub-facet of the girdle 50 comprises a plurality of individual facets. As shown in FIGS. 1A and 1B, the upper edge of the girdle 50 that abuts the crown 10 may be generally straight or may be curved, when viewed from the side. Similarly, the lower edge of the girdle 50 that abuts the pavilion 30 may be generally straight or may be curved, when viewed from the side.

The angles that each of the facets of the crown 10 are disposed at may be measured relative to a horizontal plane defined by the table of the gemstone 1 (e.g. the top surface of the gemstone 1). As shown in the upper set of axes in FIGS. 1A and 1B, each of the facets of the crown 10 is formed at an angle $\theta_C$ relative to the horizontal plane defined by the table of the gemstone 1. As is shown in FIGS. 1A and 1B, the angle $\theta_C$ that each of the facets of the crown 10 are disposed at is formed by rotating downward from the horizontal plane defined by the table.

Generally, every facet within a group of facets is disposed at the same angle or at an angle within the same range, and has a generally identical shape. For example, each of the main crown facets 20B is disposed at the same angle or at an angle within the same range as the other main crown facets 20B, and also has the same shape as the other main crown facets 20B. Similarly, each of the main crown facets 20C is disposed at the same angle or at an angle within the same range as the other main crown facets 20C, and also has the same shape as the other main crown facets 20C.

In some implementations, two different groups of facets can have different shapes, but the range of angles for the two groups of facets can overlap or can be the same, such that two facets within the two groups of facets may have identical or substantially identical angles, but different shapes. In some implementations, two different groups of facets can be disposed at different angles or at angles within different ranges, but can have generally identical shapes.

As referred to herein, the various facets are generally sorted into groups of facets based on their position on the crown 10 or the pavilion 30. Different groups of facets sharing a common name generally have the same position on the crown 10 or the pavilion 30, and have similar shapes. However, as is discussed in more detail below, due to the asymmetric cross-sectional shape of the gemstone 1 (e.g., oval-shaped with a rounded end 2A and a tapered end 2B), different groups of facets sharing a common name will generally have slightly different shapes. For example, all of the main crown facets (including the main crown facets 20A, 20B, 20C, 20D, and 20E) are positioned generally between lower intermediate crown facets and upper girdle facets, and are all generally kite-shaped. However, the kite shape of the main crown facets 20A can be different than the kite shape of the main crown facets 20B.

In an implementation, the angle of each of the star facets 14A, 14B, 14C, and 14D is between about 8° and about 18°. In another implementation, the angle of each of the star facets 14A, 14B, 14C, and 14D is between about 3° and about 20°. In a further implementation, the angle of each of the star facets 14A, 14B, 14C, and 14D is about 13°.

In an implementation, the angle of each of the upper intermediate crown facets 16A, 16B, and 16C between about 15° and about 24°. In another implementation, the angle of each of the upper intermediate crown facets 16A, 16B, and 16C is between about 8° and about 30°. In a further implementation, the angle of each of the upper intermediate crown facets 16A, 16B, and 16C is between about 17° and about 21°. In yet another implementation, the angle of each of the upper intermediate crown facets 16A, 16B, and 16C is about 19.5°.

In an implementation, the angle of each of the upper intermediate crown facets 16D and 16E between about 10° and about 18°. In another implementation, the angle of each of the upper intermediate crown facets 16D and 16E is between about 5° and about 25°. In a further implementation, the angle of each of the upper intermediate crown facets 16D and 16E is about 14°.

In an implementation, the angle of each of the lower intermediate crown facets 18A, 18B, and 18C is about between about 25° and about 35°. In another implementation, the angle of each of the lower intermediate crown facets 18A, 18B, and 18C is between about 15° and about 40°. In a further implementation, the angle of each of the lower intermediate crown facets 18A, 18B, and 18C is between about 29° and about 32°. In yet another further implementation, the angle of each of the lower intermediate crown facets 18A, 18B, and 18C is about 30°.

In an implementation, the angle of each of the lower intermediate crown facets 18D is about between about 18° and about 28°. In another implementation, the angle of each of the lower intermediate crown facets 18D is between about 15° and about 40°. In a further implementation, the angle of each of the lower intermediate crown facets 18D is between about 20° and about 25°. In yet another further implementation, the angle of each of the lower intermediate crown facets 18D is about 23°.

In an implementation, the angle of each of the main crown facets 20A and 20B is between about 42° and about 48°. In another implementation, the angle of each of the main crown facets 20A and 20B is between about 40° and about 50°. In still another implementation, the angle of each of the main crown facets 20A and 20B is between about 35° and about 55°. In a further implementation, the angle of each of the main crown facets 20A and 20B is about 45°.

In an implementation, the angle of each of the main crown facets 20C and 20D is between about 44° and about 48°. In another implementation, the angle of each of the main crown facets 20C and 20D is between about 40° and about 50°. In still another implementation, the angle of each of the main crown facets 20C and 20D is between about 35° and about 55°. In a further implementation, the angle of each of the main crown facets 20C and 20D is about 45°.

In an implementation, the angle of each of the main crown facets 20E is between about 25° and about 35°. In another implementation, the angle of each of the main crown facets 20E is between about 20° and about 40°. In still another implementation, the angle of each of the main crown facets 20E is between about 15° and about 45°. In a further implementation, the angle of each of the main crown facets 20E is about 30°.

In an implementation, the angle of each of the upper girdle facets 22A, 22B, 22C, and 22D is between about 46° and about 58°. In a further implementation, the angle of each of the upper girdle facets 22A, 22B, 22C, and 22D is between about 40° and about 60°. In a further implementation, the angle of each of the upper girdle facets 22A, 22B, 22C, and 22D is between about 50° and about 54°. In a further implementation, the angle of each of the upper girdle facets 22A, 22B, 22C, and 22D is about 52°.

The angles that each of the facets of the pavilion 30 are disposed at may also be measured relative to the horizontal plane defined by the table 12 of the gemstone 1 (e.g. the top surface of the gemstone 1). As shown in the lower set of axes in FIGS. 1A and 1B, each of the facets of the pavilion 30 is formed at an angle $\theta_P$ relative to this horizontal plane defined by the table 12 of the gemstone 1. As is shown in FIGS. 1A and 1B, the angle $\theta_P$ that each of the facets of the pavilion 30 are disposed at is formed by rotating downward from the horizontal plane defined by the table 12.

In an implementation, the angle of each of the culet-adjacent facets 32A-32E is between about 36.5° and about 40°. In another implementation, the angle of each of the culet-adjacent facets 32A-32E is between about 30° and about 45°. In still another implementation, the angle of each of the culet-adjacent facets 32A-32E is between about 25° and about 50°. In yet another implementation, the angle of each of the culet-adjacent facets 32A-32E is about 38.5°.

In an implementation, the angle of each of the candle facets 34A is between about 33° and about 40°. In another implementation, the angle of each of the candle facets 34A is between about 30° and about 45°. In another implementation, the angle of each of the candle facets 34A is between about 35° and about 50°. In yet another implementation, the angle of each of the candle facets 34A is about 36.5°.

In an implementation, the angle of each of the candle facets 34B is between about 36° and about 42°. In another implementation, the angle of each of the candle facets 34B is between about 35° and about 45°. In another implementation, the angle of each of the candle facets 34B is between about 30° and about 50°. In yet another implementation, the angle of each of the candle facets 34B is about 39°.

In an implementation, the angle of each of the candle facets 34C is between about 40° and about 45°. In another implementation, the angle of each of the candle facets 34C is between about 35° and about 50°. In another implementation, the angle of each of the candle facets 34C is between about 30° and about 55°. In yet another implementation, the angle of each of the candle facets 34C is about 37.5°.

In an implementation, the angle of each of the candle facets 34D is between about 28° and about 35°. In another implementation, the angle of each of the candle facets 34D is between about 25° and about 40°. In another implementation, the angle of each of the candle facets 34D is between about 20° and about 45°. In yet another implementation, the angle of each of the candle facets 34D is about 31.5°.

In an implementation, the angle of each of the main pavilion facets 36A is between about 32° and about 40°. In another implementation, the angle of each of the main pavilion facets 36A is between about 25° and about 50°. In still another implementation, the angle of each of the main pavilion facets 36A is between about 34° and about 38°. In yet another implementation, the angle of each of the main pavilion facets 36A is about 36°.

In an implementation, the angle of each of the main pavilion facets 36B is between about 37° and about 44°. In another implementation, the angle of each of the main pavilion facets 36B is between about 35° and about 45°. In still another implementation, the angle of each of the main pavilion facets 36B is between about 30° and about 50°. In yet another implementation, the angle of each of the main pavilion facets 36A is about 40.5°.

In an implementation, the angle of each of the main pavilion facets 36C is between about 44° and about 48°. In another implementation, the angle of each of the main pavilion facets 36C is between about 40° and about 50°. In still another implementation, the angle of each of the main pavilion facets 36C is between about 35° and about 55°. In yet another implementation, the angle of each of the main pavilion facets 36C is about 46°.

In an implementation, the angle of each of the main pavilion facets 36D is between about 42° and about 47°. In another implementation, the angle of each of the main pavilion facets 36D is between about 40° and about 50°. In still another implementation, the angle of each of the main pavilion facets 36D is between about 35° and about 55°. In yet another implementation, the angle of each of the main pavilion facets 36D is about 44.5°.

In an implementation, the angle of each of the main pavilion facets 36E is between about 28° and about 35°. In another implementation, the angle of each of the main pavilion facets 36E is between about 25° and about 40°. In still another implementation, the angle of each of the main pavilion facets 36E is between about 20° and about 45°. In yet another implementation, the angle of each of the main pavilion facets 36E is about 31.5°.

In an implementation, the angle of each of the lower girdle facets 38A, 38B, 38C, and 38D is between about 42° and about 54°. In another implementation, the angle of each of the lower girdle facets 38A, 38B, 38C, and 38D is between about 40° and about 55°. In yet another implementation, the angle of each of the lower girdle facets 38A, 38B, 38C, and 38D is between about 35° and about 60°. In yet a further implementation, the angle of each of the lower girdle facets 38A, 38B, 38C, and 38D is between about 45° and about 50. In still a further implementation, the angle of each of the lower girdle facets 38A, 38B, 38C, and 38D is about 48°.

Referring now to FIG. 2, a top plan view of the gemstone 1 showing the facets forming the crown 10 is illustrated. In describing the facets of the crown 10 shown in FIG. 2, reference is made to the rounded end 13A and the tapered end 13B of the crown 10, and the first side 15A and the second side 15B of the crown 10. The ends 13A and 13B of the crown 10 generally correspond to the ends 3A and 3B of the gemstone 1.

The major axis $A_1$ of the perimeter of the gemstone (which is formed by the girdle 50) extends vertically relative to the plane of FIG. 2 (between the first side 15A of the crown 10 and the second side 15B of the crown 10), while the minor axis $A_2$ extends horizontally relative to the plane of FIG. 2 (between the rounded end 13A of the crown 10 and the tapered end 13B of the crown 10). As shown in FIG. 2, the major axis $A_1$ divides the table 12 between a left portion and right portion, and the minor axis $A_2$ divides the table 12 into a top portion and a bottom portion. However, while the major axis $A_1$ divides the crown 10 generally in half between the first side 15A and the second side 15B, the minor axis $A_2$ generally does not divide the crown 10 in half between the rounded end 13A and the tapered end 13B. Instead, the tapered end 13B of the crown 10 is more elongated relative to the center of the table 12 as compared to the rounded end 13A, and thus more of the surface area of the crown 10 lies below the minor axis $A_2$ than above the minor axis $A_2$.

The major and minor axes $A_1$ and $A_2$ generally divide the facets of the crown 10 into a first quadrant 11A, a second quadrant 11B, a third quadrant 11C, and fourth quadrant 11D. The first quadrant 11A generally corresponds to the top-right corner region of the crown 10 relative to the plane of FIG. 2. The second quadrant 11B generally corresponds to the top-left corner region of the crown 10 relative to the plane of FIG. 2. The third quadrant 11C generally corresponds to the bottom-left corner region of the crown 10 relative to the plane of FIG. 2. The fourth quadrant 11D generally corresponds to the bottom-right corner region of the crown 10 relative to the plane of FIG. 2.

The terms "top," "bottom," "left," "right," "above," below," etc. are used herein to refer to the locations of the various facets on the crown 10. However, those of skill in the art will understand that these are relative terms that are generally used in reference to the plane of FIG. 2. Thus, any of these terms used to describe an individual facet may not apply when viewing the crown 10 from a different perspective. The facets on the surface of the crown 10 share edges and vertices where the facets meet. When describing the facets on the surface of the crown 10, the term "upper" is used to refer to edges or vertices nearer to the table 12, while the term "lower" is used to refer to edges or vertices nearer to the girdle 50.

The crown 10 includes a number of main crown facets, which include one main crown facet 20A, two main crown facets 20B, two main crown facets 20C, two main crown facets 20D, and one main crown facet 20E. Each of the main crown facets 20A-20E are generally diamond or kite-shaped, and has an upper vertex, a lower vertex, two lateral vertices, two upper edges, and two lower edges.

Main crown facet 20A is generally split in half by the major axis $A_1$, and is disposed above the minor axis $A_2$. Thus, main crown facet 20A is disposed on the rounded end 13A of the crown 10, with about half of its surface area in the first quadrant 11A on the first side 15A of the crown 10, and about half of its surface area in the second quadrant 11B on the second side 15B of the crown 10. The main crown facet 20A is generally positioned between the upper intermediate crown facet 16A, the two lower intermediate crown facets 18A, the two main crown facets 20B, the two pairs of upper girdle facets 22A, and the upper edge of the girdle 50. Generally, the main crown facet 20A is positioned at the same location along the minor axis $A_2$ as the main crown facet 20E. The main crown facet 20A and the main crown facet 20E are thus disposed along the major axis $A_1$.

The two main crown facets 20B are both disposed above the minor axis $A_2$, on the rounded end 13A of the crown 10. A first main crown facet 20B is disposed to the right of the major axis $A_1$, in the first quadrant 11A. A second main crown facet 20B is disposed to the left of the major axis $A_1$, in the second quadrant 11B. Each main crown facet 20B is generally positioned between one of the upper intermediate crown facets 16B, one of the lower intermediate crown facets 18A, one of the lower intermediate crown facets 18B, the main crown facet 20A, one of the main crown facets 20C, one of the pairs of upper girdle facets 22A, one of the pairs of upper girdle facets 22B, and the upper edge of the girdle 50. Generally, the two main crown facets 20B are positioned at the same location along the major axis $A_1$, and are thus disposed along an axis that is parallel to and above the minor axis $A_2$.

The two main crown facets 20C are disposed at opposite ends of the minor axis $A_2$, and are disposed to the left and to the right of the major axis $A_1$. The main crown facets 20C are disposed such that more than half of the surface area of each of the main crown facets 20C is above the minor axis $A_2$, due to the elongated shape of the tapered end 13B. Thus, a first main crown facet 20C is disposed on the first side 15A of the crown 10, with more than half of its surface area in the first quadrant 11A on the rounded end 13A of the crown 10, and less than half of its surface area in the fourth quadrant 11D on the tapered end 13C of the crown 10. A second main crown facet 20C is disposed on the second side 15B of the crown 10, with more than half of its surface area in the second quadrant 11B on the rounded end 13A of the crown 10, and less than half of its surface area in the third quadrant 11C on the tapered end 13C of the crown 10. Each main crown facet 20C is generally positioned between one of the upper intermediate crown facets 16C, one of the lower intermediate crown facets 18B, one of the lower intermediate crown facets 18C, one of the main crown facets 20B, one of the main crown facets 20D, one of the pairs of upper girdle facets 22B, one of the pairs of upper girdle facets 22C, and the upper edge of the girdle 50. Generally, the two main crown facets 20C are positioned at the same location along the major axis $A_1$, and are thus disposed along the minor axis $A_2$.

The two main crown facets 20D are both disposed below the minor axis $A_2$, on the tapered end 13B of the crown 10. A first main crown facet 20D is disposed to the left of the major axis $A_1$, in the third quadrant 11C. A second main crown facet 20D is disposed to the right of the major axis $A_1$, in the fourth quadrant 11D. Each main crown facet 20D is generally positioned between one of the upper intermediate crown facets 16D, one of the lower intermediate crown facets 18C, one of the lower intermediate crown facets 18D, one of the main crown facets 20C, the main crown facet 20E, one of the pairs of upper girdle facets 22B, one of the pairs of upper girdle facets 22C, and the upper edge of the girdle 50. Generally, the two main crown facets 20D are positioned at the same location along the major axis $A_1$, and are thus disposed along an axis that is parallel to and below the minor axis $A_2$.

Main crown facet 20E is generally split in half by the major axis $A_1$, and is disposed below the minor axis $A_2$. Thus, main crown facet 20E is disposed on the tapered end 13B of the crown 10, with about half of its surface area in the third quadrant 11C on the second side 15B of the crown 10, and about half of its surface area in the fourth quadrant 11D on the first side 15B of the crown 10. The main crown facet 20E is generally positioned between the upper intermediate crown facet 16E, the two lower intermediate crown facets 18D, the two main crown facets 20D, the two pairs of upper girdle facets 22D, and the upper edge of the girdle 50. Generally, the main crown facet 20E is positioned at the same location along the minor axis $A_2$ as the main crown facet 20A. The main crown facet 20E and the main crown facet 20A are thus disposed along the major axis $A_1$.

The upper vertex of the main crown facet 20A abuts a lower vertex of the upper intermediate crown facet 16A, and lateral vertices of the two lower intermediate crown facets 18A. The lower vertex of the main crown facet 20A abuts the upper edge of the girdle 50, and a lower vertex of one of the upper girdle facets 22A from each pair of upper girdle facets 22A. Each lateral vertex of the main crown facet 20A abuts a lower vertex of one of the lower intermediate crown facets 18A, a lateral vertex of one of the first main crown facets 20B, and the upper vertices of each upper girdle facet 22A of an adjacent pair of upper girdle facets 22A. Each upper edge of the main crown facet 20A is shared with a lower edge of one of the lower intermediate crown facets 18A. Each lower edge of the main crown facet 20A is shared with an upper edge of one upper girdle facet 22A of an adjacent pair of upper girdle facets 22A.

The upper vertex of each of the main crown facets 20B abuts a lower vertex of one of the upper intermediate crown facets 16B, a lateral vertex of one of the lower intermediate crown facets 18A, and a lateral vertex of one of the lower intermediate crown facets 18B. The lower vertex of each of the main crown facets 20B abuts the upper edge of the girdle 50, a lower vertex of one of the upper girdle facets 22A of an adjacent pair of upper girdle facets 22A, and a lower vertex of one of the upper girdle facets 22B of an adjacent pair of upper girdle facets 22B. Each lateral vertex of each of the main crown facets 20B abuts a lower vertex of either (i) one of the lower intermediate crown facets 18A or (ii) one of the lower intermediate crown facets 18B, a lateral vertex of (i) the main crown facet 20A or (ii) one of the main crown facets 20C, and the upper vertices of (i) each upper girdle facet 22A of an adjacent pair of upper girdle facets 22A or (ii) each upper girdle facet 22B of an adjacent pair of upper girdle facet 22B. Each upper edge of each of the main crown facets 20B is shared with a lower edge of (i) one of the lower intermediate crown facets 18A or (ii) one of the lower intermediate crown facets 18B. Each lower edge of each of the main crown facets 20B is shared with an upper edge of (i) one of the upper girdle facets 22A of an adjacent pair of upper girdle facets 22A or (ii) one of the upper girdle facets 22B of an adjacent pair of upper girdle facets 22B.

The upper vertex of each of the main crown facets 20C abuts a lower vertex of one of the upper intermediate crown facets 16C, a lateral vertex of one of the lower intermediate crown facets 18B, and a lateral vertex of one of the lower intermediate crown facets 18C. The lower vertex of each of the main crown facets 20C abuts the upper edge of the girdle 50, a lower vertex of one of the upper girdle facets 22B of an adjacent pair of upper girdle facets 22B, and a lower vertex of one of the upper girdle facets 22C of an adjacent pair of upper girdle facets 22C. Each lateral vertex of each of the main crown facets 20C abuts a lower vertex of either (i) one of the lower intermediate crown facets 18B or (ii) one of the lower intermediate crown facets 18C, a lateral vertex of (i) one of the main crown facets 20B or (ii) one of the main crown facets 20D, and the upper vertices of (i) each upper girdle facet 22B of an adjacent pair of upper girdle facets 22B or (ii) each upper girdle facet 22C of an adjacent pair of upper girdle facet 22C. Each upper edge of each of the main crown facets 20C is shared with a lower edge of (i) one of the lower intermediate crown facets 18B or (ii) one of the lower intermediate crown facets 18C. Each lower edge of each of the main crown facets 20C is shared with an upper edge of (i) one of the upper girdle facets 22B of an adjacent pair of upper girdle facets 22B or (ii) one of the upper girdle facets 22C of an adjacent pair of upper girdle facets 22C.

The upper vertex of each of the main crown facets 20D abuts a lower vertex of one of the upper intermediate crown facets 16D, a lateral vertex of one of the lower intermediate crown facets 18C, and a lateral vertex of one of the lower intermediate crown facets 18D. The lower vertex of each of the main crown facets 20D abuts the upper edge of the girdle 50, a lower vertex of one of the upper girdle facets 22C of an adjacent pair of upper girdle facets 22C, and a lower vertex of one of the upper girdle facets 22D of an adjacent pair of upper girdle facets 22D. Each lateral vertex of each of the main crown facets 20D abuts a lower vertex of either (i) one of the lower intermediate crown facets 18C or (ii) one of the lower intermediate crown facets 18D, a lateral vertex of (i) one of the main crown facets 20C or (ii) the main crown facet 20E, and the upper vertices of (i) each upper girdle facet 22C of an adjacent pair of upper girdle facets 22C or (ii) each upper girdle facet 22D of an adjacent pair of upper girdle facet 22D. Each upper edge of each of the main crown facets 20D is shared with a lower edge of (i) one of the lower intermediate crown facets 18C or (ii) one of the lower intermediate crown facets 18D. Each lower edge of each of the main crown facets 20D is shared with an upper edge of (i) one of the upper girdle facets 22C of an adjacent pair of upper girdle facets 22C or (ii) one of the upper girdle facets 22D of an adjacent pair of upper girdle facets 22D.

The upper vertex of the main crown facet 20E abuts a lower vertex of the upper intermediate crown facet 16E, and lateral vertices of the two lower intermediate crown facets 18D. The lower vertex of the main crown facet 20E abuts the upper edge of the girdle, and a lower vertex of one of the upper girdle facets 22D from each pair of upper girdle facets 22D. Each lateral vertex of the main crown facet 20E abuts a lower vertex of one of the lower intermediate crown facets 18D, a lateral vertex of one of the first main crown facets 20D, and the upper vertices of each upper girdle facet 22D of an adjacent pair of upper girdle facets 22D. Each upper edge of the main crown facet 20E is shared with a lower edge of one of the lower intermediate crown facets 18D. Each lower edge of the main crown facet 20E is shared with an upper edge of one upper girdle facet 22D of an adjacent pair of upper girdle facets 22D.

While all of the main crown facets 20A-20E are diamond or kite-shaped, in some implementations their shapes are all slightly different due to the elongated shape of the tapered end 13B of the crown 10. Main crown facets 20A and 20E are both generally symmetrical across the major axis $A_1$. However, main crown facet 20E is elongated along the major axis $A_1$, and thus the distance between the upper and lower vertices of the main crown facet 20E is larger than the distance between the upper and lower vertices of the main crown facet 20A.

The upper and lower vertices of each of the main crown facets 20B-20D are generally shifted away from each other. Thus, the angle bisector of the upper vertex of each one of the main crown facets 20B-20D does not also bisect the angle formed at the lower vertex of the same one of the main crown facets 20B-20D. The upper vertex of each of the main crown facets 20B is generally shifted toward the tapered end 13B. The upper vertex of each of the main crown facets 20C is also generally shifted toward the tapered end 13B. The distance between the upper and lower vertices of the main crown facets 20B is generally larger than the distance between the upper and lower vertices of the main crown facets 20C. The upper vertex of each of the main crown facets 20D is generally shifted toward the rounded end 13A.

Thus, the shapes of the main crown facets 20A-20E can vary depending on their location along the crown 10. However, in other implementations, any one of the groups of main crown facets 20A-20E can have the same size and shape as any of the other groups of main crown facets 20A-20E.

The crown 10 includes two pairs of upper girdle facets 22A, two pairs of upper girdle facets 22B, two pairs of upper girdle facets 22C, and two pairs of upper girdle facets 22D. Each of the upper girdle facets 22A-22D has a generally triangular shape with three edges and three vertices. Thus, each pair of upper girdle facets 22A-22D is formed as two triangular-shaped facets sharing one generally straight edge.

The two pairs of upper girdle facets 22A are disposed at the rounded end 13A of the crown 10, above the minor axis $A_2$ and on either side of the major axis $A_1$. A first pair of upper girdle facets 22A is disposed to the right of the major axis $A_1$, in the first quadrant 11A. A second pair of upper girdle facets 22A is disposed to the left of the major axis $A_1$, in the second quadrant 11B. Generally, the first and second pairs of upper girdle facets 22A are positioned at the same location along the major axis $A_1$, and are thus disposed along an axis that is parallel to and above the minor axis $A_2$. Each upper girdle facet 22A in each pair of upper girdle facets 22A is generally positioned between one of the lower intermediate crown facets 18A, the main crown facet 20A, one of the main crown facets 20B, the upper edge of the girdle 50, the other upper girdle facet 22A in the same pair of upper girdle facets 22A, and either (i) an upper girdle facet 22A of an adjacent pair of upper girdle facets 22A, or (ii) an upper girdle facet 22B of an adjacent pair of upper girdle facets 22B.

The two pairs of upper girdle facets 22B are disposed above the minor axis $A_2$, on either the first side 15A of the crown 10 or the second side 15B of the crown 10. A first pair of upper girdle facets 22B is disposed to the right of the major axis $A_1$, in the first quadrant 11A. The first pair of upper girdle facets 22B is positioned between the first pair of upper girdle facets 22A and the tapered end 13B, in a clockwise direction along the circumference of the gemstone 1. A second pair of upper girdle facets 22B is disposed to the left of the major axis $A_1$, in the second quadrant 11B. The second pair of upper girdle facets 22B is positioned between the second pair of upper girdle facets 22A and the tapered end 13B, in a counter-clockwise direction along the circumference of the gemstone 1. Each upper girdle facet 22B in each pair of upper girdle facets 22B is generally positioned between one of the lower intermediate crown facets 18B, one of the main crown facets 20B, one of the main crown facets 20C, the upper edge of the girdle 50, the other upper girdle facet 22B in the same pair of upper girdle facets 22B, and either (i) an upper girdle facet 22A of an adjacent pair of upper girdle facets 22A, or (ii) an upper girdle facet 22C of an adjacent pair of upper girdle facets 22C.

The two pairs of upper girdle facets 22C are disposed substantially below the minor axis $A_2$, on either the first side 15A of the crown 10 or the second side 15B of the crown 10. However, a portion of one of the upper girdle facets 22C from each pair extends above the minor axis $A_2$. A first pair of upper girdle facets 22C is disposed to the left of the major axis $A_1$, substantially in the third quadrant 11C with a portion in the second quadrant 11B. The first pair of upper girdle facets 22C is positioned between the second pair of upper girdle facets 22B and the tapered end 13B, in a counter-clockwise direction along the circumference of the gemstone 1. A second pair of upper girdle facets 22C is disposed to the right of the major axis $A_1$, substantially in the fourth quadrant 11D with a portion in the first quadrant 11A. The second pair of upper girdle facets 22C is positioned between the first pair of upper girdle facets 22A and the tapered end 13B, in a clockwise direction along the circumference of the gemstone 1. Each upper girdle facet 22C in each pair of upper girdle facets 22C is generally positioned between one of the lower intermediate crown facets 18C, one of the main crown facets 20C, one of the main crown facets 20D, the upper edge of the girdle 50, the other upper girdle facet 22C in the same pair of upper girdle facets 22C, and either (i) an upper girdle facet 22B of an adjacent pair of upper girdle facets 22B, or (ii) an upper girdle facet 22D of an adjacent pair of upper girdle facets 22D.

The two pairs of upper girdle facets 22D are disposed at the tapered end 13B of the crown 10, below the minor axis $A_2$ and on either side of the major axis $A_1$. A first pair of upper girdle facets 22D is disposed to the left of the major axis $A_1$, in the third quadrant 11C. A second pair of upper girdle facets 22D is disposed to the right of the major axis $A_1$, in the fourth quadrant 11D. Generally, the first and second pairs of upper girdle facets 22D are positioned at the same location along the major axis $A_1$, and are thus disposed along an axis that is parallel to and below the minor axis $A_2$. Each upper girdle facet 22D in each pair of upper girdle facets 22D is generally positioned between one of the lower intermediate crown facets 18D, one of the main crown facets 20D, the main crown facet 20E, the upper edge of the girdle 50, the other upper girdle facet 22D in the same pair of upper girdle facets 22D, and either (i) an upper girdle facet 22C of an adjacent pair of upper girdle facets 22C, or (ii) an upper girdle facet 22D of an adjacent pair of upper girdle facets 22D.

An upper vertex of each upper girdle facet 22A abuts the lower vertex of one of the lower intermediate crown facets 18A, a lateral vertex of the main crown facet 20A, a lateral vertex of one of the main crown facets 20B, and the upper vertex of the other upper girdle facet 22A in the same pair of upper girdle facets 22A. A first lower vertex of each upper girdle facet 22A abuts the upper edge of the girdle, a lower vertex of either (i) the main crown facet 20A or (ii) one of the main crown facets 20B, and the first lower vertex of either (i) an upper girdle facet 22A of an adjacent pair of upper girdle facets 22A or (ii) an upper girdle facet 22B of an adjacent pair of upper girdle facets 22B. A second lower vertex of each upper girdle facet 22A abuts the upper edge of the girdle, and the second lower vertex of the upper girdle facet 22A in the same pair of upper girdle facets 22A.

A first (lower) edge of each of the upper girdle facets 22A is shared with the upper edge of the girdle 50. This first edge can be flat or curved depending on the shape of the girdle 50. A second edge of each of the upper girdle facets 22A is shared with a lower edge of (i) the main crown facet 20A or (ii) one of the main crown facets 20B. A third edge of each of the upper girdle facets 22A is shared with the third edge of the other upper girdle facet 22A in the same pair of upper girdle facets 22A.

An upper vertex of each upper girdle facet 22B abuts the lower vertex of one of the lower intermediate crown facets 18B, a lateral vertex of one of the main crown facets 20B, a lateral vertex of one of the main crown facets 20C, and the upper vertex of the other upper girdle facet 22B in the same pair of upper girdle facets 22B. A first lower vertex of each upper girdle facet 22B abuts the upper edge of the girdle, a lower vertex of either (i) one of the main crown facets 20B or (ii) one of the main crown facets 20C, and the first lower vertex of either (i) an upper girdle facet 22A of an adjacent pair of upper girdle facets 22A or (ii) an upper girdle facet 22C of an adjacent pair of upper girdle facets 22C. A second lower vertex of each upper girdle facet 22C abuts the upper edge of the girdle, and the second lower vertex of the upper girdle facet 22C in the same pair of upper girdle facets 22C.

A first (lower) edge of each of the upper girdle facets 22C is shared with the upper edge of the girdle 50. This first edge can be flat or curved depending on the shape of the girdle 50. A second edge of each of the upper girdle facets 22C is shared with a lower edge of (i) one of the main crown facets 20B or (ii) one of the main crown facets 20C. A third edge of each of the upper girdle facets 22B is shared with the third edge of the other upper girdle facet 22B in the same pair of upper girdle facets 22B.

An upper vertex of each upper girdle facet 22C abuts the lower vertex of one of the lower intermediate crown facets 18C, a lateral vertex of one of the main crown facets 20C, a lateral vertex of one of the main crown facets 20D, and the upper vertex of the other upper girdle facet 22C in the same pair of upper girdle facets 22C. A first lower vertex of each upper girdle facet 22C abuts the upper edge of the girdle, a lower vertex of either (i) one of the main crown facets 20C or (ii) one of the main crown facets 20D, and the first lower vertex of either (i) an upper girdle facet 22B of an adjacent pair of upper girdle facets 22B or (ii) an upper girdle facet 22D of an adjacent pair of upper girdle facets 22D. A second lower vertex of each upper girdle facet 22C abuts the upper edge of the girdle, and the second lower vertex of the upper girdle facet 22C in the same pair of upper girdle facets 22C.

A first (lower) edge of each of the upper girdle facets 22C is shared with the upper edge of the girdle 50. This first edge can be flat or curved depending on the shape of the girdle 50. A second edge of each of the upper girdle facets 22C is shared with a lower edge of (i) one of the main crown facets 20C or (ii) one of the main crown facets 20D. A third edge of each of the upper girdle facets 22C is shared with the third edge of the other upper girdle facet 22C in the same pair of upper girdle facets 22C.

An upper vertex of each upper girdle facet 22D abuts the lower vertex of one of the lower intermediate crown facets 18D, a lateral vertex of one of the main crown facets 20D, a lateral vertex of the main crown facet 20E, and the upper vertex of the other upper girdle facet 22D in the same pair of upper girdle facets 22D. A first lower vertex of each upper girdle facet 22D abuts the upper edge of the girdle, a lower vertex of either (i) one of the main crown facets 20D or (ii) the main crown facet 20E, and the first lower vertex of either (i) an upper girdle facet 22C of an adjacent pair of upper girdle facets 22C or (ii) an upper girdle facet 22D of an adjacent pair of upper girdle facets 22D. A second lower vertex of each upper girdle facet 22D abuts the upper edge of the girdle, and the second lower vertex of the upper girdle facet 22D in the same pair of upper girdle facets 22D.

A first (lower) edge of each of the upper girdle facets 22D is shared with the upper edge of the girdle 50. This first edge can be flat or curved depending on the shape of the girdle 50. A second edge of each of the upper girdle facets 22D is shared with a lower edge of (i) one of the main crown facets 20D or (ii) the main crown facet 20E. A third edge of each of the upper girdle facets 22D is shared with the third edge of the other upper girdle facet 22D in the same pair of upper girdle facets 22D.

In the illustrated implementation, the length of the lower edges of the upper girdle facets 22A-22D generally increases as the upper girdle facet is closer toward the tapered end 13B of the crown 10. Thus, the combined length of the lower edges of each pair of upper girdle facets 22D is generally greater than the combined length of the lower edges of each pair of upper girdle facets 22C, which is generally greater than the combined length of the lower edges of each pair of upper girdle facets 22B, and which is generally greater than the combined length of the lower edges of each pair of upper girdle facets 22A. However, in other implementations, the lower edges of some or all of the upper girdle facets 22A-22D are generally the same length, such that all of the upper girdle facets 22A-22D are the same size.

The crown 10 includes two lower intermediate crown facets 18A, two lower intermediate crown facets 18B, two lower intermediate crown facets 18C, and two lower intermediate crown facets 18D. Each of the lower intermediate crown facets 18A-18D are generally diamond or kite-shaped, and has an upper vertex, a lower vertex, two lateral vertices, two upper edges, and two lower edges.

The two lower intermediate crown facets 18A are disposed at the rounded end 13A of the crown 10, above the minor axis $A_2$ and on either side of the major axis $A_1$. A first lower intermediate crown facet 18A is disposed to the right of the major axis $A_1$, in the first quadrant 11A. A second lower intermediate crown facet 18A is disposed to the left of the major axis $A_1$, in the second quadrant 11B. Generally, the first and second lower intermediate crown facets 18A are positioned at the same location along the major axis $A_1$, and are thus disposed along an axis that is parallel to and above the minor axis $A_2$. Each of the lower intermediate crown facets 18A is generally positioned between one of the star facets 14A, the upper intermediate crown facet 16A, one of the upper intermediate crown facets 16B, the other of the lower intermediate crown facets 18A, one of the lower intermediate crown facets 18B, the main crown facet 20A, one of the main crown facets 20B, and one of the pairs of upper girdle facets 22A.

The two lower intermediate crown facets 18B are disposed above the minor axis $A_2$, on either the first side 15A of the crown 10 or the second side 15B of the crown 10. A first lower intermediate crown facet 18 is disposed to the right of the major axis $A_1$, in the first quadrant 11A. The first lower intermediate crown facet 18B is positioned between the first lower intermediate crown facet 18A and the tapered end 13B, in a clockwise direction along the circumference of the gemstone 1. A second lower intermediate crown facet 18B is disposed to the left of the major axis $A_1$, in the second quadrant 11B. The second lower intermediate crown facet 18B is positioned between the second lower intermediate crown facet 18A and the tapered end 13B, in a counter-clockwise direction along the circumference of the gemstone 1. Each of the lower intermediate crown facets 18B is generally positioned between one of the star facets 14B, one of the upper intermediate crown facets 16B, one of the upper intermediate crown facets 16C, one of the lower intermediate crown facets 18A, one of the lower intermediate crown facets 18C, one of the main crown facets 20B, one of the main crown facets 20C, and one of the pairs of upper girdle facets 22B.

The two lower intermediate crown facets 18C are disposed below the minor axis $A_2$, on either the first side 15A of the crown 10 or the second side 15B of the crown 10. A first lower intermediate crown facet 18C is disposed to the left of the major axis $A_1$, in the third quadrant 11C. The first lower intermediate crown facet 18C is positioned between the second lower intermediate crown facet 18B and the tapered end 13B, in a counter-clockwise direction along the circumference of the gemstone 1. A second lower intermediate crown facet 18C is disposed to the right of the major axis $A_1$, in the fourth quadrant 11D. The second lower intermediate crown facet 18C is positioned between the first lower intermediate crown facet 18B and the tapered end 13B, in a clockwise direction along the circumference of the gemstone 1. Each of the lower intermediate crown facets 18C is generally positioned between one of the star facets 14C, one of the upper intermediate crown facets 16C, one of the upper intermediate crown facets 16D, one of the lower intermediate crown facets 18B, one of the lower intermediate crown facets 18D, one of the main crown facets 20C, one of the main crown facets 20D, and one of the pairs of upper girdle facets 22C.

The two lower intermediate crown facets 18D are disposed at the tapered end 13B of the crown 10, below the minor axis $A_2$ and on either side of the major axis $A_1$. A first lower intermediate crown facet 18D is disposed to the left of the major axis $A_1$, in the third quadrant 11C. A second lower intermediate crown facet 18D is disposed to the right of the major axis $A_1$, in the fourth quadrant 11D. Generally, the first and second lower intermediate crown facets 18D are positioned at the same location along the major axis $A_1$, and are thus disposed along an axis that is parallel to and below the minor axis $A_2$. Each of the lower intermediate crown facets 18D is generally positioned between one of the star facets 14D, one of the upper intermediate crown facets 16D, the upper intermediate crown facet 16E, one of the lower intermediate crown facets 18C, the other of the lower intermediate crown facets 18D, one of the main crown facets 20D, the main crown facet 20*e*, and one of the pairs of upper girdle facets 22D.

The upper vertex of each of the lower intermediate crown facets 18A abuts a lower vertex of one of the star facets 14A, a lateral vertex of the upper intermediate crown facet 16A, and a lateral vertex of one of the upper intermediate crown facets 16B. The lower vertex of each of the lower intermediate crown facets 18A abuts a lateral vertex of the main crown facet 20A, a lateral vertex of one of the main crown facets 20B, and the upper vertices of each of one of the pairs of upper girdle facets 22A. Each lateral vertex of the lower intermediate crown facets 18A abuts a lower vertex of either (i) the upper intermediate crown facet 16A or (ii) one of the upper intermediate crown facets 16B, a lateral vertex of either (i) the other lower intermediate crown facet 18A or (ii) one of the lower intermediate crown facets 18B, and an upper vertex of either (i) the main crown facet 20A or (ii) one of the main crown facets 20B. Each upper edge of the lower intermediate crown facets 18A is shared with a lower edge either (i) the upper intermediate crown facet 16A or (ii) one of the upper intermediate crown facets 16B. Each lower edge of the lower intermediate crown facets 18A is shared with an upper edge of either (i) the main crown facet 20A or (ii) one of the main crown facets 20B.

The upper vertex of each of the lower intermediate crown facets 18B abuts a lower vertex of one of the star facets 14B, a lateral vertex of one of the upper intermediate crown facets 16B, and a lateral vertex of one of the upper intermediate crown facets 16C. The lower vertex of each of the lower intermediate crown facets 18B abuts a lateral vertex of one of the main crown facets 20B, a lateral vertex of one of the main crown facets 20C, and the upper vertices of each of one of the pairs of upper girdle facets 22B. Each lateral vertex of the lower intermediate crown facets 18B abuts a lower vertex of either (i) one of the upper intermediate crown facets 16B or (ii) one of the upper intermediate crown facets 16C, a lateral vertex of either (i) one of the lower intermediate crown facets 18A or (ii) one of the lower intermediate crown facets 18C, and an upper vertex of either (i) one of the main crown facets 20B or (ii) one of the main crown facets 20C. Each upper edge of the lower intermediate crown facets 18A is shared with a lower edge either (i) one of the upper intermediate crown facets 16B or (ii) one of the upper intermediate crown facets 16C. Each lower edge of the lower intermediate crown facets 18A is shared with an upper edge of either (i) one of the main crown facets 20B or (ii) one of the main crown facets 20C.

The upper vertex of each of the lower intermediate crown facets 18C abuts a lower vertex of one of the star facets 14C, a lateral vertex of one of the upper intermediate crown facets 16C, and a lateral vertex of one of the upper intermediate crown facets 16D. The lower vertex of each of the lower intermediate crown facets 18C abuts a lateral vertex of one of the main crown facets 20C, a lateral vertex of one of the main crown facets 20D, and the upper vertices of each of one of the pairs of upper girdle facets 22C. Each lateral vertex of the lower intermediate crown facets 18C abuts a lower vertex of either (i) one of the upper intermediate crown facets 16C or (ii) one of the upper intermediate crown facets 16D, a lateral vertex of either (i) one of the lower intermediate crown facets 18B or (ii) one of the lower intermediate crown facets 18D, and an upper vertex of either (i) one of the main crown facets 20C or (ii) one of the main crown facets 20D. Each upper edge of the lower intermediate crown facets 18C is shared with a lower edge either (i) one of the upper intermediate crown facets 16C or (ii) one of the upper intermediate crown facets 16D. Each lower edge of the lower intermediate crown facets 18C is shared with an upper edge of either (i) one of the main crown facets 20C or (ii) one of the main crown facets 20D.

The upper vertex of each of the lower intermediate crown facets 18D abuts a lower vertex of one of the star facets 14D, a lateral vertex of one of the upper intermediate crown facets 16D, and a lateral vertex of the upper intermediate crown facet 16E. The lower vertex of each of the lower intermediate crown facets 18D abuts a lateral vertex of one of the main crown facets 20D, a lateral vertex of the main crown facet 20E, and the upper vertices of each of one of the pairs of upper girdle facets 22D. Each lateral vertex of the lower intermediate crown facets 18D abuts a lower vertex of either (i) one of the upper intermediate crown facet 16D or (ii) the upper intermediate crown facet 16E, a lateral vertex of either (i) one of the lower intermediate crown facets 18C or (ii) the other lower intermediate crown facet 18D, and an upper vertex of either (i) one of the main crown facets 20D or (ii) the main crown facet 20E. Each upper edge of the lower intermediate crown facets 18D is shared with a lower edge either (i) one of the upper intermediate crown facet 16D or (ii) the upper intermediate crown facet 16E. Each lower edge of the lower intermediate crown facets 18D is shared with an upper edge of either (i) one of the main crown facets 20D or (ii) the main crown facet 20E.

The upper and lower vertices of each of the lower intermediate crown facets 18A-18D are generally shifted away from each other. Thus, the angle bisector of the upper vertex of each one of the lower intermediate crown facets 18A-18D does not also bisect the angle formed at the lower vertex of the same one of the lower intermediate crown facets 18A-18D. The upper vertices of each of the lower intermediate crown facets 18A-18C are generally shifted toward the tapered end 13B. The upper vertex of each of the lower intermediate crown facets 18D is generally shifted towards the rounded end 13A. The distance between the upper and lower vertices generally decreases from the lower intermediate crown facets 18A to the lower intermediate crown facets 18D. Thus, the shapes of the lower intermediate crown facets 18A-18D can vary depending on their location along the crown 10. However, in other implementations, any one of the groups of lower intermediate crown facets 18A-18D can have the same size and shape as any of the other groups of lower intermediate crown facets 18A-18D.

The crown 10 includes a number of upper intermediate crown facets, which include one upper intermediate crown facet 16A, two upper intermediate crown facets 16B, two upper intermediate crown facets 16C, two upper intermediate crown facets 16D, and one upper intermediate crown facet 16E. Each of the upper intermediate crown facets 16A-16E are generally diamond or kite-shaped, and has an upper vertex, a lower vertex, two lateral vertices, two upper edges, and two lower edges.

Upper intermediate crown facet 16A is generally split in half by the major axis $A_1$, and is disposed above the minor axis $A_2$. Thus, upper intermediate crown facet 16A is disposed generally between the main crown facet 20A and the table 12, with about half of its surface area in the first quadrant 11A on the first side 15A of the crown 10, and about half of its surface area in the second quadrant 11B on the second side 15B of the crown 10. The upper intermediate crown facet 16A is generally positioned between the table 12, the two star facets 14A, the two upper intermediate crown facets 16B, the two lower intermediate crown facets 18A, and the main crown facet 20A. Generally, the upper intermediate crown facet 16A is positioned at the same location along the minor axis $A_2$ as the upper intermediate crown facet 16D. The upper intermediate crown facet 16A and the upper intermediate crown facet 16D are thus disposed along the major axis $A_1$.

The two upper intermediate crown facets 16B are both disposed above the minor axis $A_2$, between the table 12 and respective main crown facets 20B. A first upper intermediate crown facet 16B is disposed to the right of the major axis $A_1$, in the first quadrant 11A. A second upper intermediate crown facet 16B is disposed to the left of the major axis $A_1$, in the second quadrant 11B. Each upper intermediate crown facet 16B is generally positioned between the table 12, one of the star facets 14A, one of the star facets 14B, the upper intermediate crown facet 16A, one of the upper intermediate crown facets 16C, one of the lower intermediate crown facets 18A, one of the lower intermediate crown facets 18B, and one of main crown facets 20B. Generally, the two upper intermediate crown facets 16B are positioned at the same location along the major axis $A_1$, and are thus disposed along an axis that is parallel to and above the minor axis $A_2$.

The two upper intermediate crown facets 16C are disposed to the left and the right of the major axis $A_1$, between the table 12 and respective main crown facets 20C. The upper intermediate crown facets 16C are disposed such that more than half of the surface area of each of the upper intermediate crown facets 16C is above the minor axis $A_2$, due to the elongated shape of the tapered end 13B. Thus, a first upper intermediate crown facet 16C is disposed on the first side 15A of the crown 10 between the table 12 and the first main crown facet 20C, with more than half of its surface area in the first quadrant 11A, and less than half of its surface area in the fourth quadrant 11D. A second upper intermediate crown facet 16C is disposed on the second side 15B of the crown 10 between the table 12 and the second main crown facet 20C, with more than half of its surface area in the second quadrant 11B, and less than half of its surface area in the third quadrant 11C. Each upper intermediate crown facet 16C is generally positioned between the table 12, one of the star facets 14B, one of the star facets 14C, one of the upper intermediate crown facets 16B, one of the upper intermediate crown facets 16D, one of the lower intermediate crown facets 18B, one of the lower intermediate crown facets 18C, and one of main crown facets 20C. Generally, the two upper intermediate crown facets 16C are positioned at the same location along the major axis $A_1$, and are thus disposed along the minor axis $A_2$.

The two upper intermediate crown facets 16D are both disposed below the minor axis $A_2$, on the tapered end 13B of the crown 10. A first upper intermediate crown facet 16D is disposed to the left of the major axis $A_1$, in the third quadrant 11C. A second upper intermediate crown facet 16D is disposed to the right of the major axis $A_1$, in the fourth quadrant 11D. Each upper intermediate crown facet 16D is generally positioned between the table 12, one of the star facets 14C, one of the star facets 14D, one of the upper intermediate crown facets 16C, the upper intermediate crown facet 16E, one of the lower intermediate crown facets 18C, one of the lower intermediate crown facets 18D, and one of main crown facets 20D. Generally, the two upper intermediate crown facets 16D are positioned at the same location along the major axis $A_1$, and are thus disposed along an axis that is parallel to and below the minor axis $A_2$.

Upper intermediate crown facet 16E is generally split in half by the major axis $A_1$, and is disposed below the minor axis $A_2$. Thus, upper intermediate crown facet 1620E is disposed on the tapered end 13B of the crown 10, with about half of its surface area in the third quadrant 11C, and about half of its surface area in the fourth quadrant 11D. The upper intermediate crown facet 16E is generally positioned between the table 12, the two star facets 14D, the two upper intermediate crown facets 16D, the two lower intermediate crown facets 18D, and the main crown facet 20E. Generally, the upper intermediate crown facet 16E is positioned at the same location along the minor axis $A_2$ as the upper intermediate crown facet 16A. The upper intermediate crown facet 16E and the upper intermediate crown facet 16A are thus disposed along the major axis $A_1$.

The upper vertex of the upper intermediate crown facet 16A abuts a vertex of the table 12, and lateral vertices of the two star facets 14A. The lower vertex of the upper intermediate crown facet 16A abuts the upper vertex of the main crown facet 20A, and a lateral vertex of each of the lower intermediate crown facets 18A. Each lateral vertex of the upper intermediate crown facet 16A abuts a lower vertex of one of the star facets 14A, a lateral vertex of one of the upper intermediate crown facets 16B, and the upper vertex of one of the lower intermediate crown facets 18A. Each upper edge of the upper intermediate crown facet 16A is shared with a lower edge of one of the star facets 14A. Each lower edge of the upper intermediate crown facet 16A is shared with an upper edge of one of the lower intermediate crown facets 18A.

The upper vertex of each of the upper intermediate crown facets 16B abuts a vertex of the table 12, a lateral vertex of one of the star facets 14A, and a lateral vertex of one of the star facets 14B. The lower vertex of each of the upper intermediate crown facets 16B abuts an upper vertex of one of the main crown facets 20B, a lateral vertex of one of the lower intermediate crown facets 18A, and a lateral vertex of one of the lower intermediate crown facets 18B. Each lateral vertex of each of the upper intermediate crown facets 16B abuts a lower vertex of either (i) one of the star facets 14A or (ii) one of the star facets 14B, a lateral vertex of (i) the upper intermediate crown facet 16A or (ii) one of the upper intermediate crown facets 16C, and the upper vertex of one of the main crown facets 20B. Each upper edge of each of the upper intermediate crown facets 16B is shared with a lower edge of (i) one of the star facets 14A or (ii) one of the star facets 14B. Each lower edge of each of the upper intermediate crown facets 16B is shared with an upper edge of (i) one of the lower intermediate facets 18A or (ii) one of the lower intermediate facets 18B.

The upper vertex of each of the upper intermediate crown facets 16C abuts a vertex of the table 12, a lateral vertex of one of the star facets 14B, and a lateral vertex of one of the star facets 14C. The lower vertex of each of the upper intermediate crown facets 16C abuts an upper vertex of one of the main crown facets 20C, a lateral vertex of one of the lower intermediate crown facets 18B, and a lateral vertex of one of the lower intermediate crown facets 18C. Each lateral vertex of each of the upper intermediate crown facets 16C abuts a lower vertex of either (i) one of the star facets 14B or (ii) one of the star facets 14C, a lateral vertex of either (i) one of the upper intermediate crown facets 16B or (ii) one of the upper intermediate crown facets 16D, and an upper vertex of (i) the lower intermediate crown facet 18B or (ii) one of the lower intermediate crown facets 18C. Each upper edge of each of the upper intermediate crown facets 16C is shared with a lower edge of either (i) one of the star facets 14B or (ii) one of the star facets 14C. Each lower edge of each of the upper intermediate crown facets 16C is shared with an upper edge of (i) one of the lower intermediate facets 18B or (ii) one of the lower intermediate facets 18C.

The upper vertex of each of the upper intermediate crown facets 16D abuts a vertex of the table 12, a lateral vertex of one of the star facets 14C, and a lateral vertex of one of the star facets 14D. The lower vertex of each of the upper intermediate crown facets 16D abuts an upper vertex of one of the main crown facets 20D, a lateral vertex of one of the lower intermediate crown facets 18C, and a lateral vertex of one of the lower intermediate crown facets 18D. Each lateral vertex of each of the upper intermediate crown facets 16D abuts a lower vertex of (i) one of the star facets 14C or (ii) one of the star facets 14D, a lateral vertex of either (i) one of the upper intermediate crown facets 16C or (ii) the upper intermediate crown facet 16E, and an upper vertex of (i) the lower intermediate crown facet 18C or (ii) one of the lower intermediate crown facets 18D. Each upper edge of each of the upper intermediate crown facets 16D is shared with a lower edge of (i) one of the star facets 14C or (ii) one of the star facets 14D. Each lower edge of each of the upper intermediate crown facets 16D is shared with an upper edge of (i) one of the lower intermediate facets 18C or (ii) one of the lower intermediate facets 18D.

The upper vertex of the upper intermediate crown facet 16E abuts a vertex of the table 12, and lateral vertices of the two star facets 14D. The lower vertex of the upper intermediate crown facet 16E abuts the upper vertex of the main crown facet 20E, and a lateral vertex of each of the lower intermediate crown facets 18D. Each lateral vertex of the upper intermediate crown facet 16E abuts a lower vertex of one of the star facets 14D, a lateral vertex of one of the upper intermediate crown facets 16D, and the upper vertex of one of the lower intermediate crown facets 18D. Each upper edge of the upper intermediate crown facet 16E is shared with a lower edge of one of the star facets 14D. Each lower edge of the upper intermediate crown facet 16E is shared with an upper edge of one of the lower intermediate crown facets 18D.

While all of the upper intermediate crown facets 16A-16E are diamond or kite-shaped, in some implementations their shapes are all slightly different due to the elongated shape of the tapered end 13B of the crown 10. Upper intermediate crown facets 16A and 16E are both generally symmetrical across the major axis $A_1$. However, upper intermediate crown facet 16E is elongated along the major axis $A_1$, and thus the distance between the upper and lower vertices of the upper intermediate crown facet 16E is larger than the distance between the upper and lower vertices of the upper intermediate crown facet 16A.

The upper and lower vertices of each of the upper intermediate crown facets 16B-16D are generally shifted away from each other. Thus, the angle bisector of the upper vertex of each one of the upper intermediate crown facets 16B-16D does not also bisect the angle formed at the lower vertex of the same one of the upper intermediate crown facets 16B-16D. The upper vertex of each of the upper intermediate crown facets 16B is generally shifted toward the tapered end 13B. The upper vertex of each of the upper intermediate crown facets 16C is also generally shifted toward the tapered end 13B. The distance between the upper and lower vertices of the upper intermediate crown facets 16B is generally larger than the distance between the upper and lower vertices of the upper intermediate crown facets 16C. The upper vertex of each of the upper intermediate crown facets 16D is generally shifted toward the rounded end 13A.

Thus, the shapes of the upper intermediate crown facets 16A-16E can vary depending on their location along the crown 10. However, in other implementations, any one of the groups of upper intermediate crown facets 16A-16E can have the same size and shape as any of the other groups of upper intermediate crown facets 16A-16E.

The crown 10 includes two star facets 14A, two star facets 14B, two star facets 14C, and two star facets 14D. Each of the star facets 14A-14D is disposed adjacent to and abutting an edge of the table 12. Each of the star facets 14A-14D is generally triangle-shaped with two upper vertices, a lower vertex, an upper edge, and two lower edges.

The two star facets 14A are disposed at the rounded end 13A of the crown 10, above the minor axis $A_2$ and on either side of the major axis $A_1$. A first star facet 14A is disposed to the right of the major axis $A_1$, in the first quadrant 11A. A second star facet 14A is disposed to the left of the major axis $A_1$, in the second quadrant 11B. Generally, the first and second star facets 14A are positioned at the same location along the major axis $A_1$, and are thus disposed along an axis that is parallel to and above the minor axis $A_2$. Each of the star facets 14A is generally positioned between the table 12, the other star facet 14A, one of the star facets 14B, the upper intermediate crown facet 16A, one of the upper intermediate crown facets 16B, and one of the lower intermediate crown facets 18A.

The two star facets 14B are disposed above the minor axis $A_2$, on either the first side 15A of the crown 10 or the second side 15B of the crown 10. A first star facet 14B is disposed to the right of the major axis $A_1$, in the first quadrant 11A. The star facet 14B is positioned between the first star facet 14A and the tapered end 13B, in a clockwise direction along the circumference of the gemstone 1. A second star facet 14B is disposed to the left of the major axis $A_1$, in the second quadrant 11B. The second star facet 14B is positioned between the table 12 and the tapered end 13B, in a counter-clockwise direction along the circumference of the gemstone 1. Each of the star facets 14B is generally positioned between the table 12, one of the star facets 14A, one of the star facets 14C, one of the upper intermediate crown facets 16B, one of the upper intermediate crown facets 16C, and one of the lower intermediate crown facets 18B.

The two star facets 14C are disposed below the minor axis $A_2$, on either the first side 15A of the crown 10 or the second side 15B of the crown 10. A first star facet 14C is disposed to the left of the major axis $A_1$, in the third quadrant 11C. The first star facet 14C is positioned between the table 12 and the tapered end 13B, in a counter-clockwise direction along the circumference of the gemstone 1. A second star facet 14C is disposed to the right of the major axis $A_1$, in the fourth quadrant 11D. The second star facet 14C is positioned between the table 12 and the tapered end 13B, in a clockwise direction along the circumference of the gemstone 1. Generally, the minor axis $A_2$ extends between the first star facet 14B and the second star facet 14C on the first side 15A of the crown 10, and between the second star facet 14B and the first star facet 14C on the second side 15A of the crown 10. Each of the star facets 14C is generally positioned between the table 12, one of the star facets 14B, one of the star facets 14D, one of the upper intermediate crown facets 16C, one of the upper intermediate crown facets 16D, and one of the lower intermediate crown facets 18C.

The two star facets 14D are disposed at the tapered end 13B of the crown 10, below the minor axis $A_2$ and on either side of the major axis $A_1$. A first star facet 14D is disposed to the left of the major axis $A_1$, in the third quadrant 11C. A second star facet 14D is disposed to the right of the major axis $A_1$, in the fourth quadrant 11D. Generally, the first and second star facets 14D are positioned at the same location along the major axis $A_1$, and are thus disposed along an axis that is parallel to and below the minor axis $A_2$. Each of the star facets 14D is generally positioned between the table 12, one of the star facets 14C, the other star facet 14D, one of the upper intermediate crown facets 16D, the upper intermediate crown facet 16E, and one of the lower intermediate crown facets 18D.

One upper vertex of each of the star facets 14A abuts a vertex of the table 12, an upper vertex of the other star facet 14A, and an upper vertex of the upper intermediate crown facet 16A. The other upper vertex of each of the star facets 14A abuts a different vertex of the table 12, an upper vertex of one of the star facets 14B, and the upper vertex of one of the upper intermediate crown facets 16B. The lower vertex of each of the star facets 14A abuts a lateral vertex of the upper intermediate crown facet 16A, a lateral vertex of one of the upper intermediate crown facets 16B, and the upper vertex of one of the lower intermediate crown facets 18A. The upper edge of each of the star facets 14A is shared with an edge of the table 12. One of the lower edges of each of the star facets 14A is shared with an upper edge of the upper intermediate crown facet 16A. The other lower edge of each of the star facets 14A is shared with an upper edge of one of the upper intermediate crown facets 16B.

One upper vertex of each of the star facets 14B abuts a vertex of the table 12, an upper vertex of one of the star facets 14A, and the upper vertex of one of the upper intermediate crown facets 16B. The other upper vertex of each of the star facets 14B abuts a different vertex of the table 12, an upper vertex of one of the star facets 14C, and the upper vertex of one of the upper intermediate crown facets 16C. The lower vertex of each of the star facets 14B abuts a lateral vertex of one of the upper intermediate crown facets 16B, a lateral vertex of one of the upper intermediate crown facets 16C, and the upper vertex of one of the lower intermediate crown facets 18B. The upper edge of each of the star facets 14B is shared with an edge of the table 12. One of the lower edges of each of the star facets 14B is shared with an upper edge of one of the upper intermediate crown facets 16B. The other lower edge of each of the star facets 14B is shared with an upper edge of one of the upper intermediate crown facets 16C.

One upper vertex of each of the star facets 14C abuts a vertex of the table 12, an upper vertex of one of the star facets 14D, and the upper vertex of one of the upper intermediate crown facets 16D. The other upper vertex of each of the star facets 14C abuts a different vertex of the table 12, an upper vertex of one of the star facets 14B, and the upper vertex of one of the upper intermediate crown facets 16C. The lower vertex of each of the star facets 14C abuts a lateral vertex of one of the upper intermediate crown facets 16C, a lateral vertex of one of the upper intermediate crown facets 16D, and the upper vertex of one of the lower intermediate crown facets 18C. The upper edge of each of the star facets 14C is shared with an edge of the table 12. One of the lower edges of each of the star facets 14C is shared with an upper edge of one of the upper intermediate crown facets 16C. The other lower edge of each of the star facets 14B is shared with an upper edge of one of the upper intermediate crown facets 16D.

One upper vertex of each of the star facets 14D abuts a vertex of the table 12, an upper vertex of the other star facet 14D, and an upper vertex of the upper intermediate crown facet 16E. The other upper vertex of each of the star facets 14D abuts a different vertex of the table 12, an upper vertex of one of the star facets 14C, and the upper vertex of one of the upper intermediate crown facets 16D. The lower vertex of each of the star facets 14A abuts a lateral vertex of one of the upper intermediate crown facets 16D, a lateral vertex of the upper intermediate crown facet 16E, and the upper vertex of one of the lower intermediate crown facets 18D. The upper edge of each of the star facets 14D is shared with an edge of the table 12. One of the lower edges of each of the star facets 14D is shared with an upper edge of one of the upper intermediate crown facets 16D. The other lower edge of each of the star facets 14A is shared with an upper edge of the upper intermediate crown facet 16E.

While all of the star facets 14A-14D are triangle-shaped, in some implementations their shapes are all slightly different due to the elongated shape of the tapered end 13B of the crown 10. The lower vertex of each of the star facets 14A-14C is generally shifted slight towards the rounded end 13A of the crown 10, such that the angle bisector of the lower vertex of each of the star facets 14A-14C does not intersect the upper edges of each of the star facets 14A-14C at the midway point of the upper edges. The lower vertex of each of the star facets 14D is generally shifted towards the tapered end 13B of the crown 10. Further, the distance between the two upper vertices of each of the star facets 14A is generally less than the same distance on each of the star facets 14B. Finally, the height of each of the star facets 14A (e.g., the distance between the lower vertex and the upper edge) is generally greater than the height of each of the star facets 14B, which in turn is generally greater than the height of each of the star facets 14C, which is further generally greater than the height of each of the star facets 14D.

The table 12 is a generally horizontal surface having a number of edges and is located at the top of the crown 10. In the implementation illustrated in FIG. 2, table 12 has a generally octagonal shape. In this implementation, two edges of the table 12 are shared with the star facets 14A, two of the edges of the table 12 are shared with the star facets 14B, two of the edges of the table 12 are shared with the star facets 14C, and two of the edges of the table 12 are shared with the star facets 14C. Other shapes for table 12 are contemplated in other implementations. In some implementations, the table 12 has equal dimensions along the major axis $A_1$ and the minor axis $A_2$. In other implementations, the table 12 has a generally longer dimension along the major axis $A_1$, and a generally shorter dimension along the minor axis $A_2$. In still other implementations, the table 12 has a generally shorter dimension along the major axis $A_1$, and a generally longer dimension along the minor axis $A_2$.

Referring now to FIG. 3, a bottom plan view of the gemstone 1 showing the pavilion 30 is illustrated. In describing the facets of the crown pavilion 30 shown in FIG. 3, reference is made to the rounded end 33A and the tapered end 33B of the pavilion 30, and the first side 35A and the second side 35B of the pavilion 30. The ends 33A and 33B of the pavilion 30 generally correspond to the ends 3A and 3B of the gemstone 1.

The major axis $A_1$ of the perimeter of the gemstone (which is formed by the girdle 50) extends vertically relative to the plane of FIG. 3 (between the first side 35A of the pavilion 30 and the second side 35B of the pavilion 30), while the minor axis $A_2$ extends horizontally relative to the plane of FIG. 3 (between the rounded end 33A of the pavilion 30 and the tapered end 33B of the pavilion 30). As shown in FIG. 3, the major axis $A_1$ and the major axis $A_1$ generally intersect at the lower point 29. The major axis $A_1$ divides the table 12 between a left portion and right portion, and the minor axis $A_2$ divides the table 12 into a top portion and a bottom portion. However, while the major axis $A_1$ divides pavilion 30 generally in half between the first side 35A and the second side 35B, the minor axis $A_2$ generally does not divide the pavilion 30 in half between the rounded end 33A and the tapered end 33B. Instead, the tapered end 33B of the pavilion 30 is more elongated relative to the lower point 29 as compared to the rounded end 33A, and thus more of the surface area of the pavilion 30 lies below the minor axis $A_2$ than above the minor axis $A_2$.

The major and minor axes $A_1$ and $A_2$ generally divide the facets of the pavilion 30 into a first quadrant 31A, a second quadrant 31B, a third quadrant 31C, and fourth quadrant 31D. The first quadrant 31A generally corresponds to the top-right corner region of the pavilion 30 relative to the plane of FIG. 3. The second quadrant 31B generally corresponds to the top-left corner region of the pavilion 30 relative to the plane of FIG. 3. The third quadrant 31C generally corresponds to the bottom-left corner region of the pavilion 30 relative to the plane of FIG. 3. The fourth quadrant 31D generally corresponds to the bottom-right corner region of the pavilion 30 relative to the plane of FIG. 3.

The terms "top," "bottom," "left," "right," "above," below," etc. are used herein to refer to the locations of the various facets on the pavilion 30. However, those of skill in the art will understand that these are relative terms that are generally used in reference to the plane of FIG. 3. Thus, any of these terms used to describe an individual facet may not apply when viewing the pavilion 30 from a different perspective. The facets on the surface of the pavilion 30 share edges and vertices where the facets meet. The facets on the surface of the pavilion 30 share edges and vertices where the facets meet. When describing the facets on the surface of the pavilion 30, the term "lower" is used to refer to edges or vertices nearer to the lower point 29 (see FIGS. 1A and 1B), while the term "upper" is used to refer to edges or vertices nearer to the girdle 50.

The pavilion 30 includes a number of main pavilion facets, which include one main pavilion facet 36A, two main pavilion facets 36B, two main pavilion facets 36C, two main pavilion facets 36D, and one main pavilion facet 36E. Each main pavilion facet 36A-36E, is generally diamond or kite-shaped with a flattened lower edge. Thus, each main pavilion facet 36A-36E has a pentagon shape with two lower vertices, two lateral vertices, and an upper vertex; and a lower edge, two lateral edges, and two upper edges.

Main pavilion facet 36A is generally split in half by the major axis $A_1$, and is disposed above the minor axis $A_2$. Thus, main pavilion facet 36A is disposed on the rounded end 33A of the pavilion 30, with about half of its surface area in the first quadrant 31A on the first side 35A of the pavilion 30, and about half of its surface area in the second quadrant 31B on the second side 35B of the pavilion 30. The main pavilion facet 36A is generally positioned between the culet-adjacent facet 32A, the two candle facets 34A, a lower girdle facet 38A from each of two pairs of lower girdle facets 38A, and the lower edge of the girdle. Generally, the main pavilion facet 36A is positioned at the same location along the minor axis $A_2$ as the main pavilion facet 36E. The main pavilion facet 36A and the main pavilion facet 36E are thus disposed along the major axis $A_1$.

The two main pavilion facets 36B are both disposed above the minor axis $A_2$, on the rounded end 33A of the pavilion 30. A first main pavilion facet 36B is disposed to the right of the major axis $A_1$, in the first quadrant 31A. A second main pavilion facet 36B is disposed to the left of the major axis $A_1$, in the second quadrant 31B. Each main pavilion facet 36B is generally positioned between one of the culet-adjacent facets 32B, one of the candle facets 34A, one of the candle facets 34B, a lower girdle facet 38A from one pair of lower girdle facets 38A, a lower girdle facet 38B from one pair of lower girdle facets 38B, and the lower edge of the girdle. Generally, the two main pavilion facets 36B are positioned at the same location along the major axis $A_1$, and are thus disposed along an axis that is parallel to and above the minor axis $A_2$.

The two main pavilion facets 36C are disposed at opposite ends of the minor axis $A_2$, and are disposed to the left and to the right of the major axis $A_1$. The main pavilion facets 36C are disposed such that more than half of the surface area of each of the main pavilion facets 36C is above the minor axis $A_2$, due to the elongated shape of the tapered end 33B. Thus, a first main pavilion facet 36C is disposed on the first side 35A of the pavilion 30, with more than half of its surface area in the first quadrant 31A on the rounded end 33A of the pavilion 30, and less than half of its surface area in the fourth quadrant 31D on the tapered end 33C of the pavilion 30. A second main pavilion facet 36C is disposed on the second side 35B of the pavilion 30, with more than half of its surface area in the second quadrant 31B on the rounded end 33A of the pavilion 30, and less than half of its surface area in the third quadrant 31C on the tapered end 33C of the pavilion 30. Each main pavilion facet 36C is generally positioned between one of the culet-adjacent facets 32C, one of the candle facets 34B, one of the candle facets 34C, a lower girdle facet 38B from one pair of lower girdle facets 38B, a lower girdle facet 38C from one pair of lower girdle facets 38C, and the lower edge of the girdle. Generally, the two main pavilion facets 36C are positioned at the same location along the major axis $A_1$, and are thus disposed along the minor axis $A_2$.

The two main pavilion facets 36D are both disposed below the minor axis $A_2$, on the tapered end 33B of the pavilion 30. A first main pavilion facet 36D is disposed to the left of the major axis $A_1$, in the third quadrant 31C. A second main pavilion facet 36D is disposed to the right of the major axis $A_1$, in the fourth quadrant 31D. Each main pavilion facet 36D is generally positioned between one of the culet-adjacent facets 32D, one of the candle facets 34C, one of the candle facets 34D, a lower girdle facet 38C from one pair of lower girdle facets 38C, a lower girdle facet 38D from one pair of lower girdle facets 38D, and the lower edge of the girdle. Generally, the two main pavilion facets 36D are positioned at the same location along the major axis $A_1$, and are thus disposed along an axis that is parallel to and below the minor axis $A_2$.

Main pavilion facet 36E is generally split in half by the major axis $A_1$, and is disposed below the minor axis $A_2$. Thus, main pavilion facet 36E is disposed on the tapered end 33B of the pavilion 30, with about half of its surface area in the third quadrant 31C on the second side 35B of the pavilion 30, and about half of its surface area in the fourth quadrant 31D on the first side 35B of the pavilion 30. The main pavilion facet 36E is generally positioned between the culet-adjacent facet 32E, the two candle facets 34D, a lower girdle facet 38D from each of two pairs of lower girdle facets 38D, and the lower edge of the girdle. Generally, the main pavilion facet 36E is positioned at the same location along the minor axis $A_2$ as the main pavilion facet 36A. The main pavilion facet 36E and the main pavilion facet 36A are thus disposed along the major axis $A_1$.

The two lower vertices of the main pavilion facet 36A each abut one of the upper vertices of the culet-adjacent facet 32A, and a lower-lateral vertex of each of the candle facets 34A. The two lateral vertices of the main pavilion facet 36A each abut an upper-lateral vertex of each of the candle facets 34A, and a lower vertex of a lower girdle facet 38A of each of the lower girdle facets 38A.

The lower edge of the main pavilion facet 36A is shared with the upper edge of the culet-adjacent facet 32A. One lateral edge of the main pavilion facet 36A is shared with a lateral edge of one of the candle facets 34A, and the other lateral edge of the main pavilion facet 36A is shared with a lateral edge of the other one of the candle facets 34A. One upper edge of the main pavilion facet 36A is shared with an edge of a lower girdle facet 38A from one pair of lower girdle facets 38A, and the other upper edge of the main pavilion facet 36A is shared with an edge of a lower girdle facet 38A from the other pair of lower girdle facets 38A.

The two lower vertices of each of the main pavilion facets 36B each abut one of the upper vertices of one of the culet-adjacent facets 32B, a lower-lateral vertex of one of the candle facets 34A, and a lower-lateral vertex of one of the candle facets 34B. The two lateral vertices of each of the main pavilion facets 36B each abut an upper-lateral vertex of one of the candle facets 34A, an upper-lateral vertex of one of the candle facets 34B, a lower vertex of a lower girdle facet 38A of one of the lower girdle facets 38A, and a lower vertex of a lower girdle facet 38B of one of the lower girdle facets 38B.

The lower edge of the each of the main pavilion facets 36B is shared with the upper edge of one of the culet-adjacent facets 32B. One lateral edge of each of the main pavilion facets 36B is shared with a lateral edge of one of the candle facets 34A, and the other lateral edge of each of the main pavilion facets 36B is shared with a lateral edge of one of the candle facets 34B. One upper edge of each of the main pavilion facets 36B is shared with an edge of a lower girdle facet 38A from one of the pairs of lower girdle facets 38A, and the other upper edge of each of the main pavilion facets 36B is shared with an edge of a lower girdle facet 38B from one of the pairs of lower girdle facets 38B.

The two lower vertices of each of the main pavilion facets 36C each abut one of the upper vertices of one of the culet-adjacent facets 32C, a lower-lateral vertex of one of the candle facets 34B, and a lower-lateral vertex of one of the candle facets 34C. The two lateral vertices of each of the main pavilion facets 36C each abut an upper-lateral vertex of one of the candle facets 34B, an upper-lateral vertex of one of the candle facets 34C, a lower vertex of a lower girdle facet 38B of one of the lower girdle facets 38B, and a lower vertex of a lower girdle facet 38C of one of the lower girdle facets 38C.

The lower edge of the each of the main pavilion facets 36C is shared with the upper edge of one of the culet-adjacent facets 32C. One lateral edge of each of the main pavilion facets 36C is shared with a lateral edge of one of the candle facets 34B, and the other lateral edge of each of the main pavilion facets 36C is shared with a lateral edge of one of the candle facets 34C. One upper edge of each of the main pavilion facets 36C is shared with an edge of a lower girdle facet 38B from one of the pairs of lower girdle facets 38B, and the other upper edge of each of the main pavilion facets 36C is shared with an edge of a lower girdle facet 38C from one of the pairs of lower girdle facets 38C.

The two lower vertices of each of the main pavilion facets 36D each abut one of the upper vertices of one of the culet-adjacent facets 32D, a lower-lateral vertex of one of the candle facets 34C, and a lower-lateral vertex of one of the candle facets 34D. The two lateral vertices of each of the main pavilion facets 36D each abut an upper-lateral vertex of one of the candle facets 34C, an upper-lateral vertex of one of the candle facets 34D, a lower vertex of a lower girdle facet 38C of one of the lower girdle facets 38C, and a lower vertex of a lower girdle facet 38D of one of the lower girdle facets 38D.

The lower edge of the each of the main pavilion facets 36D is shared with the upper edge of one of the culet-adjacent facets 32D. One lateral edge of each of the main pavilion facets 36D is shared with a lateral edge of one of the candle facets 34C, and the other lateral edge of each of the main pavilion facets 36D is shared with a lateral edge of one of the candle facets 34D. One upper edge of each of the main pavilion facets 36D is shared with an edge of a lower girdle facet 38C from one of the pairs of lower girdle facets 38C, and the other upper edge of each of the main pavilion facets 36D is shared with an edge of a lower girdle facet 38D from one of the pairs of lower girdle facets 38D.

The two lower vertices of the main pavilion facet 36E each abut one of the upper vertices of the culet-adjacent facet 32E, and a lower-lateral vertex of each of the candle facets 34D. The two lateral vertices of the main pavilion facet 36E each abut an upper-lateral vertex of each of the candle facets 34D, and a lower vertex of a lower girdle facet 38D of each of the lower girdle facets 38D.

The lower edge of the main pavilion facet 36E is shared with the upper edge of the culet-adjacent facet 32E. One lateral edge of the main pavilion facet 36E is shared with a lateral edge of one of the candle facets 34D, and the other lateral edge of the main pavilion facet 36E is shared with a lateral edge of the other one of the candle facets 34D. One upper edge of the main pavilion facet 36E is shared with an edge of a lower girdle facet 38D from one pair of lower girdle facets 38D, and the other upper edge of the main pavilion facet 36E is shared with an edge of a lower girdle facet 38D from the other pair of lower girdle facets 38D.

While all of the main pavilion facets 36A-36E are generally pentagon-shaped with a flattened lower edge, in some implementations their shapes are all slightly different due to the elongated shape of the tapered end 33B of the pavilion 30. Main pavilion facets 36A and 36E are both generally symmetrical across the major axis $A_1$. However, main pavilion facet 36E is elongated along the major axis $A_1$, and thus the distance between the upper vertex and the lower edge of the main pavilion facet 36E is larger than the distance between the upper vertex and the lower edge of the main pavilion facet 36A.

In each of the main pavilion facets 36B-36D, the upper vertex is generally shifted away from the lower edge. Thus, the angle bisector of the upper vertex does not intersect at the midpoint of the lower edges. The upper vertex of each of the main pavilion facets 36B is generally shifted toward the tapered end 33B. The upper vertex of each of the main pavilion facets 36C is also generally shifted toward the tapered end 33B. The distance between the upper vertex and the lower edge of the main pavilion facets 36B is generally larger than the distance between the upper edge and the lower edge of the main pavilion facets 36C. The upper vertex of each of the main pavilion facets 36D is generally shifted toward the rounded end 33A.

Thus, the shapes of the main pavilion facets 36A-36E can vary depending on their location along the pavilion 30. However, in other implementations, any one of the groups of main pavilion facets 36A-36E can have the same size and shape as any of the other groups of main pavilion facets 36A-36E.

The pavilion 30 includes two pairs of lower girdle facets 38A, two pairs of lower girdle facets 38B, two pairs of lower girdle facets 382C, and two pairs of lower girdle facets 38D. Each of the lower girdle facets 38A-38D has a generally triangular shape. However, each pair of lower girdle facets 38A-38D forms a notch into which one of the candle facets fits. Thus, each lower girdle facet 38A-38D has four edges and four vertices, while maintaining a generally triangular shape. Each pair of lower girdle facets 38A-38D is formed as two triangular-shaped facets sharing one generally straight edge.

The two pairs of lower girdle facets 38A are disposed at the rounded end 33A of the pavilion 30, above the minor axis $A_2$ and on either side of the major axis $A_1$. A first pair of lower girdle facets 38A is disposed to the right of the major axis $A_1$, in the first quadrant 31A. A second pair of lower girdle facets 38A is disposed to the left of the major axis $A_1$, in the second quadrant 31B. Generally, the first and second pairs of lower girdle facets 38A are positioned at the same location along the major axis $A_1$, and are thus disposed along an axis that is parallel to and above the minor axis $A_2$. Each lower girdle facet 38A in each pair of lower girdle facets 38A is generally positioned between one of the candle facets 34A, either (i) the main pavilion facet 36A or (ii) one of the main pavilion facets 36B, the other lower girdle facet 38A in the same pair of lower girdle facets 38A, and either (i) a lower girdle facet 38A from an adjacent pair of lower girdle facets 38A or (ii) a lower girdle facet 38B from an adjacent pair of lower girdle facets 38B.

The two pairs of lower girdle facets 38B are disposed above the minor axis $A_2$, on either the first side 35A of the pavilion 30 or the second side 35B of the pavilion 30. A first pair of lower girdle facets 38B is disposed to the right of the major axis $A_1$, in the first quadrant 31A. The first pair of lower girdle facets 38B is positioned between the first pair of lower girdle facets 38A and the tapered end 33B, in a clockwise direction along the circumference of the gemstone 1. A second pair of lower girdle facets 38B is disposed to the left of the major axis $A_1$, in the second quadrant 31B. The second pair of lower girdle facets 38B is positioned between the second pair of lower girdle facets 38A and the tapered end 33B, in a counter-clockwise direction along the circumference of the gemstone 1. Each lower girdle facet 38B in each pair of lower girdle facets 38B is generally positioned between one of the candle facets 34B, either (i) one of the main pavilion facets 36B or (ii) one of the main pavilion facets 36C, the other lower girdle facet 38B in the same pair of lower girdle facets 38A, and either (i) a lower girdle facet 38A from an adjacent pair of lower girdle facets 38A or (ii) a lower girdle facet 38C from an adjacent pair of lower girdle facets 38C.

The two pairs of lower girdle facets 38C are disposed substantially below the minor axis $A_2$, on either the first side 35A of the pavilion 30 or the second side 35B of the pavilion 30. However, a portion of one of the lower girdle facets 38C from each pair extends above the minor axis $A_2$. A first pair of lower girdle facets 38C is disposed to the left of the major axis $A_1$, substantially in the third quadrant 31C with a portion in the second quadrant 31B. The first pair of lower girdle facets 38C is positioned between the second pair of lower girdle facets 38B and the tapered end 33B, in a counter-clockwise direction along the circumference of the gemstone 1. A second pair of lower girdle facets 38C is disposed to the right of the major axis $A_1$, substantially in the fourth quadrant 31D with a portion in the first quadrant 31A. The second pair of lower girdle facets 38C is positioned between the first pair of lower girdle facets 38A and the tapered end 33B, in a clockwise direction along the circumference of the gemstone 1. Each lower girdle facet 38C in each pair of lower girdle facets 38C is generally positioned between one of the candle facets 34C, either (i) one of the main pavilion facets 36C or (ii) one of the main pavilion facets 36D, the other lower girdle facet 38C in the same pair of lower girdle facets 38C, and either (i) a lower girdle facet 38B from an adjacent pair of lower girdle facets 38B or (ii) a lower girdle facet 38D from an adjacent pair of lower girdle facets 38D.

The two pairs of lower girdle facets 38D are disposed at the tapered end 33B of the pavilion 30, below the minor axis $A_2$ and on either side of the major axis $A_1$. A first pair of lower girdle facets 38D is disposed to the left of the major axis $A_1$, in the third quadrant 31C. A second pair of lower girdle facets 38D is disposed to the right of the major axis $A_1$, in the fourth quadrant 31D. Generally, the first and second pairs of lower girdle facets 38D are positioned at the same location along the major axis $A_1$, and are thus disposed along an axis that is parallel to and below the minor axis $A_2$. Each lower girdle facet 38D in each pair of lower girdle facets 38D is generally positioned between one of the candle facets 34D, either (i) one of the main pavilion facets 36D or (ii) the main pavilion facet 36E, the other lower girdle facet 38D in the same pair of lower girdle facets 38*d*, and either (ii) a lower girdle facet 38C from an adjacent pair of lower girdle facets 38C or (ii) a lower girdle facet 38A from an adjacent pair of lower girdle facets 38A.

A lower vertex of each lower girdle facet 38A abuts an upper-lateral vertex of one of the candle facets 34A. A lateral vertex of each lower girdle facet 38A abuts an upper vertex of one of the candle facets 34A. One upper vertex of each lower girdle facet 38A abuts an upper vertex of the other lower girdle facet 38A in the pair of lower girdle facets 38A. The other upper vertex of each lower girdle facet 38A abuts an upper vertex of either (i) a lower girdle facet 38A from an adjacent pair of lower girdle facets 38A, or (ii) a lower girdle facet 38B from an adjacent pair of lower girdle facets 38B.

A first edge of each lower girdle facet 38A is shared with an upper edge of one of the candle facets 34A. A second edge of each lower girdle facet 38A is shared with an upper edge of either (i) the main pavilion facet 36A or (ii) one of the main pavilion facets 36B. A third edge of each lower girdle facet 38A is shared with an edge of the lower girdle facet 38A in the same pair of lower girdle facets 38A. An upper edge of each lower girdle facet 38A is shared with the lower edge of the girdle 50.

A lower vertex of each lower girdle facet 38B abuts an upper-lateral vertex of one of the candle facets 34B. A lateral vertex of each lower girdle facet 38B abuts an upper vertex of one of the candle facets 34B. One upper vertex of each lower girdle facet 38B abuts an upper vertex of the other lower girdle facet 38B in the pair of lower girdle facets 38B. The other upper vertex of each lower girdle facet 38B abuts an upper vertex of either (i) a lower girdle facet 38A from an adjacent pair of lower girdle facets 38A, or (ii) a lower girdle facet 38C from an adjacent pair of lower girdle facets 38C.

A first edge of each lower girdle facet 38B is shared with an upper edge of one of the candle facets 34B. A second edge of each lower girdle facet 38B is shared with an upper edge of either (i) one of the main pavilion facets 36B or (ii) one of the main pavilion facets 36C. A third edge of each lower girdle facet 38B is shared with an edge of the lower girdle facet 38B in the same pair of lower girdle facets 38B. An upper edge of each lower girdle facet 38B is shared with the lower edge of the girdle 50.

A lower vertex of each lower girdle facet 38C abuts an upper-lateral vertex of one of the candle facets 34C. A lateral vertex of each lower girdle facet 38C abuts an upper vertex of one of the candle facets 34C. One upper vertex of each lower girdle facet 38C abuts an upper vertex of the other lower girdle facet 38C in the pair of lower girdle facets 38C. The other upper vertex of each lower girdle facet 38C abuts an upper vertex of either (i) a lower girdle facet 38B from an adjacent pair of lower girdle facets 38B, or (ii) a lower girdle facet 38B from an adjacent pair of lower girdle facets 38B.

A first edge of each lower girdle facet 38C is shared with an upper edge of one of the candle facets 34C. A second edge of each lower girdle facet 38C is shared with an upper edge of either (i) one of the main pavilion facets 36C or (ii) one of the main pavilion facets 36D. A third edge of each lower girdle facet 38C is shared with an edge of the lower girdle facet 38C in the same pair of lower girdle facets 38C. An upper edge of each lower girdle facet 38C is shared with the lower edge of the girdle 50.

A lower vertex of each lower girdle facet 38D abuts an upper-lateral vertex of one of the candle facets 34D. A lateral vertex of each lower girdle facet 38D abuts an upper vertex of one of the candle facets 34D. One upper vertex of each lower girdle facet 38D abuts an upper vertex of the other lower girdle facet 38D in the pair of lower girdle facets 38D. The other upper vertex of each lower girdle facet 38D abuts an upper vertex of either (i) a lower girdle facet 38C from an adjacent pair of lower girdle facets 38C, or (ii) a lower girdle facet 38D from an adjacent pair of lower girdle facets 38D.

A first edge of each lower girdle facet 38D is shared with an upper edge of one of the candle facets 34D. A second edge of each lower girdle facet 38D is shared with an upper edge of either (i) one of the main pavilion facets 36D or (ii) the main pavilion facet 36E. A third edge of each lower girdle facet 38D is shared with an edge of the lower girdle facet 38D in the same pair of lower girdle facets 38D. An upper edge of each lower girdle facet 38D is shared with the lower edge of the girdle 50.

In the illustrated implementation, the upper edge of the lower girdle facets 38A-38D generally increases as the lower girdle facet is closer toward the tapered end 33B of the pavilion 30. Thus, the combined length of the upper edges of each pair of lower girdle facets 38D is generally greater than the combined length of the upper edges of each pair of lower girdle facets 38C, which is generally greater than the combined length of the upper edges of each pair of lower girdle facets 38B, and which is generally greater than the combined length of the upper edges of each pair of lower girdle facets 38A. However, in other implementations, the upper edges of some or all of the lower girdle facets 38A-38D are generally the same length, such that all of the lower girdle facets 38A-38D are the same size.

Eight culet-adjacent facets are formed at the lowermost portion of the pavilion 30, which includes one culet-adjacent facet 32A, two culet-adjacent facets 32B, two culet-adjacent facets 32C, two culet-adjacent facets 32D, and one culet-adjacent facet 32E. Each culet-adjacent facet 32A-32E has a generally pentagonal shape with a lower vertex, two lateral vertices, and two upper vertices; and a flat upper edge, two lateral edges, and two lower edges. The flat upper edge is opposite the lower vertex of each culet-adjacent facet 32A-32E. In some implementations, the two lower edges of each of the culet-adjacent facets 32A-32E terminate in a culet, which is a horizontal surface forming the bottom of the pavilion 30. In the implementation illustrated in FIG. 3, the lower edges of each of the culet-adjacent facets 32A-32E terminates in a bottom vertex. Together, the bottom vertices of each of the culet-adjacent facets 32A-32E form the lower point 29 of the gemstone 1 (see FIGS. 1A and 1B).

Culet-adjacent facet 32A is generally split in half by the major axis $A_1$, and is disposed above the minor axis $A_2$. Thus, culet-adjacent facet 32A is disposed nearer to the rounded end 33A of the pavilion 30, with about half of its surface area in the first quadrant 31A on the first side 35A of the pavilion 30, and about half of its surface area in the second quadrant 31B on the second side 35B of the pavilion 30. The culet-adjacent facet 32A is generally positioned between the two culet-adjacent facets 32B, the two candle facets 34, and the main pavilion facet 36A. Generally, the culet-adjacent facet 32A is positioned at the same location along the minor axis $A_2$ as the culet-adjacent facet 32E. The culet-adjacent facet 32A and the culet-adjacent facet 32E are thus disposed along the major axis $A_1$.

The culet-adjacent facets 32B are both disposed above the minor axis $A_2$, on the rounded end 33A of the pavilion 30. A first culet-adjacent facet 32B is disposed to the right of the major axis $A_1$, in the first quadrant 31A. A second culet-adjacent facet 32B is disposed to the left of the major axis $A_1$, in the second quadrant 31B. Each culet-adjacent facet 32B is generally positioned between the culet-adjacent facet 32A, one of the culet-adjacent facets 32C, one of the candle facets 34A, one of the candle facets 34B, and one of the main pavilion facets 36B. Generally, the two main pavilion facets 36B are positioned at the same location along the major axis $A_1$, and are thus disposed along an axis that is parallel to and above the minor axis $A_2$.

The two culet-adjacent facets 32C are disposed at opposite ends of the minor axis $A_2$, and are disposed to the left and to the right of the major axis $A_1$. The culet-adjacent facets 32C are disposed such that more than half of the surface area of each of the culet-adjacent facets 32C is above the minor axis $A_2$, due to the elongated shape of the tapered end 33B. Thus, a first culet-adjacent facet 32C is disposed on the first side 35A of the pavilion 30, with more than half of its surface area in the first quadrant 31A on the rounded end 33A of the pavilion 30, and less than half of its surface area in the fourth quadrant 31D on the tapered end 33C of the pavilion 30. A second culet-adjacent facet 32C is disposed on the second side 35B of the pavilion 30, with more than half of its surface area in the second quadrant 31B on the rounded end 33A of the pavilion 30, and less than half of its surface area in the third quadrant 31C on the tapered end 33C of the pavilion 30. Each culet-adjacent facet 32C is generally positioned between one of the culet-adjacent facets 32B, one of the culet-adjacent facets 32D, one of the candle facets 34B, one of the candle facets 34C, and one of the main pavilion facets 36C. Generally, the two culet-adjacent facets 32C are positioned at the same location along the major axis $A_1$, and are thus disposed along the minor axis $A_2$.

The two culet-adjacent facets 32D are both disposed below the minor axis $A_2$, on the tapered end 33B of the pavilion 30. A first culet-adjacent facet 32D is disposed to the left of the major axis $A_1$, in the third quadrant 31C. A second culet-adjacent facet 32D is disposed to the right of the major axis $A_1$, in the fourth quadrant 31D. Each culet-adjacent facet 32D is generally positioned between one of the culet-adjacent facets 32C, the culet-adjacent facet 32E, one of the candle facets 34C, one of the candle facets 34D, and one of the main pavilion facets 36D. Generally, the two culet-adjacent facets 32D are positioned at the same location along the major axis $A_1$, and are thus disposed along an axis that is parallel to and below the minor axis $A_2$.

The culet-adjacent facet 32E is generally split in half by the major axis $A_1$, and is disposed below the minor axis $A_2$. Thus, culet-adjacent facet 32E is disposed on the tapered end 33B of the pavilion 30, with about half of its surface area in the third quadrant 31C on the second side 35B of the pavilion 30, and about half of its surface area in the fourth quadrant 31D on the first side 35B of the pavilion 30. The culet-adjacent facet 32E is generally positioned between the two culet-adjacent facets 32D, the two candle facets 34D, and the main pavilion facet 36E. Generally, the culet-adjacent facet 32E is positioned at the same location along the minor axis $A_2$ as the culet-adjacent facet 32A. The culet-adjacent facet 32E and the culet-adjacent facet 32A are thus disposed along the major axis $A_1$.

The lower vertex of the culet-adjacent facet 32A abuts the lower vertices of each of the other culet-adjacent facets 32B-32E, to form the lower point 29. The two lateral vertices of the culet-adjacent facet 32A each abut a lateral vertex of one of the culet-adjacent facets 32B, and a lower vertex of one of the candle facets 34A. The two upper vertices of the culet-adjacent facet 32A each abut a lower-lateral vertex of one of the candle facets 34A, and one of the lower vertices of the main pavilion facet 36A.

The upper edge of the culet-adjacent facet 32A is shared with the lower edge of the main pavilion facet 36A. Each of the two lateral edges of the culet-adjacent facet 32A is shared with a lower edge of one of the candle facets 34A. Each of the two lower edges of the culet-adjacent facet 32A is shared with a lower edge of one of the culet-adjacent facets 32B.

The lower vertex of each of the culet-adjacent facets 32B abuts the lower vertices of each of the other culet-adjacent facets 32A and 32C-32E, to form the lower point 29. Each of the two lateral vertices of each of the culet-adjacent facets 32B abuts a lateral vertex of either (i) the culet-adjacent facet 32A or (ii) one of the culet-adjacent facets 32C, and a lower vertex of either (i) one of the candle facets 34A or (ii) one of the candle facets 34B. Each of the two upper vertices of each of the culet-adjacent facets 32B abuts a lower-lateral vertex either (i) one of the candle facets 34A or (ii) one of the candle facets 34B, and one of the lower vertices of one of the main pavilion facets 36B.

The upper edge of each of the culet-adjacent facets 32B is shared with the lower edge of one of the main pavilion facets 36B. Each of the two lateral edges of each of the culet-adjacent facets 32B is shared with a lower edge of either (i) one of the candle facets 34A or (ii) one of the candle facets 34B. Each of the two lower edges of each of the culet-adjacent facets 32B is shared with a lower edge of either (i) the culet-adjacent facet 32A or (ii) one of the culet-adjacent facets 32C.

The lower vertex of each of the culet-adjacent facets 32C abuts the lower vertices of each of the other culet-adjacent facets 32A-32B and 32D-32E, to form the lower point 29. Each of the two lateral vertices of each of the culet-adjacent facets 32C abuts a lateral vertex of either (i) one of the culet-adjacent facets 32B or (ii) one of the culet-adjacent facets 32D, and a lower vertex of either (i) one of the candle facets 34B or (ii) one of the candle facets 34D. Each of the two upper vertices of each of the culet-adjacent facets 32C abuts a lower-lateral vertex either (i) one of the candle facets 34B or (ii) one of the candle facets 34C, and one of the lower vertices of one of the main pavilion facets 36C.

The upper edge of each of the culet-adjacent facets 32C is shared with the lower edge of one of the main pavilion facets 36C. Each of the two lateral edges of each of the culet-adjacent facets 32C is shared with a lower edge of either (i) one of the candle facets 34B or (ii) one of the candle facets 34C. Each of the two lower edges of each of the culet-adjacent facets 32C is shared with a lower edge of either (i) the culet-adjacent facet 32B or (ii) one of the culet-adjacent facets 32D.

The lower vertex of each of the culet-adjacent facets 32D abuts the lower vertices of each of the other culet-adjacent facets 32A-32C and 32E, to form the lower point 29. Each of the two lateral vertices of each of the culet-adjacent facets 32D abuts a lateral vertex of either (i) one of the culet-adjacent facets 32C or (ii) the culet-adjacent facet 32E, and a lower vertex of either (i) one of the candle facets 34C or (ii) one of the candle facets 34D. Each of the two upper vertices of each of the culet-adjacent facets 32D abuts a lower-lateral vertex either (i) one of the candle facets 34C or (ii) one of the candle facets 34D, and one of the lower vertices of one of the main pavilion facets 36D.

The upper edge of each of the culet-adjacent facets 32D is shared with the lower edge of the main pavilion facet 36E. Each of the two lateral edges of each of the culet-adjacent facets 32D is shared with a lower edge of either (i) one of the candle facets 34C or (ii) one of the candle facets 34D. Each of the two lower edges of each of the culet-adjacent facets 32D is shared with a lower edge of either (i) one of the culet-adjacent facets 32C or (ii) the culet-adjacent facet 32E.

The lower vertex of the culet-adjacent facet 32E abuts the lower vertices of each of the other culet-adjacent facets 32A-32D, to form the lower point 29. The two lateral vertices of the culet-adjacent facet 32E each abut a lateral vertex of one of the culet-adjacent facets 32D, and a lower vertex of one of the candle facets 34D. The two upper vertices of the culet-adjacent facet 32E each abut a lower-lateral vertex of one of the candle facets 34D, and one of the lower vertices of the main pavilion facet 36E.

The upper edge of the culet-adjacent facet 32E is shared with the lower edge of the main pavilion facet 36E. Each of the two lateral edges of the culet-adjacent facet 32E is shared with a lower edge of one of the candle facets 34D. Each of the two lower edges of the culet-adjacent facet 32E is shared with a lower edge of one of the culet-adjacent facets 32D.

While all of the culet-adjacent facets 32A-32E are generally pentagon-shaped with a flattened upper edge, in some implementations their shapes are all slightly different due to the elongated shape of the tapered end 33B of the pavilion 30. Culet-adjacent facets 32A and 32E are both generally symmetrical across the major axis $A_1$. However, culet-adjacent facet 32E is elongated along the minor axis $A_2$, and thus the distance between the lateral vertices of the culet-adjacent facet 32E is larger than the distance between the lateral vertices of the culet-adjacent facet 32A.

In each of the culet-adjacent facets 32B-32D, the lower vertex is generally shifted away from the midpoint of the upper edge. Thus, the angle bisectors of the lower vertices do not intersect at the midpoint of the upper edges. The lower vertex of each of the culet-adjacent facets 32B is generally shifted toward the tapered end 33B. The lower vertex of each of the culet-adjacent facets 32C is also generally shifted toward the tapered end 33B. The lower vertex of each of the culet-adjacent facets 32D is generally shifted toward the rounded end 33A. The distance between the two lateral vertices of the culet-adjacent facets 32D is generally larger than the distance between the lateral vertices of the culet-adjacent facets 32B and 32D.

Thus, the shapes of the culet-adjacent facets 32A-32E can vary depending on their location along the pavilion 30. However, in other implementations, any one of the groups of culet-adjacent facets 32A-32E can have the same size and shape as any of the other groups of culet-adjacent facets 32A-32E.

The pavilion 30 includes two candle facets 34A, two candle facets 34B, two candle facets 34C, and two candle facets 34D. Each candle facet 34A-34D has an elongated shape with six vertices and six edges. The six vertices include an upper vertex, two upper-lateral vertices, two lower-lateral vertices, and a lower vertex. The six edges include two upper edges, two lower edges, and two lateral edges.

The two candle facets 34A are both disposed at the same location along the major axis $A_1$, above the minor axis $A_2$ on the rounded end 33A of the pavilion 30. A first candle facet 34A is disposed to the right of the major axis $A_1$, in the first quadrant 31A. A second candle facet 34A is disposed to the left of the major axis $A_1$, in the second quadrant 31B. Both the candle facets 34A have a larger vertical component (relative to the plane of FIG. 3) than horizontal component. Each candle facet 34A is generally positioned between the culet-adjacent facet 32A, one of the culet-adjacent facets 32B, the main pavilion facet 36A, one of the main pavilion facets 36B, and one of the pairs of lower girdle facets 38A.

A lower portion of each of the candle facets 34A extends between the culet-adjacent facet 32A and one of the culet-adjacent facets 32B. An upper portion of each of the candle facets 34A extends between the two lower girdle facets 38A of one of the pairs of lower girdle facets 38A.

The two candle facets 34B are both disposed at the same location along the major axis $A_1$, above the minor axis $A_2$ on the rounded end 33A of the pavilion 30. A first candle facet 34B is disposed to the right of the major axis $A_1$, in the first quadrant 31A. A second candle facet 34B is disposed to the left of the major axis $A_1$, in the second quadrant 31B. The first candle facet 34B is positioned generally clockwise relative to the first candle facet 34A, while the second candle facet 34B is position generally counter-clockwise relative to the second candle facet 34A. Both the candle facets 34B have a larger horizontal component (relative to the plane of FIG. 3) than vertical component. Each candle facet 34B is generally positioned between one of the culet-adjacent facets 32B, one of the culet-adjacent facets 32C, one of the main pavilion facets 36B, one of the main pavilion facets 36C, and one of the pairs of lower girdle facets 38B. A lower portion of each of the candle facets 34B extends between one of the culet-adjacent facets 32B and one of the culet-adjacent facets 32C. An upper portion of each of the candle facets 34B extends between the two lower girdle facets 38B of one of the pairs of lower girdle facets 38B.

The two candle facets 34C are both disposed at the same location along the major axis $A_1$, below the minor axis $A_2$ on the tapered end 33B of the pavilion 30. A first candle facet 34C is disposed to the left of the major axis $A_1$, in the third quadrant 31C. A second candle facet 34B is disposed to the right of the major axis $A_1$, in the fourth quadrant 31D. The first candle facet 34C is positioned generally counter-clockwise relative to the second candle facet 34B, while the second candle facet 34C is positioned generally clockwise relative to the first candle facet 34B. Both the candle facets 34C have a larger horizontal component (relative to the plane of FIG. 3) than vertical component. Each candle facet 34C is generally positioned between one of the culet-adjacent facets 32C, one of the culet-adjacent facets 32D, one of the main pavilion facets 36C, one of the main pavilion facets 36D, and one of the pairs of lower girdle facets 38C. A lower portion of each of the candle facets 34C extends between one of the culet-adjacent facets 32C and one of the culet-adjacent facets 32D. An upper portion of each of the candle facets 34C extends between the two lower girdle facets 38C of one of the pairs of lower girdle facets 38C.

The two candle facets 34D are both disposed at the same location along the major axis $A_1$, below the minor axis $A_2$ on the tapered end 33B of the pavilion 30. A first candle facet 34D is disposed to the left of the major axis $A_1$, in the third quadrant 31C. A second candle facet 34D is disposed to the right of the major axis $A_1$, in the fourth quadrant 31D. The first candle facet 34D is positioned generally counter-clockwise relative to the first candle facet 34C, while the second candle facet 34D is position generally clockwise relative to the second candle facet 34C. Both the candle facets 34D have a larger vertical component (relative to the plane of FIG. 3) than horizontal component. Each candle facet 34D is generally positioned between one of the culet-adjacent facets 32D, the culet-adjacent facet 32E, one of the main pavilion facets 36D, the main pavilion facet 36E, and one of the pairs of lower girdle facets 38D. A lower portion of each of the candle facets 34D extends between one of the culet-adjacent facets 32D and the culet-adjacent facet 32E. An upper portion of each of the candle facets 34D extends between the two lower girdle facets 38D of one of the pairs of lower girdle facets 38D.

While all of the candle facets 34A-34D have generally the same six-sided shape with pointed upper and lower ends, in some implementations their shapes are all slightly different due to the elongated shape of the tapered end 33B of the pavilion 30. The distance between the upper and lower vertices of the candle facets 34A is generally larger than the distance between the upper and lower vertices of either the candle facets 34B or the candle facets 34C. However, the distance between the upper and lower vertices of the candle facets 34D is generally larger than the distance between the upper and lower vertices of the candle facets 34A. In some implementations, the upper and lower vertices of any of the candle facets 34A-34D are shifted relative to each other. In these implementations, for any shifted candle facet of the candle facets 34A-34D, the angle bisectors of the upper vertex and the lower vertex are not coincident. Thus, the shapes of the candle facets 34A-34D can vary depending on their location along the pavilion 30. However, in other implementations, any one of the groups of candle facets 34A-34D can have the same size and shape as any of the other groups of candle facets 34A-34D.

Figure 4A:
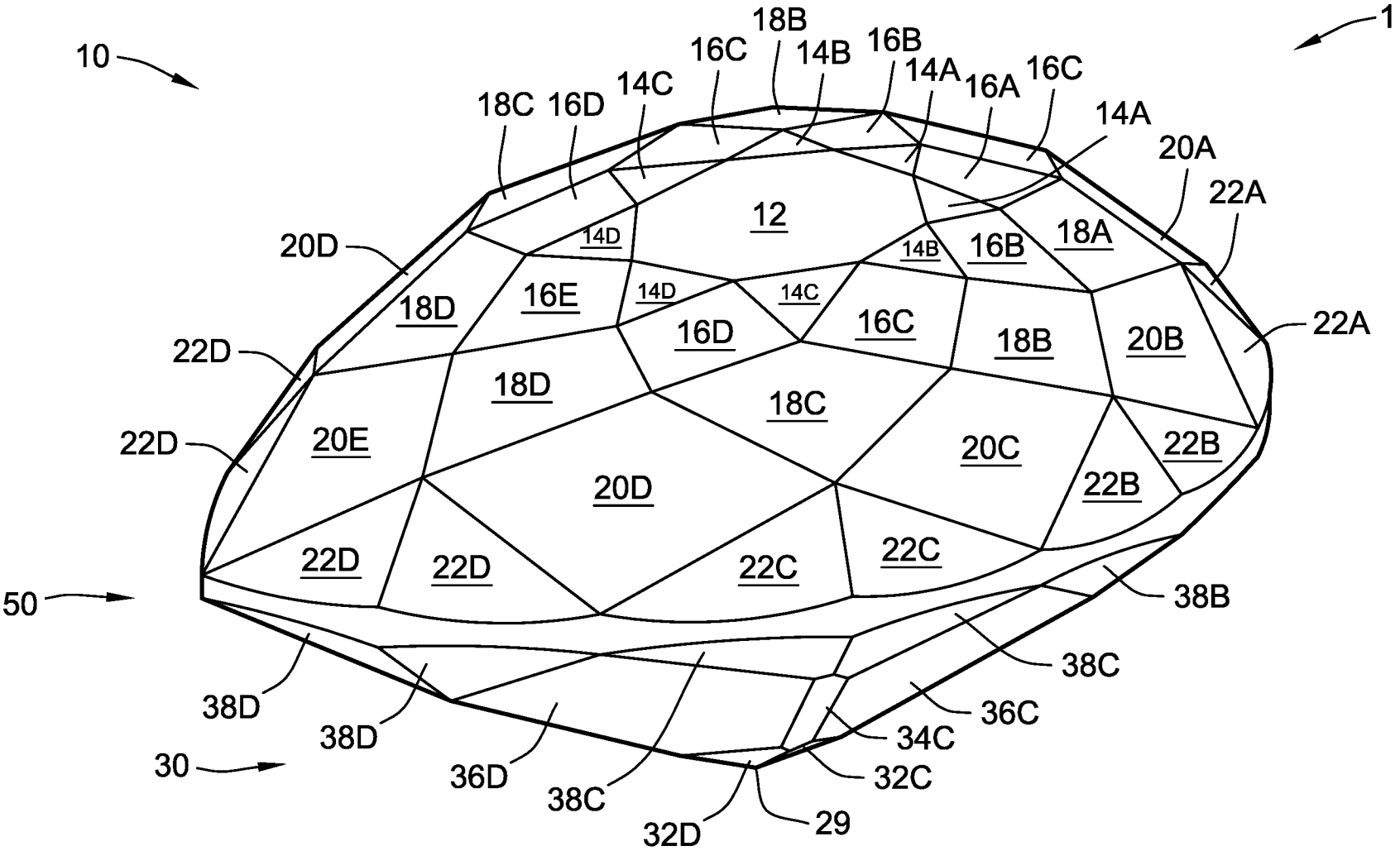
FIG. 4A is a perspective view of the gemstone of FIGS. 1A and 1B viewed at a downward angle, according to some implementations of the present disclosure.
Figure 4B:
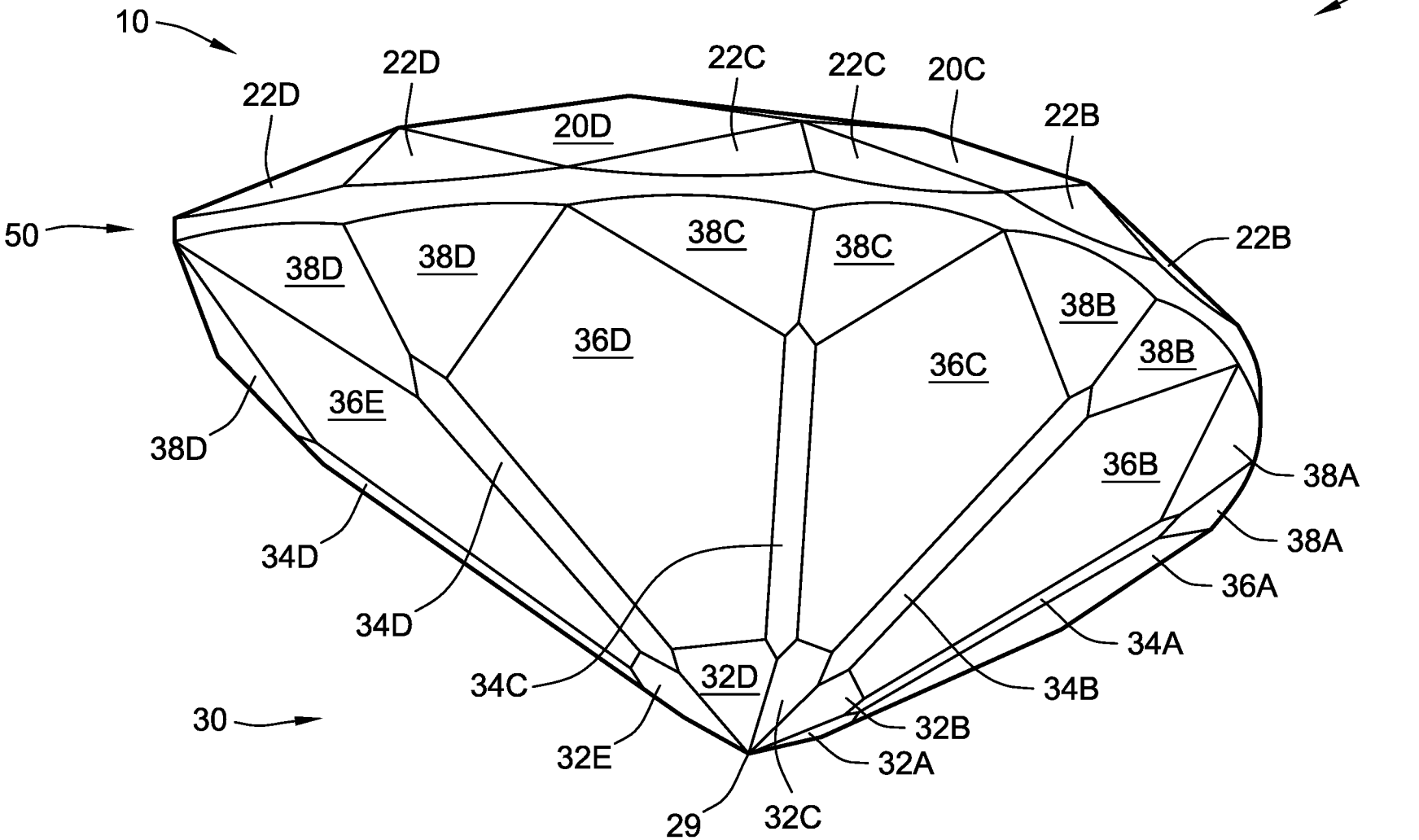
FIG. 4B is a perspective view of the gemstone of FIGS. 1A and 1B viewed at an upward angle, according to some implementations of the present disclosure.

FIG. 4A illustrates a perspective view of gemstone 1 at a downward angle, while FIG. 4B illustrates a perspective view of gemstone 1 at an upward angle. These figures show the table 12, the star facets 14A-14D, the upper intermediate crown facets 16A-16E, the lower intermediate crown facets 18A-18D, The main crown facets 20A-20E, the upper girdle facets 22A-22D, the culet-adjacent facets 32A-32E, the candle facets 34A-34D, the main pavilion facets 36A-36E, the lower girdle facets 38A-38D, and the girdle 50.

Referring now to FIGS. 5A-5E, the steps for forming the crown of the gemstone are illustrated. As used in relation to FIGS. 5A-5E, the major axis $A_1$ and the minor axis $A_2$ have the same orientations relative to the gemstone as gemstone 1 in FIGS. 2 and 3, but are not shown. Thus, in FIGS. 5A-5E, the major axis $A_1$ extends vertically relative to the plane of the figures, while the minor axis $A_2$ extends horizontally relative to the plane of the figures. Generally, the gemstone may be formed from an uncut sample, which can have any shape.

Figure 5B:
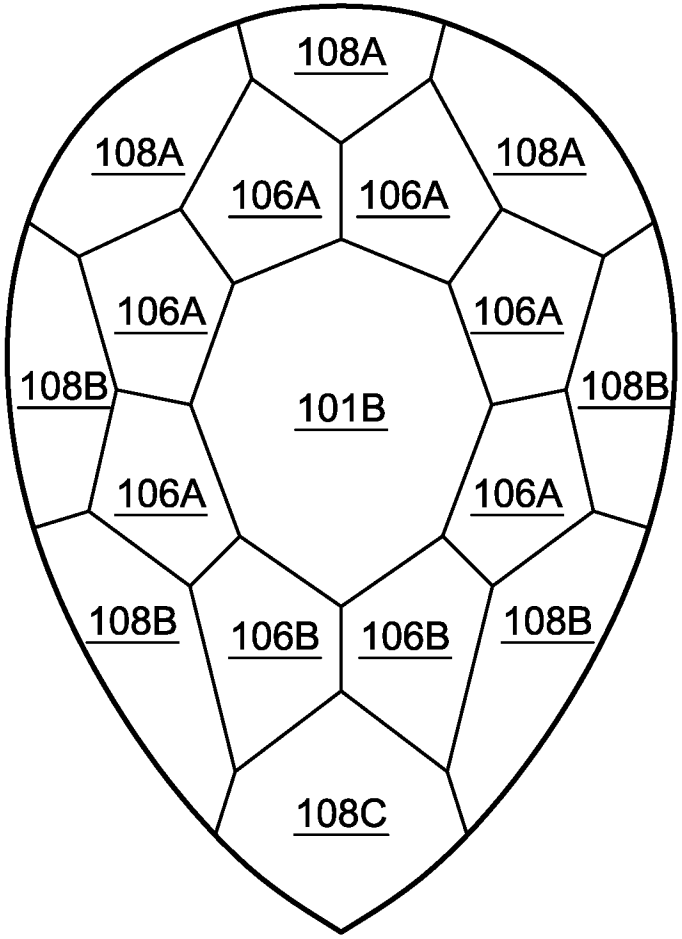
FIG. 5B illustrates a second step of the method of forming the crown of the gemstone of FIGS. 1A and 1B, according to some implementations of the present disclosure.
Figure 5A:
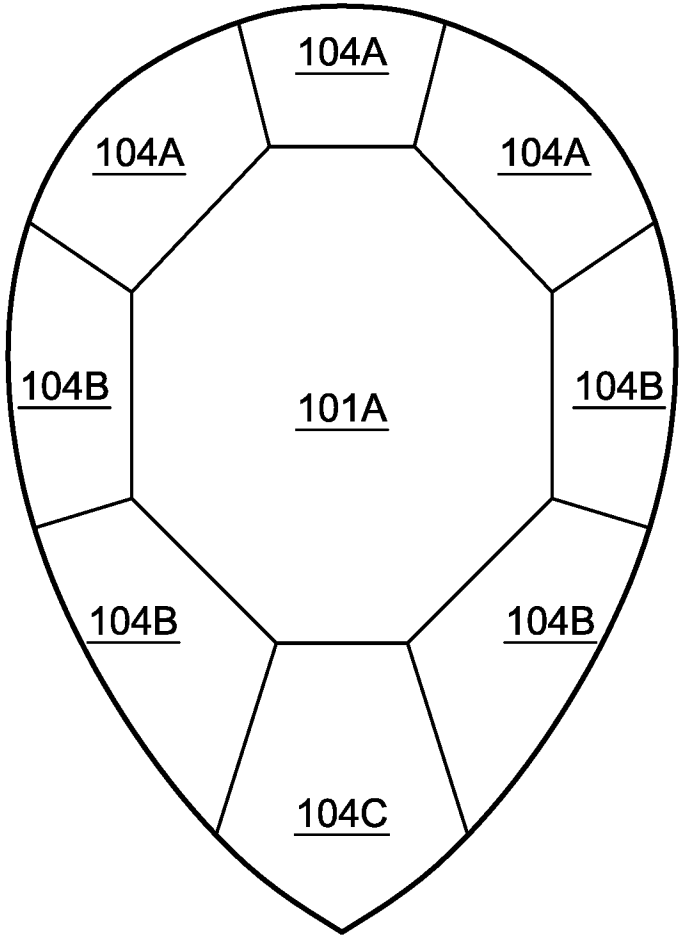
FIG. 5A illustrates a first step of a method of forming a crown of the gemstone of FIGS. 1A and 1B, according to some implementations of the present disclosure.

As shown in FIG. 5A, the first step includes forming a first preliminary table 101A and a first set of crown facets 104A, 104B, and 104C. The first set of crown facets 104A-104C forms a first temporary set of crown facets. Generally, the width of the first preliminary table 101A is formed to be larger than the width of the table 12 of the final gemstone, and thus can be between about 21.0% and about 51.0% of the width of the gemstone. However, the first preliminary table 101A can be formed with a larger width as well.

Portions of the facets of the first set of crown facets 104A will form the main crown facets 20A and 20B of the final gemstone. Thus, the facets of the first set of crown facets 104A can be formed at the desired angle of the main crown facets 20A and 20B, such as between about 42° and about 48°, between about 40° and about 50°, between about 35° and about 55°, or about 45°. Portions of the facets of the first set of crown facets 104B will form the main crown facets 20C and 20D of the final gemstone. Thus, the facets of the first set of crown facets 104B can be formed at the desired angle of the main crown facets 20C and 20D, such as between about 44° and about 48°, between about 40° and about 50°, between about 35° and about 55°, or of about 45°. Portions of the facets of the first set of crown facets 104C will form the main crown facet 20E of the final gemstone.

Thus, the facets of the first set of crown facets 104C can be formed at the desired angle of the main crown facet 20E, such as between about 25° and about 35°, between about 20° and about 40°, between about 15° and about 45°, or of about 30°.

The angle of the first set of crown facets 104A-104C and the angles of subsequent crown facets formed in subsequent steps are measured relative to the horizontal plane that is defined by the first preliminary table 101A, similar to how the angles of the facets of the completed crown were measured in FIGS. 1A and 1B. After this step, the crown of the gemstone includes the first preliminary table 101A and the first set of crown facets 104A-104C.

The next step is shown in FIG. 5B. Here, a second set of crown facets 106A and 106B is formed on the crown of the gemstone. The second set of crown facets 106A and 106B forms a second temporary set of crown facets. The second set of crown facets 106A and 106B is formed by carving a pentagonal surface out of portions of the first preliminary table 102A, and the first set of crown facets 104A-104C.

Portions of the facets of the second set of crown facets 106A will form the lower intermediate crown facets 18A, 18B, and 18C of the final gemstone. Thus, the facets of the second set of crown facets 106A can be formed at the desired angle of the lower intermediate crown facets 18A, 18B, and 18C, such as between about 25° and about 35°, between about 15° and about 40°, between about 29° and about 32°, or about 30°. Portions of the facets of the second set of crown facets 106B will form the lower intermediate crown facets 18D of the final gemstone. Thus, the facets of the second set of crown facets 106B can be formed at the desired angle of the lower intermediate crown facets 18D, such as between about 18° and about 28°, between about 15° and about 40°, between about 20° and about 25°, or about 23°.

The gemstone after this step is thus left with a second preliminary table 101B, the second set of crown facets 106A and 106B, and a third set of crown facets 108A-108C (e.g., a third temporary set of crown facets). The second preliminary table 101B is formed from the remainder of the first preliminary table 101A, and is generally horizontal. The third set of crown facets 108A is formed from the remainder of the first set of crown facets 104A, and is formed at the same angle. The third set of crown facets 108B is formed from the remainder of the first set of crown facets 104B, and is formed at the same angle. The third set of crown facets 108C is formed from the remainder of the first set of crown facets 104C, and is formed at the same angle.

Figure 5D:
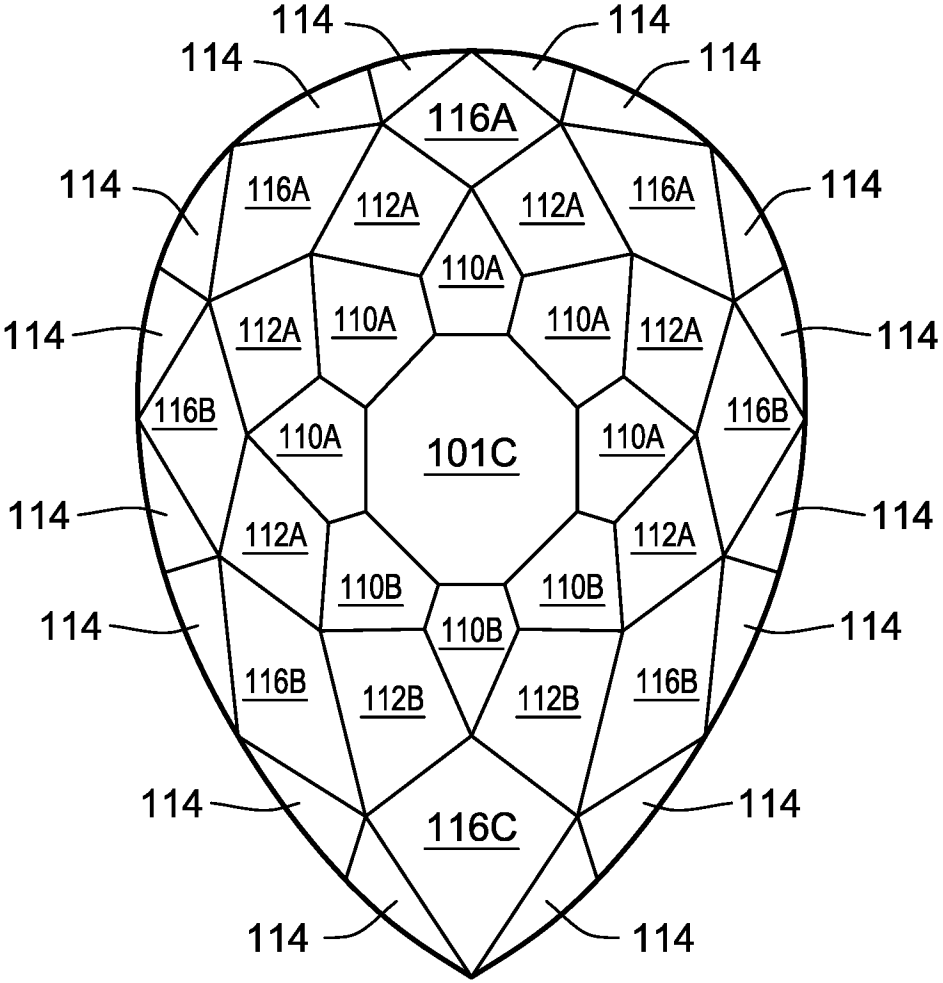
FIG. 5D illustrates a fourth step of the method of forming the crown of the gemstone of FIGS. 1A and 1B, according to some implementations of the present disclosure.
Figure 5C:
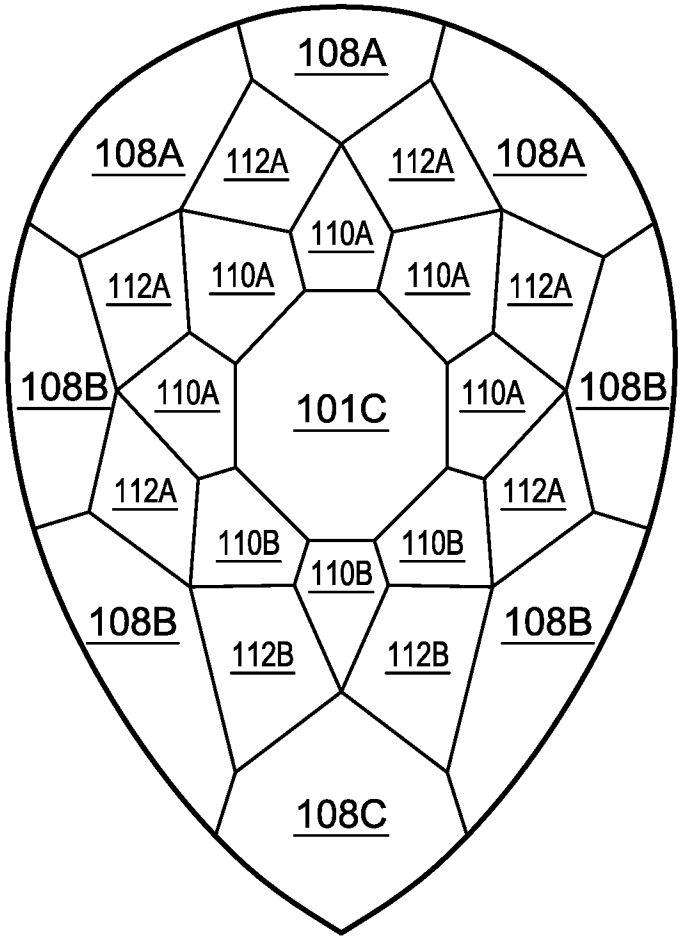
FIG. 5C illustrates a third step of the method of forming the crown of the gemstone of FIGS. 1A and 1B, according to some implementations of the present disclosure.

The next step is shown in FIG. 5C. Here, a fourth set of crown facets 110A and 110B is formed on the crown of the gemstone. The fourth crown facets 110A and 110B forms a fourth temporary set of crown facets. The fourth set of crown facets 110A and 110B is formed by carving out pentagonal-shaped portions from the second preliminary table 101B and the second set of crown facets 106A-106B.

Portions of the facets of the fourth set of crown facets 110A will form the upper intermediate crown facets 16A, 16B, and 16C of the final gemstone. Thus, the facets of the fourth set of crown facets 110A can be formed at the desired angle of the upper intermediate crown facets 16A, 16B, and 16C, such as between about 15° and about 24°, between about 8° and about 30°, between about 17° and about 21°, or about 19.5°. Portions of the facets of the fourth set of crown facets 110B will form the upper intermediate crown facets 16D of the final gemstone. Thus, the facets of the fourth set of crown facets 11BA can be formed at the desired angle of the upper intermediate crown facets 16D, such as between about 10° and about 18°, between about 5° and about 25°, or about 14°.

The gemstone after this step is left with a third preliminary table 101C, the third set of crown facets 108A-108C, the fourth set of crown facets 110A-110B, and a fifth set of crown facets 112A-112B (e.g., a first final set of crown facets). The third preliminary table 101C is formed from the remainder of the second preliminary table 101B. The fifth set of crown facets 112A is formed from the remainder of the second set of crown facets 106A, and is formed at the same angle. The fifth set of crown facets 112B is formed from the remainder of the second set of crown facets 106B, and is formed at the same angle. The fifth set of crown facets 112A corresponds to the lower intermediate crown facets 18A, 18B, and 18C of the final gemstone. The fifth set of crown facets 112B corresponds to the lower intermediate crown facets 18C of the final gemstone.

The next step is shown in FIG. 5D. Here, a sixth set of crown facets 114 is formed on the crown of the gemstone. The sixth set of crown facets 114 forms a second final set of crown facets. The sixth set of crown facets 114 is formed by carving out triangular-shaped portions from the third set of crown facets 108A-108C. The sixth set of crown facets 114 corresponds to the upper girdle facets 22A-22D of the final gemstone. Thus, the facets of the sixth set of crown facets 114 can be formed at the desired angle of the upper girdle facets 22A-22D, such as between about 46° and about 58°, between about 40° and about 60°, between about 50° and about 54°, or about 52°.

The gemstone after this step is left with a third preliminary table 101C, the fourth set of crown facets 110A-110B, the fifth set of crown facets 112A-112B, the sixth set of crown facets 114, and a seventh set of crown facets 116A-116C (e.g., a third final set of crown facets). The seventh set of crown facets 116A is formed from the remainder of the third set of crown facets 108A, and is formed at the same angle. The seventh set of crown facets 116B is formed from the remainder of the third set of crown facets 108B, and is formed at the same angle. The seventh set of crown facets 116C is formed from the remainder of the third set of crown facets 108C, and is formed at the same angle. The seventh set of crown facets 116A corresponds to the main crown facets 20A and 20B of the final gemstone. The seventh set of crown facets 116B corresponds to the main crown facets 20C and 20D of the final gemstone. The seventh set of crown facets 116C corresponds to the main crown facet 20E of the final gemstone.

Figure 5E:
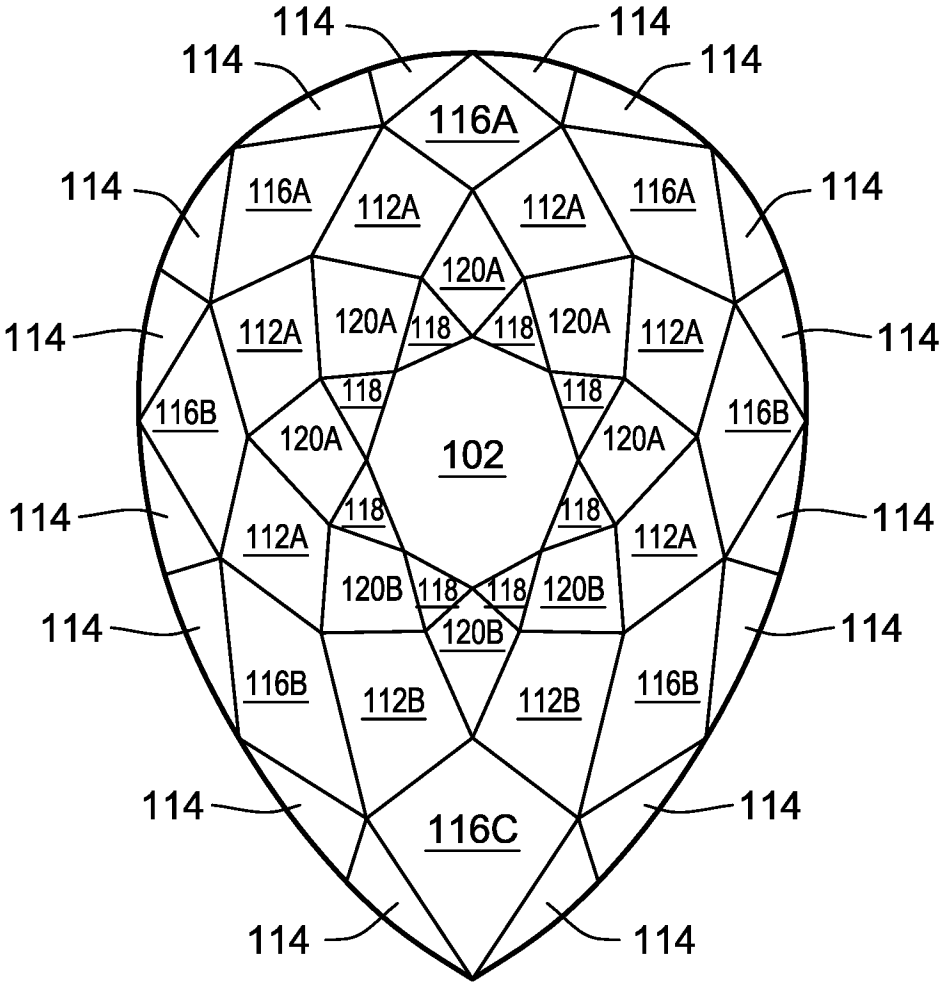
FIG. 5E illustrates a fifth step of the method of forming the crown of the gemstone of FIGS. 1A and 1B, according to some implementations of the present disclosure.

The final step is shown in FIG. 5E. Here, an eighth set of crown facets 118 is formed on the crown of the gemstone. The eighth set of crown facets 118 forms a fourth final set of crown facets. The eighth set of crown facets 118 is formed by carving out triangular-shaped portions from the third preliminary table 101C and the fourth set of crown facets 110A and 110B. The eighth set of crown facets 118 corresponds to the star facets 14A-14D of the final gemstone. Thus, the facets of the eighth set of crown facets 118 can be formed at the desired angle of the star facets 14A-14D, such as between about 8° and about 18°, between about 3° and about 20°, or about 13°.

The gemstone after this step is left with a final table 102, the fifth set of crown facets 112A-112B, the sixth set of crown facets 114, the seventh set of crown facets 116A-116C, the eighth set of crown facets 118, and a ninth set of crown facets 120A and 120B (e.g., a fifth final set of crown facets). The ninth set of crown facets 120A is formed from the remainder of the fourth set of crown facets 110A, and is formed at the same angle. The ninth set of crown facets 120B is formed from the remainder of the fourth set of crown facets 110B, and is formed at the same angle. The ninth set of crown facets 120A corresponds to the upper intermediate crown facets 16A, 16B, and 16C of the final gemstone. The ninth set of crown facets 120B corresponds to the upper intermediate crown facets 16D and 16E of the final gemstone.

As shown in FIG. 5E, the remaining set of facets on the crown (e.g., the first, second, third, fourth, and fifth final sets of crown facets) correspond to the facets on the finished crown in FIGS. 1A, 1B, and 2. The fifth set of crown facets 112A and 112B corresponds to the lower intermediate crown facets. The sixth set of crown facets 114 corresponds to the upper girdle facets. The seventh set of crown facets 116A-116C corresponds to the main crown facets 20A-20E. The eighth set of crown facets 118 corresponds to the star facets. The ninth set of crown facets 120A and 120B corresponds to the upper intermediate crown facets 16A-16E.

Referring now to FIGS. 6A-6D, the steps for forming the pavilion of the gemstone are illustrated. As used in relation to FIGS. 6A-6E, the major axis $A_1$ and the minor axis $A_2$ have the same orientations relative to the gemstone as gemstone 1 in FIGS. 2 and 3, but are not shown. Thus, in FIGS. 6A-6D, the major axis $A_1$ extends vertically relative to the plane of the figures, while the minor axis $A_2$ extends horizontally relative to the plane of the figures.

Figure 6B:
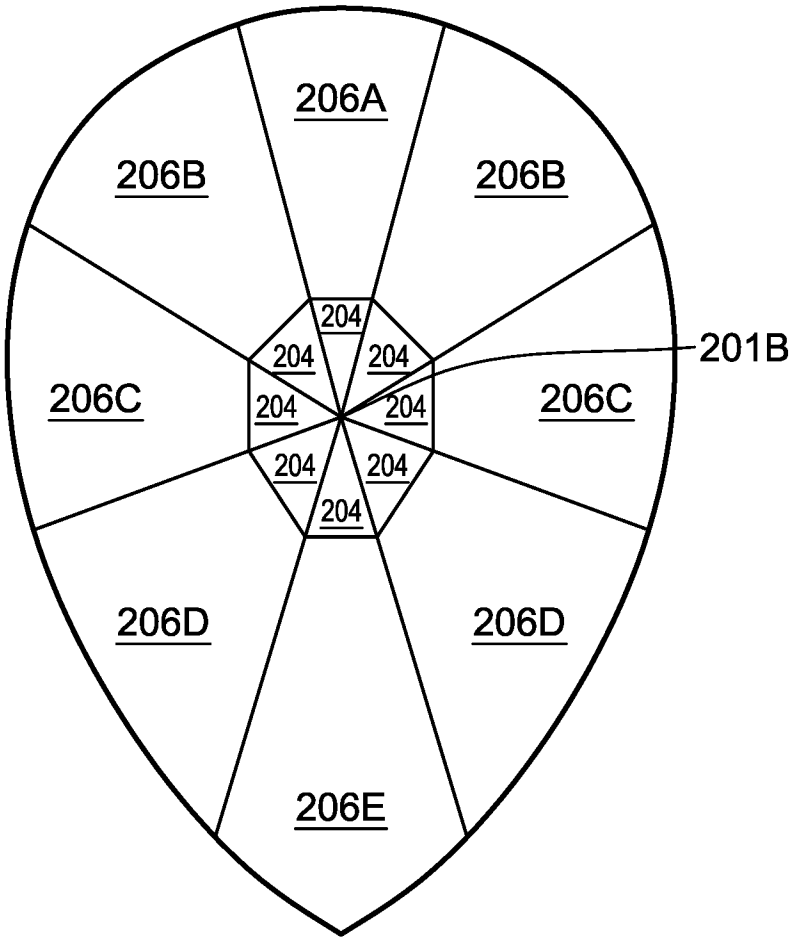
FIG. 6B illustrates a second step of the method of forming the pavilion of the gemstone of FIGS. 1A and 1B, according to some implementations of the present disclosure.
Figure 6A:
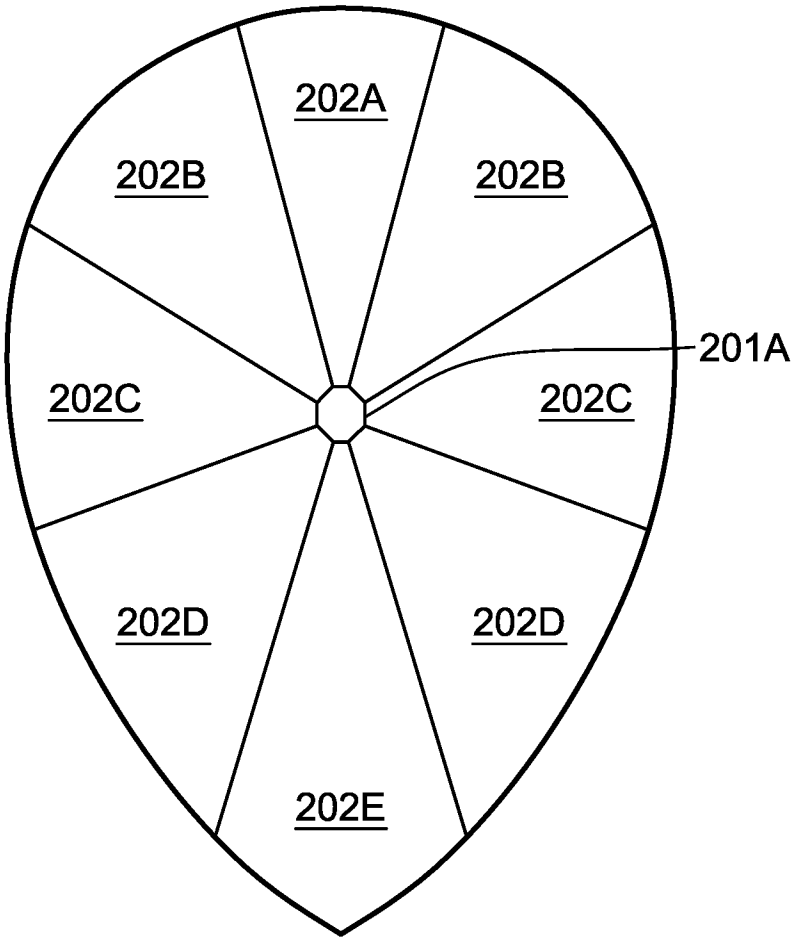
FIG. 6A illustrates a first step of a method of forming a pavilion of the gemstone of FIGS. 1A and 1B, according to some implementations of the present disclosure.

As shown in FIG. 6A, the first step includes forming a first set of pavilion facets 202A-202E by carving out generally triangular portions from the surface of the pavilion. The first set of pavilion facets 202A-202E forms a first temporary set of pavilion facets. In the illustrated implementation, the first set of pavilion facets 202A-202E form a flat lower facet 201A called a culet, which is generally located in the center of the pavilion. The culet 201A can remain or be further carved or formed in subsequent steps, depending on the design of the gemstone. In other implementations, forming the first set of pavilion facets 202A-202E forms a lower point.

Portions of the facets of the first set of pavilion facets 202A will form the main pavilion facets 36A of the final gemstone. Thus, the facets of the first set of pavilion facets 202A can be formed at the desired angle of the main pavilion facets 36A, such as between about 32° and about 40°, between about 25° and about 50°, between about 34° and about 38°, or about 36°. Portions of the facets of the first set of pavilion facets 202B will form the main pavilion facets 36B of the final gemstone. Thus, the facets of the first set of pavilion facets 202B can be formed at the desired angle of the main pavilion facets 36B, such as between about 37° and about 44°, between about 35° and about 45°, between about 30° and about 50°, or about 40.5°. Portions of the facets of the first set of pavilion facets 202C will form the main pavilion facets 36C of the final gemstone. Thus, the facets of the first set of pavilion facets 202C can be formed at the desired angle of the main pavilion facets 36C, such as between about 44° and about 48°, between about 40° and about 50°, between about 35° and about 55°, or about 46°. Portions of the facets of the first set of pavilion facets 202D will form the main pavilion facets 36D of the final gemstone. Thus, the facets of the first set of pavilion facets 202D can be formed at the desired angle of the main pavilion facets 36D, such as between about 42° and about 47°, between about 40° and about 50°, between about 35° and about 55°, or about 46°. Portions of the facets of the first set of pavilion facets 202E will form the main pavilion facets 36E of the final gemstone. Thus, the facets of the first set of pavilion facets 202E can be formed at the desired angle of the main pavilion facets 36E, such as between about 28° and about 35°, between about 25° and about 40°, between about 20° and about 45°, or about 31.5°.

The angle of the first set of pavilion facets 202A-202E, and the angles of subsequent pavilion facets formed in subsequent steps are measured relative to the horizontal plane that is defined by the preliminary tables 101A, 101B, and 101C, as well as the final table 102 (shown in FIGS. 5A-5E), similar to how the angles of the facets of the completed pavilion were measured in FIGS. 1A and 1B. After this step, the pavilion of the gemstone includes the first set of pavilion facets 202A-202E.

As shown in FIG. 6B, the second step includes forming a second set of pavilion facets 204 by carving triangular-shaped portions from the first set of pavilion facets 202A-202E and the culet 201A. The second set of pavilion facets 204 forms a second temporary set of pavilion facets. As shown, the second set of pavilion facets 204 form a lower point 201B, which remains as part of the pavilion in the steps shown in FIG. 6C and FIG. 6D.

Portions of the facets of the second set of pavilion facets 204 will form the culet-adjacent facets 32A-32E of the final gemstone. Thus, the facets of the second set of pavilion facets 204 can be formed at the desired angle of the culet-adjacent facets 32A-32E, such as between about 36.5° and about 40°, between about 30° and about 45°, between about 25° and about 50°, or about 38.5°.

The gemstone after this step is thus left with the second set of pavilion facets 204, and a third set of pavilion facets 206A-206E (e.g., a third temporary set of pavilion facets). The third set of pavilion facets 206A is formed from the remainder of the first set of pavilion facets 202A, and is formed at the same angle. The third set of pavilion facets 206B is formed from the remainder of the first set of pavilion facets 202B, and is formed at the same angle. The third set of pavilion facets 206C is formed from the remainder of the first set of pavilion facets 202C, and is formed at the same angle. The third set of pavilion facets 206D is formed from the remainder of the first set of pavilion facets 202D, and is formed at the same angle. The third set of pavilion facets 206E is formed from the remainder of the first set of pavilion facets 202E, and is formed at the same angle.

Figure 6D:
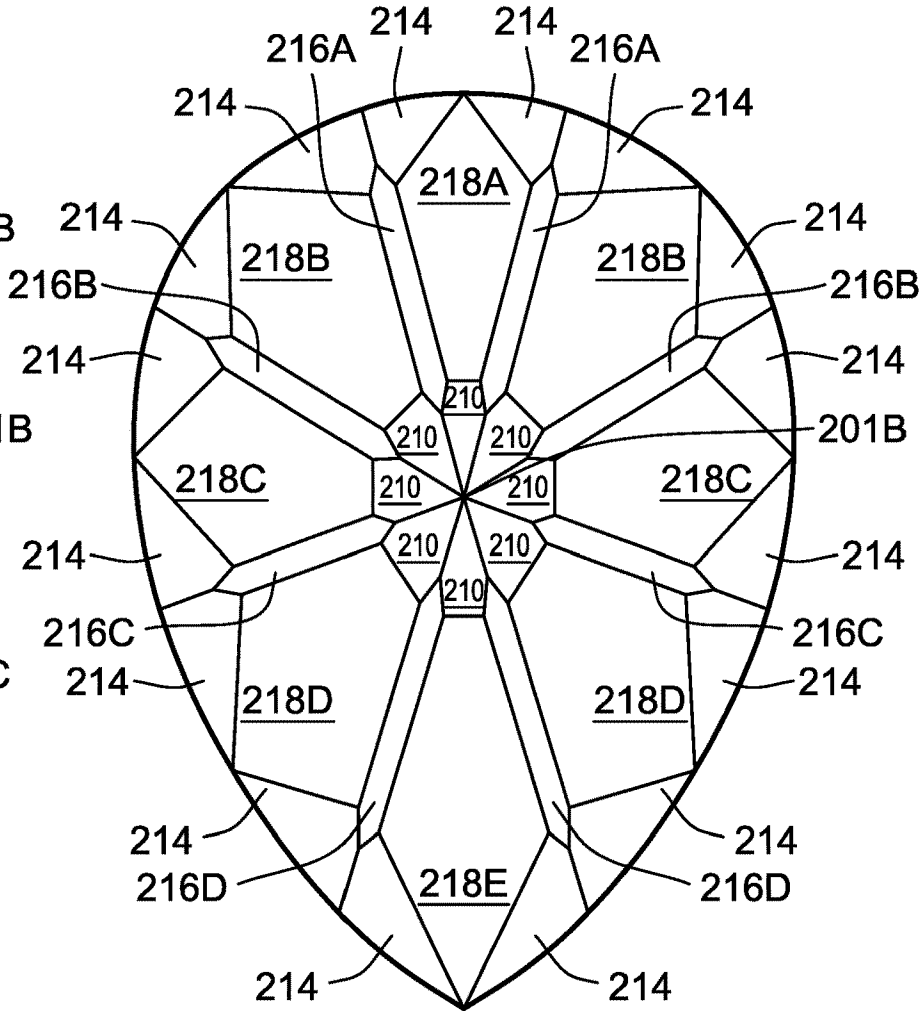
FIG. 6D illustrates a fourth step of the method of forming the pavilion of the gemstone of FIGS. 1A and 1B, according to some implementations of the present disclosure.
Figure 6C:
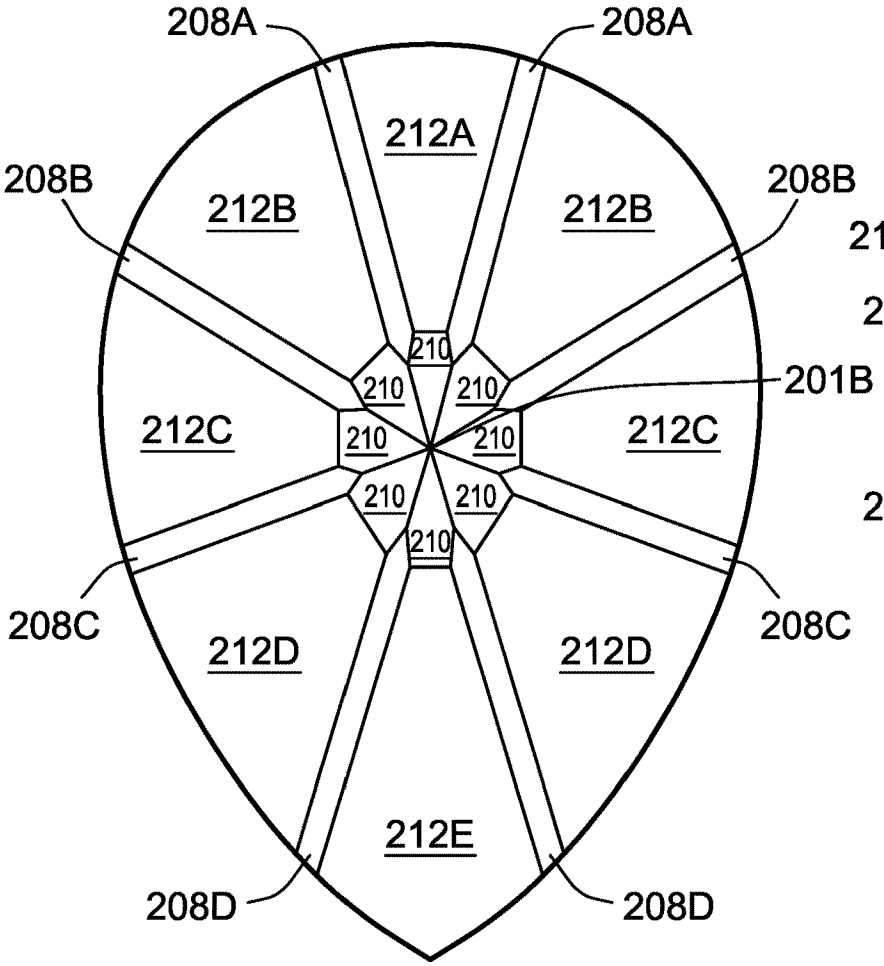
FIG. 6C illustrates a third step of the method of forming the pavilion of the gemstone of FIGS. 1A and 1B, according to some implementations of the present disclosure.

As shown in FIG. 6C, the third step includes forming a fourth set of pavilion facets 208A-208D by carving portions from the second set of pavilion facets 204 and the third set of pavilion facets 206A-206E. The carved-out portions are generally rectangular with a pointed lower end. The fourth set of pavilion facets 208A-208D forms a fourth temporary set of pavilion facets. The fourth set of pavilion facets 208A is formed from portions of the second set of pavilion facets 204, the third set of pavilion facets 206A, and the third set of pavilion facets 206B. The fourth set of pavilion facets 208B is formed from portions of the second set of pavilion facets 204, the third set of pavilion facets 206B, and the third set of pavilion facets 206C. The fourth set of pavilion facets 208C is formed from portions of the second set of pavilion facets 204, the third set of pavilion facets 206C, and the third set of pavilion facets 206D. The fourth set of pavilion facets 208D is formed from portions of the second set of pavilion facets 204, the third set of pavilion facets 206D, and the third set of pavilion facets 206E.

Portions of the facets of the fourth set of pavilion facets 208A will form the candle facets 34A of the final gemstone. Thus, the facets of the fourth set of pavilion facets 208A can be formed at the desired angle of the candle facets 34A, such as between about 33° and about 40°, between about 30° and about 45°, between about 35° and about 50°, or about 36.5°. Portions of the facets of the fourth set of pavilion facets 208B will form the candle facets 34B of the final gemstone. Thus, the facets of the fourth set of pavilion facets 208B can be formed at the desired angle of the candle facets 34B, such as between about 36° and about 42°, between about 35° and about 45°, between about 30° and about 50°, or about 39°. Portions of the facets of the fourth set of pavilion facets 208C will form the candle facets 34C of the final gemstone. Thus, the facets of the fourth set of pavilion facets 208C can be formed at the desired angle of the candle facets 34C, such as between about 40° and about 44°, between about 35° and about 50°, between about 30° and about 55°, or about 37.5°. Portions of the facets of the fourth set of pavilion facets 208D will form the candle facets 34D of the final gemstone. Thus, the facets of the fourth set of pavilion facets 208D can be formed at the desired angle of the candle facets 34D, such as between about 28° and about 35°, between about 25° and about 40°, between about 20° and about 45°, or about 31.5°.

The gemstone after this step is thus left with the fourth set of pavilion facets 208A-208D, a fifth set of pavilion facets 210 (e.g., a first final set of pavilion facets), and a sixth set of pavilion facets 212A-212E (e.g., a fifth temporary set of pavilion facets). The fifth set of pavilion facets 210 is formed from the remainder of the second set of pavilion facets 204, and is thus formed at the same angle. The fifth set of pavilion facets 210 corresponds to the culet-adjacent facets 32A-32E of the final gemstone.

The sixth set of pavilion facets 212A is formed from the remainder of the third set of pavilion facets 206A, and is formed at the same angle. The sixth set of pavilion facets 212B is formed from the remainder of the third set of pavilion facets 206B, and is formed at the same angle. The sixth set of pavilion facets 212C is formed from the remainder of the third set of pavilion facets 206C, and is formed at the same angle. The sixth set of pavilion facets 212D is formed from the remainder of the third set of pavilion facets 206D, and is formed at the same angle. The sixth set of pavilion facets 212E is formed from the remainder of the third set of pavilion facets 206E, and is formed at the same angle.

As shown in FIG. 6D, the final step includes forming a seventh set of pavilion facets 214 by carving portions from the fourth set of pavilion facets 208A-208D and the sixth set of pavilion facets 212A-212E. The seventh set of pavilion facets 214 forms a second final set of pavilion facets. The seventh set of pavilion facets 214 corresponds to the lower girdle facets 38A-38D of the final gemstone. Thus, the facets of the seventh set of pavilion facets 214 can be formed at the desired angle of the lower girdle facets 38A-38D, such as between about 42° and about 54°, between about 40° and about 55°, between about 35° and about 60°, between about 45° and about 50°, or about 13°.

The gemstone after this step is thus left with the fifth set of pavilion facets 210, the seventh set of pavilion facets 214, an eighth set of pavilion facets 216A-216D (e.g., a third final set of pavilion facets), and a ninth set of pavilion facets 218 (e.g., a fourth final set of pavilion facets).

The eighth set of pavilion facets 216A is formed from the remainder of the fourth set of pavilion facets 208A, and is formed at the same angle. The eighth set of pavilion facets corresponds to the candle facets 34A of the final gemstone. The eighth set of pavilion facets 216B is formed from the remainder of the fourth set of pavilion facets 208B, and is formed at the same angle. The eighth set of pavilion facets corresponds to the candle facets 34B of the final gemstone. The eighth set of pavilion facets 216C is formed from the remainder of the fourth set of pavilion facets 208C, and is formed at the same angle. The eighth set of pavilion facets corresponds to the candle facets 34C of the final gemstone. The eighth set of pavilion facets 216D is formed from the remainder of the fourth set of pavilion facets 208D, and is formed at the same angle. The eighth set of pavilion facets corresponds to the candle facets 34D of the final gemstone.

The ninth set of pavilion facets 218A is formed from the remainder of the sixth set of pavilion facets 212A, and is formed at the same angle. The ninth set of pavilion facets 218A corresponds to the main pavilion facets 36A of the final gemstone. The ninth set of pavilion facets 218B is formed from the remainder of the sixth set of pavilion facets 212B, and is formed at the same angle. The ninth set of pavilion facets 218B corresponds to the main pavilion facets 36B of the final gemstone. The ninth set of pavilion facets 218C is formed from the remainder of the sixth set of pavilion facets 212C, and is formed at the same angle. The ninth set of pavilion facets 218C corresponds to the main pavilion facets 36C of the final gemstone. The ninth set of pavilion facets 218D is formed from the remainder of the sixth set of pavilion facets 212D, and is formed at the same angle. The ninth set of pavilion facets 218D corresponds to the main pavilion facets 36D of the final gemstone. The ninth set of pavilion facets 218E is formed from the remainder of the sixth set of pavilion facets 212E, and is formed at the same angle. The ninth set of pavilion facets 218E corresponds to the main pavilion facets 36E of the final gemstone As shown in FIG. 6D, the remaining set of facets on the pavilion (e.g., the first, second, third, and fourth final sets of pavilion facets) correspond to the facets on the finished pavilion in FIGS. 1A, 1B, and 3. The fifth set of pavilion facets 210 corresponds to the culet-adjacent facets. The seventh set of pavilion facets 214 corresponds to the lower girdle facets. The eighth set of pavilion facets 216 corresponds to the candle facets. The ninth set of pavilion facets 218 corresponds to the main pavilion facets.

Thus, a gemstone having a crown, a girdle, and a pavilion are thus formed. The crown and the pavilion comprise a number of sets of interlocking facets that share edges and vertices on the surface of the gemstone. Each of the sets of interlocking facets is disposed at a specific angle. The shape of the facets, the organization of the facets, and the angles that the facets are formed at on the surface of the gemstone result in a gemstone having an improved brilliance. The brilliance refers to the amount of light that enters the gemstone, and is internally reflected such that it exits out of the crown of the gemstone. The facets according to aspects of the present disclosure increase the amount of light reflecting off of the internal surfaces of the facets, thus increasing the brilliance of the gemstone.

One or more elements or aspects or steps, or any portion(s) thereof, from one or more of any of claims 1-20 below can be combined with one or more elements or aspects or steps, or any portion(s) thereof, from one or more of any of the other claims 1-20 or combinations thereof, to form one or more additional implementations and/or claims of the present disclosure.

While the present disclosure has been described with reference to one or more particular implementations, those skilled in the art will recognize that many changes may be made thereto without departing from the spirit and scope of the present disclosure. Each of these implementations and obvious variations thereof is contemplated as falling within the spirit and scope of the present disclosure. It is also contemplated that additional implementations according to aspects of the present disclosure may combine any number of features from any of the implementations described herein, such as, for example, in the alternative implementations described below.

ALTERNATIVE IMPLEMENTATIONS

Alternative Implementation 1. A gemstone comprising: a girdle defining a perimeter of the gemstone, the girdle having a pear-shaped cross-section, the pear-shaped cross section being an oval shape with a first rounded end and a second tapered end opposing the first rounded end, the second tapered end being narrower than the first rounded end; a crown forming an upper portion of the gemstone, a surface of the crown including: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed generally between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed generally between two of the plurality of lower intermediate crown facets, an upper vertex of each of the plurality of main crown facets abutting a lower vertex of one of the plurality of lower intermediate crown facets; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets; and a pavilion forming a lower portion of the gemstone, a surface of the pavilion including: a plurality of culet-adjacent facets forming a lower point of the pavilion; a plurality of candle facets, a lower portion of each of the plurality of candle facets being disposed generally between two of the plurality of culet-adjacent facets; a plurality of main pavilion facets, each of the main pavilion facets being disposed between two of the plurality of candle facets, a lower edge of each of the plurality of main pavilion facets abutting an upper edge of one of the plurality of culet-adjacent facets; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween; and wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle.

Alternative Implementation 2. The gemstone of Alternative Implementation 1, wherein the gemstone has a table percentage between about 27% and about 40%.

Alternative Implementation 3. The gemstone of Alternative Implementation 1, wherein the gemstone has a top depth percentage between about 22% and about 29%.

Alternative Implementation 4. The gemstone of Alternative Implementation 1, wherein the gemstone has a bottom depth percentage between about 45% to about 52%.

Alternative Implementation 5. The gemstone of Alternative Implementation 1, wherein the gemstone has a total depth percentage between about 75% and about 88%.

Alternative Implementation 6. The gemstone of Alternative Implementation 1, wherein the gemstone has a girdle thickness percentage between about 3.5% and about 6.5%.

Alternative Implementation 7. The gemstone of Alternative Implementation 1, wherein a horizontal plane is defined by the table of the gemstone, and wherein each of the plurality of star facets is disposed at a first angle relative to the horizontal plane, each of the plurality of upper intermediate crown facets is disposed at a second angle relative to the horizontal plane, each of the plurality of lower intermediate crown facets is disposed at a third angle relative to the horizontal plane, each of the plurality of main crown facets is disposed at a fourth angle relative to the horizontal plane, and each of the plurality of upper girdle facets is disposed at a fifth angle relative to the horizontal plane.

Alternative Implementation 8. The gemstone of Alternative Implementation 7, wherein first angle is between about 8° and about 18°.

Alternative Implementation 9. The gemstone of Alternative Implementation 7, wherein the second angle is between about 10° and about 24°.

Alternative Implementation 10. The gemstone of Alternative Implementation 9, wherein the plurality of upper intermediate crown facets includes a first set of upper intermediate crown facets disposed at an angle of between about 15° and about 24°, and a second set of upper intermediate crown facets disposed at an angle of between about 10° and about 18°.

Alternative Implementation 11. The gemstone of Alternative Implementation 7, wherein the third angle is between about 18° and about 35°.

Alternative Implementation 12. The gemstone of Alternative Implementation 11, wherein the plurality of lower intermediate crown facets includes a first set of lower intermediate crown facets disposed at an angle of between about 25° and about 35°, and a second set of lower intermediate crown facets disposed at an angle of between about 18° and about 28°.

Alternative Implementation 13. The gemstone of Alternative Implementation 7, wherein the fourth angle is between about 42° and about 48° or between about 25° and about 35°.

Alternative Implementation 14. The gemstone of Alternative Implementation 13, wherein the plurality of main crown facets includes a first set of main crown facets disposed at an angle of between about 42° and about 48°, a second set of main crown facets disposed at an angle of between about 44° and about 48°, and a third set of main crown facets disposed at an angle of about 25° and about 35°.

Alternative Implementation 15. The gemstone of Alternative Implementation 7, wherein the fifth angle is between about 46° and about 58°.

Alternative Implementation 16. The gemstone of Alternative Implementation 1, wherein a horizontal plane is defined by the table of the gemstone, and wherein each of plurality of culet-adjacent facets is disposed at a first angle relative to the horizontal plane, each of plurality of candle facets is disposed at a second angle relative to the horizontal plane, each of plurality of main pavilion facets is disposed at a third angle relative to the horizontal plane, and each of the plurality of lower girdle facets is disposed at a fourth angle relative to the horizontal plane.

Alternative Implementation 17. The gemstone of Alternative Implementation 16, wherein the first angle is between about 36.5° and about 40.0°.

Alternative Implementation 18. The gemstone of Alternative Implementation 16, wherein second angle is between about 28° and about 45°.

Alternative Implementation 19. The gemstone of Alternative Implementation 18, wherein the plurality of candle facets includes a first set of candle facets disposed at an angle of between about 33° and about 40°, a second set of candle facets disposed at an angle of between about 36° and about 42°, a third set of candle facets disposed at an angle of between about 40° and about 45°, and a fourth set of candle facets disposed at an angle of between about 28° and about 35°.

Alternative Implementation 20. The gemstone of Alternative Implementation 16, wherein the third angle is between about 28° and about 48°.

Alternative Implementation 21. The gemstone of Alternative Implementation 20, wherein the plurality of main crown facets includes a first set of main crown facets disposed at an angle of between about 32° and about 40°, a second set of main crown facets disposed at an angle of between about 37° and about 44°, a third set of main crown facets disposed at an angle of between about 44° and about 48°, a fourth set of main crown facets disposed at an angle of between about 42° and about 47°, and a fifth set of main crown facets disposed at an angle of between about 28° and about 35°.

Alternative Implementation 22. The gemstone of Alternative Implementation 16, wherein the fourth angle is between about 42° and about 54°.

Alternative Implementation 23. The gemstone of Alternative Implementation 1, wherein the second tapered end of the cross-section of the gemstone terminates in a point.

Alternative Implementation 24. The gemstone of Alternative Implementation 1, wherein the pear-shaped cross section is symmetric across a first axis an extending between the first rounded end and the second tapered end, and wherein the pear-shaped cross-section is asymmetric across a second axis that is perpendicular to the first axis.

Alternative Implementation 25. The gemstone of Alternative Implementation 1, wherein the table has a generally octagonal shape, each of the plurality of star facets is triangle-shaped, each of the plurality of upper intermediate crown facets is kite-shaped, each of the plurality of lower intermediate crown facets is kite-shaped, each of the plurality of main crown faces is kite-shaped, and each of the plurality of upper girdle facets is triangle-shaped.

Alternative Implementation 26. The gemstone of Alternative Implementation 1, wherein each of the plurality of culet-adjacent facets is pentagon-shaped, each of the plurality of candle facets has six edges, each of the plurality of main pavilion facets is pentagon-shaped, and each of the plurality of lower girdle facet has four edges.

Alternative Implementation 27. A gemstone comprising: a girdle defining a perimeter of the gemstone, the girdle having a pear-shaped cross-section; and a crown forming an upper portion of the gemstone, a surface of the crown including: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed generally between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed generally between two of the plurality of lower intermediate crown facets, an upper vertex of each of the plurality of main crown facets abutting a lower vertex of one of the plurality of lower intermediate crown facets; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets.

Alternative Implementation 28. A gemstone comprising: a girdle defining a perimeter of the gemstone, the girdle having a pear-shaped cross-section; and a pavilion forming a lower portion of the gemstone, a surface of the pavilion including: a plurality of culet-adjacent facets forming a lower point of the pavilion; a plurality of candle facets, a lower portion of each of the plurality of candle facets being disposed generally between two of the plurality of culet-adjacent facets; a plurality of main pavilion facets, each of the main pavilion facets being disposed between two of the plurality of candle facets, a lower edge of each of the plurality of main pavilion facets abutting an upper edge of one of the plurality of culet-adjacent facets; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween.

Alternative Implementation 29. A gemstone comprising: a girdle defining a perimeter of the gemstone, the girdle having a pear-shaped cross-section; a crown forming an upper portion of the gemstone, a surface of the crown including: a table forming a generally horizontal upper surface of the crown, the table having a generally octagonal shape; a plurality of star facets disposed adjacent to the table, each of the plurality of star facets being triangle-shaped; a plurality of upper intermediate crown facets disposed adjacent to the plurality of star facets, each of the plurality of upper intermediate crown facets being kite-shaped; a plurality of lower intermediate crown facets disposed adjacent to the plurality of upper intermediate crown facets, each of the plurality of lower intermediate crown facets being kite-shaped; a plurality of main crown facets disposed adjacent to the plurality of lower intermediate crown facets, each of the plurality of main crown facets being kite-shaped; and a plurality of upper girdle facets disposed adjacent to the plurality of main crown facets, each of the plurality of upper girdle facets being triangle-shaped; and a pavilion forming a lower portion of the gemstone, a surface of the pavilion including: a plurality of culet-adjacent facets forming a lower point of the pavilion, each of the plurality of culet-adjacent facets having a generally pentagonal shape; a plurality of candle facets disposed adjacent to the plurality of culet-adjacent facets, each of the plurality of candle facets having six edges; a plurality of main pavilion facets, each of the main pavilion facets being disposed between two of the plurality of candle facets and having a generally pentagonal shape; and a plurality of lower girdle facets formed in pairs of adjacent lower girdle facets, each pair of adjacent lower girdle facets being disposed generally between two of the plurality of main pavilion facets, each lower girdle facet having four edges; and wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle.

Alternative Implementation 30. A gemstone comprising: a crown forming an upper portion of the gemstone; a pavilion forming a lower portion of the gemstone; and a girdle positioned between the crown and the pavilion and encircling the gemstone, the girdle having a pear-shaped cross-section with a first rounded end and a second tapered end narrower than the first rounded end, wherein the gemstone has a top depth percentage between about 22% and about 35%, and a bottom depth percentage between about 45% and about 52%.

Alternative Implementation 31. The gemstone of Alternative Implementation 30, wherein the gemstone has a total depth percentage between about 75% and about 88%.

Alternative Implementation 32. The gemstone of Alternative Implementation 30, wherein the gemstone has a table percentage between about 27% and about 40%.

Alternative Implementation 33. The gemstone of Alternative Implementation 30, wherein the gemstone has a girdle thickness percentage between about 3.5% and about 6.5%.

Alternative Implementation 34. A gemstone comprising: a crown forming an upper portion of the gemstone; a pavilion forming a lower portion of the gemstone; and a girdle positioned between the crown and the pavilion and encircling the gemstone, the girdle having a pear-shaped cross-section with a first rounded end and a second tapered end narrower than the rounded end, wherein the gemstone has a total depth percentage between about 75% and about 86%.

Alternative Implementation 35. A gemstone comprising: a crown forming an upper portion of the gemstone, a surface of the crown including a first plurality of facets, each of the first plurality of facets being disposed at an angle between about 8° and about 58° relative to an upper surface of the gemstone; a pavilion forming a lower portion of the gemstone, a surface of the pavilion including a second plurality of facets, each of the second plurality of facets being disposed at an angle between about 28° and about 54° relative to the upper surface of the gemstone; and a girdle positioned between the crown and the pavilion and encircling the gemstone, the girdle having a pear-shaped cross-section with a first rounded end and a second tapered end narrower than the rounded end.

Alternative Implementation 36. A method of forming a crown of a gemstone, comprising: forming a generally horizontal upper surface on an upper portion of the gemstone; forming a first temporary set of crown facets, the first temporary set of crown facets being formed at an angle of between about 42° and about 48° relative to the generally horizontal upper surface; forming a second temporary set of crown facets on the upper portion of the gemstone from portions of the generally horizontal upper surface and the first temporary set of crown facets, the second temporary set of crown facets being formed at an angle of between about 18° and about 35° relative to the generally horizontal upper surface, a remainder of the first temporary set of crown facets forming a third temporary set of crown facets; forming a fourth temporary set of crown facets on the upper portion of the gemstone from portions of the generally horizontal upper surface and the second temporary set of crown facets, the fourth temporary set of crown facets being formed at an angle of between about 15° and about 24° relative to the generally horizontal upper surface, a remainder of the second temporary set of crown facets forming a first final set of crown facets; forming a second final set of crown facets on the upper portion of the gemstone from portions of the third temporary set of crown facets, the second final set of crown facets being formed at an angle of between about 46° and about 58° relative to the generally horizontal upper surface, a remainder of the third temporary set of crown facets forming a third final set of crown facets; and forming a fourth final set of crown facets on the upper portion of the gemstone from portions of the generally horizontal surface and the fourth temporary set of crown facets, the fifth final set of crown facets being formed at an angle of between about 8° and about 18° relative to the generally horizontal upper surface, a remainder of the fourth temporary set of crown facets forming a fifth final set of crown facets, such that the upper portion of the gemstone is formed from the first, second, third, fourth, and fifth final sets of crown facets.

Alternative Implementation 37. The method of Alternative Implementation 36, further comprising forming a girdle defining a perimeter of the gemstone, the girdle having a pear-shaped cross-section with a first rounded end and a second tapered end narrower than the first rounded end.

Alternative Implementation 38. A method of forming a pavilion of a gemstone having a horizontal upper surface, comprising: forming a first temporary set of pavilion facets, the first temporary set of pavilion facets being formed at an angle of between about 41° and about 45° relative to the horizontal upper surface, the first temporary set of facets forming a lower point; forming a second temporary set of pavilion facets on the lower portion of the gemstone from portions of the first temporary set of pavilion facets, the second temporary set of facets being formed at an angle of between about 36.5° and about 40° relative to the horizontal upper surface, a remainder of the first temporary set of pavilion facets forming a third temporary set of pavilion facets; forming a fourth temporary set of pavilion facets on the lower portion of the gemstone from portions of the second temporary set of pavilion facets and the third temporary set of pavilion facets, the fourth temporary pavilion facets being formed at an angle of between about 33° and about 45° relative to the horizontal upper surface, a remainder of the second temporary set of pavilion facets forming a first final set of pavilion facets, a remainder of the third temporary set of pavilion facets forming a fifth temporary set of pavilion facets; and forming a second final set of pavilion facets on the lower portion of the gemstone from portions of the fourth temporary set of pavilion facets and the fifth temporary set of pavilion facets, the second final set of pavilion facets being formed at an angle of between about 42° and about 54°, a remainder of the fourth temporary set of pavilion facets forming a third final set of pavilion facets, a remainder of the fifth temporary set of pavilion facets forming a fourth final set of pavilion facets, such that the lower portion of the gemstone is formed from the first, second, third, and fourth final sets of pavilion facets.

Alternative Implementation 39. The method of Alternative Implementation 38, further comprising forming a girdle defining a perimeter of the gemstone, the girdle having a pear-shaped cross-section with a first rounded end and a second tapered end narrower than the first rounded end.

What is claimed is:

1. A method of forming a crown of a pear-shaped gemstone, comprising:

forming a girdle defining a perimeter of the gemstone, the girdle having a pear-shaped cross-section, the pear-shaped cross section being an oval shape with a first rounded end and a second tapered end opposing the first rounded end, the second tapered end being narrower than the first rounded end;

forming a first preliminary table on an upper portion of the gemstone, the first preliminary table defining a generally flat upper surface of the gemstone;

forming a first temporary set of crown facets on the upper portion of the gemstone;

forming a second temporary set of crown facets on the upper portion of the gemstone from a portion of the first preliminary table and a portion of each of the first temporary set of crown facets, such that the first preliminary table is reduced in size to form a second preliminary table and a remainder of the first temporary set of crown facets forms a third temporary set of crown facets;

forming a fourth temporary set of crown facets on the upper portion of the gemstone from a portion of the second preliminary table and a portion of each of the second temporary set of crown facets, such that the second preliminary table is reduced in size to form a third preliminary table and a remainder of the second temporary set of crown facets forms a first final set of crown facets;

forming a second final set of crown facets on the upper portion of the gemstone from a portion of each of the third temporary set of crown facets, such that a remainder of the third temporary set of crown facets forms a third final set of crown facets; and forming a fourth final set of crown facets on the upper portion of the gemstone from a portion of the third preliminary table and a portion of each of the fourth temporary set of crown facets, such that the third preliminary table is reduced in size to form a final table and a remainder of the fourth temporary set of crown facets forms a fifth final set of crown facets.

2. The method of claim 1, wherein:

each facet of the first final set of crown facets is disposed at least partially between two of the third final set of crown facets and two of the fifth final set of crown facets;

each adjacent pair of the second final set of crown facets is disposed at least partially between the girdle and two facets of the third final set of crown facets;

each facet of the third final set of crown facets is disposed at least partially between two facets of the first final set of crown facets and two facets of the second final set of crown facets;

each facet of the fourth final set of crown facets is disposed adjacent to and abutting the final table; and each facet of the fifth final set of crown facets is disposed two facets of the first final set of crown facets and two facets of the fourth final set of crown facets.

3. The method of claim 1, wherein:

each facet of the first final set of crown facets abuts an edge of each of two facets of the third final set of crown facets and an edge of each of two facets of the fifth final set of crown facets;

each facet of the second final set of crown facets abuts an edge of the girdle, an edge of one other facet of the second final set of crown facets, and an edge of one facet of the third final set of crown facets;

each facet of the third final set of crown facets abuts an edge of each of two facets of the first final set of crown facets and an edge of each of two facets of the second final set of crown facets;

each facet of the fourth final set of crown facets abuts an edge of the final table and an edge of each of two facets of the fifth final set of crown facets; and each facet of the fifth final set of crown facets abuts an edge of each of two facets of the first final set of crown facets and an edge of each of two facets of the fourth final set of crown facets.

4. The method of claim 1, wherein the gemstone has a table percentage between about 25% and about 45%.

5. The method of claim 1, wherein the gemstone has a top depth percentage between about 15% and about 35%.

6. The method of claim 1, wherein each facet in the first final set of crown facets is disposed at a first angle relative to the final table, each facet in the second final set of crown facets is disposed at a second angle relative to the final table, each facet in the third final of final crown facets is disposed at a third angle relative to the final table, each facet in the fourth final of final crown facets is disposed at a fourth angle relative to the final table, and each facet in the fifth final of final crown facets is disposed at a fifth angle relative to the final table.

7. The method of claim 6, wherein first angle is between about 15° and about 40°, the second angle is between about 40° and about 60°, the third angle is between about 20° and about 55°, the fourth angle is between about 3° and about 20°, and the fifth angle is between about 8° and about 30°.

8. The method of claim 1, wherein:

the final table has a generally octagonal shape;

each facet of the first final set of crown facets, the third final set of crown facets, and the fifth final set of crown facets is kite-shaped; and each facet of the second final set of crown facets and the fourth final set of crown facets is triangle-shaped.

9. The method of claim 1, wherein:

the second tapered end of the cross-section of the gemstone terminates in a point;

the pear-shaped cross section is symmetric across a first axis an extending between the first rounded end and the second tapered end; and the pear-shaped cross-section is asymmetric across a second axis that is perpendicular to the first axis.

10. A method of forming a pavilion of a pear-shaped gemstone, comprising:

forming a girdle defining a perimeter of the gemstone, the girdle having a pear-shaped cross-section, the pear-shaped cross section being an oval shape with a first rounded end and a second tapered end opposing the first rounded end, the second tapered end being narrower than the first rounded end;

forming a first temporary set of pavilion facets on a lower portion of the gemstone;

forming a second temporary set of pavilion facets on the lower portion of the gemstone from a portion of each of the first temporary set of pavilion facets, such that a remainder of the first temporary set of pavilion facets forms a third temporary set of pavilion facets;

forming a fourth temporary set of pavilion facets on the lower portion of the gemstone from a portion of each of the second temporary set of pavilion facets and each of the third temporary set of pavilion facets, such that a remainder of the second temporary set of pavilion facets forms a first final set of pavilion facets and a remainder of the third temporary set of pavilion facets forms a fifth temporary set of pavilion facets; and forming a second final set of pavilion facets on the lower portion of the gemstone from a portion of each of the fourth temporary set of pavilion facets and a portion of each of the fifth temporary set of pavilion facets, such that a remainder of the fourth temporary set of pavilion facets forms a third final set of pavilion facets and a remainder of the fifth temporary set of pavilion facets forms a fourth final set of pavilion facets.

11. The method of claim 10, wherein:

the first final set of pavilion facets form a lower point of the pavilion;

each pair of adjacent facets of the second final set of pavilion facets is disposed at least partially between the girdle, one facet of the third final set of pavilion facets, and two facets of the fourth final set of pavilion facets;

a lower portion of each facet of the third final set of pavilion facets is disposed at least partially between two facets of the first final set of pavilion facets;

an upper portion of each facet of the third final set of pavilion facets is disposed at least partially between two facets of the first final set of pavilion facets;

each facet of the fourth final set of pavilion facets is disposed at least partially between two facets of the third final set of pavilion facets.

12. The method of claim 10, wherein:

each facet of the first final set of pavilion facets abuts an edge of each of two other facets of the first final set of pavilion facets, an edge of each of two facets of the third final set of pavilion facets, and an edge of one facet of the fourth final set of pavilion facets;

each facet of the second final set of pavilion facets abuts the girdle, an edge of one other facet of the second final set of pavilion facets, an edge of one facet of the third final set of pavilion facets, and an edge of one facet of the fourth final set of pavilion facets;

each facet of the third final set of pavilion facets abuts an edge of each of two facets of the first final set of pavilion facets, an edge of each of two facets of the second final set of pavilion facets, and an edge of each of two facets of the fourth final set of pavilion facets; and each facet of the fourth final set of pavilion facets abuts an edge of one facet of the first final set of pavilion facets, an edge of each of two facets of the second final set of pavilion facets, and an edge of each of two facets of the third final set of pavilion facets.

13. The method of claim 10, wherein the gemstone has a bottom depth percentage between about 40% to about 60%.

14. The method of claim 10, wherein the gemstone has a table that defines a generally flat upper surface thereof, and wherein each facet in the first final set of pavilion facets is disposed at a first angle relative to the table, each facet in the second final set of pavilion facets is disposed at a second angle relative to the table, each facet in the third final of final pavilion facets is disposed at a third angle relative to the table, and each facet in the fourth final of final pavilion facets is disposed at a fourth angle relative to the table.

15. The method of claim 14, wherein first angle is between about 25° and about 50°, the second angle is between about 35° and about 60°, the third angle is between about 20° and about 55°, and the fourth angle is between about 25° and about 55°.

16. The method of claim 10, wherein:

each facet of the first final set of pavilion facets and the fourth final set of pavilion facets is pentagon-shaped;

each facet of the second final set of pavilion facets has four edges; and each facet of the third final set of pavilion facets has six edges.

17. The method of claim 10, wherein:

the second tapered end of the cross-section of the gemstone terminates in a point;

the pear-shaped cross section is symmetric across a first axis an extending between the first rounded end and the second tapered end; and the pear-shaped cross-section is asymmetric across a second axis that is perpendicular to the first axis.

18. A method of forming a gemstone, the method comprising:

forming a girdle defining a perimeter of the gemstone, the girdle having a pear-shaped cross-section, the pear-shaped cross section being an oval shape with a first rounded end and a second tapered end opposing the first rounded end, the second tapered end being narrower than the first rounded end;

forming a first preliminary table on an upper portion of the gemstone, the first preliminary table defining a generally flat upper surface of the gemstone;

forming a first temporary set of crown facets on the upper portion of the gemstone;

forming a second temporary set of crown facets on the upper portion of the gemstone from a portion of the first preliminary table and a portion of each of the first temporary set of crown facets, such that the first preliminary table is reduced in size to form a second preliminary table and a remainder of the first temporary set of crown facets forms a third temporary set of crown facets;

forming a fourth temporary set of crown facets on the upper portion of the gemstone from a portion of the second preliminary table and a portion of each of the second temporary set of crown facets, such that the second preliminary table is reduced in size to form a third preliminary table and a remainder of the second temporary set of crown facets forms a first final set of crown facets;

forming a second final set of crown facets on the upper portion of the gemstone from a portion of each of the third temporary set of crown facets, such that a remainder of the third temporary set of crown facets forms a third final set of crown facets;

forming a fourth final set of crown facets on the upper portion of the gemstone from a portion of the third preliminary table and a portion of each of the fourth temporary set of crown facets, such that the third preliminary table is reduced in size to form a final table and a remainder of the fourth temporary set of crown facets forms a fifth final set of crown facets;

forming a first temporary set of pavilion facets on a lower portion of the gemstone;

forming a second temporary set of pavilion facets on the lower portion of the gemstone from a portion of each of the first temporary set of pavilion facets, such that a remainder of the first temporary set of pavilion facets forms a third temporary set of pavilion facets;

forming a fourth temporary set of pavilion facets on the lower portion of the gemstone from a portion of each of the second temporary set of pavilion facets and each of the third temporary set of pavilion facets, such that a remainder of the second temporary set of pavilion facets forms a first final set of pavilion facets and a remainder of the third temporary set of pavilion facets forms a fifth temporary set of pavilion facets; and forming a second final set of pavilion facets on the lower portion of the gemstone from a portion of each of the fourth temporary set of pavilion facets and a portion of each of the fifth temporary set of pavilion facets, such that a remainder of the fourth temporary set of pavilion facets forms a third final set of pavilion facets and a remainder of the fifth temporary set of pavilion facets forms a fourth final set of pavilion facets.

19. The method of claim 18, wherein the gemstone has a total depth percentage between about 70% and about 90%.

20. The method of claim 18, wherein the gemstone has a girdle thickness percentage that is less than 10%.

* * * * *